US010851312B1

(12) United States Patent
Perez-Cordova

(10) Patent No.: US 10,851,312 B1
(45) **Date of Patent: *Dec. 1, 2020**

(54) FLASH CHEMICAL IONIZING PYROLYSIS OF HYDROCARBONS

(71) Applicant: Racional Energy & Environment Company, Conroe, TX (US)

(72) Inventor: Ramon Perez-Cordova, Conroe, TX (US)

(73) Assignee: Racional Energy & Environment Company, Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/841,562

(22) Filed: Apr. 6, 2020

Related U.S. Application Data

(60) Continuation-in-part of application No. 16/663,838, filed on Oct. 25, 2019, now Pat. No. 10,611,969, (Continued)

(51) Int. Cl.
*C10G 11/02* (2006.01)
*C10G 11/04* (2006.01)
(Continued)

(52) U.S. Cl.
CPC ..... *C10G 11/04* (2013.01); *C10G 11/02* (2013.01); *C10G 11/08* (2013.01); *C10G 11/16* (2013.01);
(Continued)

(58) Field of Classification Search
CPC ..... C10G 11/00–04; C10G 11/08
See application file for complete search history.

(56) References Cited

U.S. PATENT DOCUMENTS 2,088,214 A 7/1937 Pfirrmann
2,455,696 A 12/1948 Mosesman
(Continued)

FOREIGN PATENT DOCUMENTS

CA 2470695 12/2004
CN 101786685 A 11/2011
(Continued)

OTHER PUBLICATIONS

Bach, Robert D. et al., "Thermochemistry of Iron Chlorides and Their Positive and Negative Ions," J. Phys. Chem. 100, 8770-8776 (1996).

(Continued)

*Primary Examiner* — Renee Robinson
(74) *Attorney, Agent, or Firm* — Daniel N. Lundeen; Lundeen & Lundeen PLLC

(57) ABSTRACT

Flash chemical ionizing pyrolysis (FCIP) process. The FCIP includes mixing an iron source material, an alkali or alkaline earth metal chloride source material, an aqueous phase, and an oil component to form a feed emulsion; introducing the feed emulsion into an FCIP reactor at a temperature greater than about 400° C. up to about 600° C., a pressure from 10 to 50 psia and a residence time of 0.1 to 10 seconds, to form an FCIP effluent; and condensing a liquid ionizing pyrolyzate (LIP) from the effluent. The feed emulsion can be free of added solids other than the iron source material, the alkali or alkaline earth metal chloride source material, and any sediment in the oil component.

31 Claims, 10 Drawing Sheets

Related U.S. Application Data which is a continuation-in-part of application No. 16/433,021, filed on Jun. 6, 2019, now Pat. No. 10,557,089, which is a division of application No. 14/957,659, filed on Dec. 3, 2015, now Pat. No. 10,336,946.

(60) Provisional application No. 62/989,303, filed on Mar. 13, 2020, provisional application No. 62/750,708, filed on Oct. 25, 2018, provisional application No. 62/087,148, filed on Dec. 3, 2014, provisional application No. 62/087,164, filed on Dec. 3, 2014.

(51) Int. Cl.

| | |
|---|---|
| ***C10G 11/08*** | (2006.01) |
| ***C10G 11/16*** | (2006.01) |
| *B01F 3/08* | (2006.01) |

(52) U.S. Cl.

CPC .. *B01F 2003/0842* (2013.01); *C10G 2300/70* (2013.01)

(56) References Cited

U.S. PATENT DOCUMENTS

| | | | | |
|---|---|---|---|---|
| 2,835,553 | A | 5/1958 | Rufford et al. | |
| 3,173,853 | A | 3/1965 | Peralta | |
| 3,213,037 | A | 10/1965 | Hodgkiss | |
| 3,544,650 | A | 12/1970 | Garwood | |
| 3,544,659 | A | 12/1970 | Schwab et al. | |
| 3,721,632 | A | 3/1973 | Miller et al. | |
| 3,926,847 | A | 12/1975 | Beard et al. | |
| 3,960,706 | A | 6/1976 | McCollum et al. | |
| 3,979,332 | A | 9/1976 | Kiovsky et al. | |
| 4,039,651 | A | 8/1977 | Knoche | |
| 4,405,445 | A | 9/1983 | Kovach et al. | |
| 4,545,974 | A | 10/1985 | Thompson | |
| 4,557,821 | A | 12/1985 | Lopez et al. | |
| 4,743,357 | A | 5/1988 | Patel et al. | |
| 4,804,803 | A | 2/1989 | Schmidt et al. | |
| 5,688,395 | A | 11/1997 | Carrazza et al. | |
| 5,885,441 | A * | 3/1999 | Pereira | C10B 57/06 208/130 |
| 6,774,149 | B1 | 8/2004 | Gagnon | |
| 7,585,406 | B2 | 9/2009 | Khadzhiev et al. | |
| 8,006,758 | B2 | 8/2011 | Reynolds et al. | |
| 8,372,441 | B2 | 2/2013 | Thompson et al. | |
| 8,455,405 | B2 | 6/2013 | Chakrabarty | |
| 8,481,602 | B2 | 7/2013 | Gagnon | |
| 8,663,607 | B2 | 3/2014 | Monzyk et al. | |
| 10,336,946 | B2 | 7/2019 | Perez-Cordova | |
| 2007/0113736 | A1 | 5/2007 | Bandosz | |
| 2010/0147743 | A1 | 6/2010 | MacArthur et al. | |
| 2011/0059009 | A1 | 3/2011 | Amendola | |
| 2014/0315764 | A1 | 10/2014 | Perez-Cordova | |
| 2014/0360917 | A1 | 12/2014 | Park et al. | |
| 2016/0039669 | A1 | 2/2016 | Brunet | |
| 2016/0160131 | A1 | 6/2016 | Perez-Cordova | |

FOREIGN PATENT DOCUMENTS

| | | |
|---|---|---|
| EP | 1496016 | 1/2005 |
| EP | 1386881 | 7/2016 |
| GB | 902338 | 8/1962 |
| GB | 2313131 | 11/1997 |
| JP | 2015164909 | 9/2015 |
| WO | 2013066089 | 5/2013 |

OTHER PUBLICATIONS

Bouarab, R. et al., "Hydrogen Production from the Water-Gas Shift Reaction on Iron Oxide Catalysts," Hindawi Publishing Company, Journal of Catalysts, vol. 2014, Articl ID 612575, [http://]dx.doi.org/10.1155/2014/612575.

Cetco, Technical Breference GN-001, "Sodium Bentonite: Its Structure and Properties," (2013).

Eser, Semih, "Chemistry of Catalytic Cracking," Penn State, FSC 432 Petroleum Processing, downloaded from [https://www.]e-education.psu.edu/fsc432/content/chemistry-catalytic-cracking Jun. 6, 2018.

Extended EP Search Report, EP A 15866292, dated Jun. 6, 2018.

Freyland, W., "Coulombic Fluids," Springer Series in Solid-State Sciences 169, DOI 10.1007/978-3-642-17779-8 2, Springer-Verlag Berlin Heidelberg (2011).

Funai, S. et al., "Recovery of useful lighter fuels from petroleum residual oil by oxidative cracking with steam using iron oxide catalyst," Chemical Engineering Science [online], Jan. 1, 2010 (Jan. 1, 2010) [Retrieved on Aug. 3, 2016), vol. 54, Issue 1, Retrieved from internet: <DOI: 10.1016/j.ces.2009.03.028>, pp. 60-65.

Ghosh, Upasana et al., "Review—Hydrocracking using Different Catalysts," Chemical and Process Engineering Reseawrch, vol. 345 (2015). Iron.atomistry.com/ferric_chloride.html, "Ferric chloride, FeCl3," available at [http://]ironatomistry.com/ferric_chloride.html, (2008).

International Search Report, PCT/US2015/063582, dated Jun. 8, 2016.

Johnstone, H.F., "The System Ferric Chloride-Sodium Chloride," Contribution from the Division of Chemical Engineering, Noyes Chemical Laboratory, University of Illinois, Feb. 1942.

Kanungo, S.B. et al., Abstract, "Thermal Dehydration and Decomposition of FeCh.xH2O," Journal of Thermal Analysis, vol. 46, 1487-1500 (1996).

Knauth, H.-D. et al., "Equilibrium Constant of the Gas Reaction Cl2O+H2O=2HOCI and the Ultraviolet Spectrum of HOCI," The Journal of Physical Chemistry, vol. 83, No. 12 (1979).

Koenig, "The Chemistry of the Metals," pp. 195-196 (1902).

Milliken, T.H., "Use of Clays as Petroleum Cracking Catalysts," Clay Technology in the Petroleum Industry, Clays and Clay Technology, Bull. 169, Part VIII, p. 314, (Jan. 1952).

Monin, et al., "Thermal Cracking of Heavy-Oil/Mineral Matrix Systems," SPE Reservoir Engineering, 1243, Nov. 1988.

Muthuvel, I. et al., "A new solid acid catalyst FeCl3/bentonite for aldol condensation under solvent-free condition," Indian Journal of Chemistry, vol. 55B, pp. 252-260 , Feb. 2016.

Pradisty, Novia Arinda et al., "Fe(III) Oxide-modified Indonesian Bentonite for Catalytic Photodegradation of Phenol in Water," Makara Journal of Science, 21/1. 25-33 (2017).

Rytwo, Giora, "Exchange Reactions in the Ca—Mg—Na-Montmorillonite System," Clays and Clay Minerals, Vo.44, No. 2, 276-285 (1996).

Sheth, Atul C. et al., "Catalytic Gasification of Coal Using Eutectic Salts: Recovery, Regeneration, and Recycle of Spent Eutectic Catalysts," Journal of the Air and Waste Management Association, 53:4, 451-460, DOI: 10.1080/10473289.2003.10466179 (2012).

Written Opinion, PCT/US2015/063582, dated Jun. 8, 2016.

Yang, Xue-jing et al., "Iron Oxychloride (FeOCI): an Efficient Fenton-like catalyst for Producing Hydroxyl Radical in Degradatiuon of Organbic Contaminants," Journal of the American Chemical Society, 2013, 135, 16058-16061 (2013).

Recommended Practice for Field Testing Oil-Based Drilling Fluids, API Recommended Practice 13B-2, Fifth Edition [Draft], Apr. 12, 2012; retrieved from internet (http://ballots.api.org/ecs/sc13/ballots/docs/12b-2-5th-Ed-Draft-20120424.pdf), 156 pp; entire document.

Wong, S. et al., Crude oil emulsion: A review on formation, classification, and stability of water-in-oil emulsions, Journal of Petroleum Science and Engineering, 2015, vol. 135, pp. 498-504, Abstract.

Fumoto et al., Recovery of Useful Hydrocarbons from Petroleum Residual Oil by Catalytic Cracking with Steam over Zirconia-Supporting Iron Oxide Catalyst, Energy & Fuels, 2004, 18, 1770-1774.

PCT/US15/63582; Invitation to Pay Additional Fees; dated Mar. 24, 2016.

Yang, Ming-Gang and Eser, Semih, Upgrading a High Asphaltene Content Petroleum Residue by Hydrogenation with a NiMo-supported Catalyst, Fuel Scientc Program and the Energy Institute, pp. 471-475.

(56) References Cited

OTHER PUBLICATIONS

Powers, Edward Joseph, Thermochemical Water Splitting Cycles: Oxygen Liberation Reactions, M.S. Thesis Submitted to Iowas State University 1975.
Haseli, Yousef, Analysis of Hydrodynamic Transport Phenomena in a Fluidized Bed for Thermochemical Hydrogen Production. Thesis Submitted to University of Ontario Institute of Technology, Apr. 2008.
Mavroyannis, C. and Winkler, C.A., The Reaction of Nitrogen Atoms With Hydrogen Atoms, Canadian Journal of chemistry, vol. 40, 1062, pp. 240-245.
Nanda, Awn K., The Kinetics of the Reverse Deacon Reaction, Iowa State University, 1981.
Kawamura, Fumio and Taniguchi, Takashi, Synthesis of Ammonia Using Sodium Melt, Scientific Reports, 7: 11578, Sep. 14, 2017, pp. 1-4.
Wada, Shin-Ichiro and Weerasooriya, Janaki Deepa, Sodium-calcium, calcium-potassium, and potassium-sodium exchange equilibria on a montmorillonitic soil, Soil Science and Plant Nutrition, 2012, 36:3, 451-459.
Ganiev, I.M., et al., Reactions of Chlorine Dioxide with Organic Compounds, Eurasian ChemTech Journal, 7 (2005) 1-31.
Knoche, K.F. et al., A Thermochemical Process for Hydrogen Production, International Journal of Hydrogen Energy, vol. 1, pp. 23-32, Pergamon Press, 1976.
Subrt, J. and Tobola, K., DTA Study of the Kinetics of Sodium Hydride Decomposition, Journal of Thermal Analysis, vol. 10 (1976) pp. 5-12.
Chuzlov, Viacheslav A. et al., Simulation of Light Naphtha Isomerization Process, Procedia Chemistry 15 (2015) pp. 282-287.
Computed Potential Energy Surfaces for Chemical Reactions, National Aeronautics and Space Administration Ames Research Center Moffett Field, 1990, pp. 1-20.
Okamoto, H., H—Na (Hydrogen-Sodium), Journal of Phase Equilibria and Diffusion, vol. 31, No. 5, 2010, p. 494.
Campano, Barlow R., The Kleingarn Regenerated Spent Acid at Increasing Ferrous (Fe+2) and Ferric Chloride (Fe+3) Content, Dec. 2012, pp. 1-18.
Bell, Osborne, Determination of elements in aqua regia and nitric acid digests by flame atomic absorption spectrometry, https://kipdf.com/determination-of-elements-in-aqua-regia-and-nitric-acid-digests-by-flame-atomic-_5b2dd949097c4708778b49a9.html, 2004, pp. 1-17.
Hardwick, T.J., The Rate Constant of the Reaction Between Ferrous Ions and Hydrogen Peroxide in Acid Solution, Canadian Journal of Chemistry, vol. 35, 1957, pp. 428-436.

* cited by examiner

FLASH CHEMICAL IONIZING PYROLYSIS OF HYDROCARBONS

CROSS REFERENCE TO RELATED APPLICATIONS

This application is a non-provisional of and claims the benefit of and priority to U.S. Ser. No. 62/989,303 filed Mar. 13, 2020. This application is a continuation-in-part of copending application Ser. No. 16/663,838, filed Oct. 25, 2019, now U.S. Pat. No. 10,611,969, which is a non-provisional of and claims the benefit of and priority to U.S. Ser. No. 62/750,708, filed Oct. 25, 2018, and which is a continuation-in-part of U.S. Ser. No. 16/433,021, filed Jun. 6, 2019, now U.S. Pat. No. 10,557,089, which is a divisional of U.S. Ser. No. 14/957,659, filed Dec. 3, 2015, now U.S. Pat. No. 10,336,946 B2, which claims priority benefit to my earlier U.S. provisional application Nos. 62/087,148, filed Dec. 3, 2014, and 62/087,164, filed Dec. 3, 2014. All priority documents are herein incorporated by reference in their entireties.

BACKGROUND

My earlier patent, U.S. Pat. No. 10,336,946 B2, discloses a process for upgrading heavy oil comprising feeding to a reactor an emulsion of heavy oil, water, and solid particulates comprising a mineral support and an oxide or acid addition salt of a Group 3-16 metal, and spraying the feed mixture in the reactor at a high temperature and low pressure.

My earlier patent, U.S. Pat. No. 10,611,969, discloses flash chemical ionizing pyrolysis of a hydrocarbon using a chemical ionizing additive comprising a mineral support and an oxide and/or acid addition salt of a Group 3-16 metal, e.g., by emulsifying water and an oil component with the additive; introducing the emulsion into a flash chemical ionizing pyrolysis (FCIP) reactor maintained at a temperature greater than about 400° C. up to about 600° C. and low pressure to form a chemical ionizing pyrolyzate effluent. Also disclosed is a process comprising the further steps of condensing a liquid ionizing pyrolyzate (LIP) from the effluent; combining a feedstock oil with the LIP to form a pyrolyzate-feedstock blend; and thermally processing the blend at a temperature above about 100° C. In these processes. A mineral support such as bentonite is introduced into the reactor system and necessitates the need for solids removal steps and equipment.

There remains a need for more efficient techniques and systems to refine and process petroleum and other hydrocarbons with ever higher yields of lighter, higher-value hydrocarbon products, while reducing the amount of resid and coke that must be handled. A solution would preferably: reduce the amount of solids introduced into the reactor and/or eliminate or reduce the size of solids removal equipment; be an upstream process to treat crude oil; minimize asphaltene and coke yields; improve saturates and/or aromatics yields; improve the quality of the saturates with increased isomerates production; improve lube oil base stock yields; minimize end product blending requirements; employ mild pressure conditions with a short residence time and high throughput using inexpensive chemical additives; reduce the need for feedstock pretreatment or conditioning to remove catalyst poisons; reduce the need for dewatering and/or desalting; facilitate crude pre-heating by minimizing fouling in the pre-heaters; and/or avoid adding hydrogen.

SUMMARY

The present invention discloses improvements to the process applicant refers to herein as "flash chemical ionizing pyrolysis" or FCIP, and a liquid ionizing pyrolyzate or LIP produced by the process. FCIP can be used as a method to pretreat crude oil, optionally without dewatering, to convert asphaltenes from the crude, and form a resulting LIP with a reduced sulfide content, increased isomerates content, and other improvements detailed hereinbelow.

It has been found, unexpectedly, that when the chemical ionizing additive is employed as a system of an iron source material and an alkali or alkaline earth metal chloride source material in an emulsion with water, the additive can be used without any mineral support and moreover, can achieve even higher conversion rates to liquid oil, a further reduction of coke make, and/or a further improved oil quality as reflected in lower density, lower viscosity, lower pour point, or the like, and without introducing excessive solids into the reactor system.

In one aspect, embodiments according to the present invention provide a hydrocarbon conversion process comprising: providing an iron source material (preferably an unsupported iron source material); providing an alkali or alkaline earth metal chloride source material; providing an aqueous phase; mixing the iron source material, the alkali or alkaline earth metal chloride source material, and the aqueous phase with an oil component to form a feed emulsion (preferably wherein the feed emulsion comprises less than 1 part by weight of added undissolved solids per 100 parts by weight of the oil component); introducing the feed emulsion into a flash chemical ionizing pyrolysis (FCIP) reactor maintained at a temperature greater than about 400° C. up to about 600° C. and a pressure from 10 to 50 psia to form a chemical ionizing pyrolyzate effluent; and condensing a liquid ionizing pyrolyzate (LIP) from the effluent.

In another aspect, embodiments according to the present invention provide a hydrocarbon conversion process comprising: reacting iron with a mixture of hydrochloric acid and nitric acid in the presence of water (preferably aqua regia) to form an iron source material; mixing the iron source material, an alkali or alkaline earth metal chloride source material, and an aqueous phase with an oil component to form an emulsion; introducing the emulsion into a flash chemical ionizing pyrolysis (FCIP) reactor maintained at a temperature greater than about 400° C. up to about 600° C. and a pressure from 10 to 50 psia for a residence time of from 0.1 to 10 seconds to form a chemical ionizing pyrolyzate effluent; and condensing a liquid ionizing pyrolyzate (LIP) from the effluent.

In a further aspect, embodiments of the present invention provide a hydrocarbon refinery process comprising the steps of: preparing a feed emulsion comprising (i) 100 parts by weight of an oil component, (ii) from about 1 to 100 parts by weight of water, (iii) from about 0.01 to 5 parts by weight of an iron source material, and (iv) from about 0.01 to 5 parts by weight of an alkali or alkaline earth metal chloride source material; spraying the feed emulsion in a flash chemical ionizing pyrolysis reactor at a temperature from about 400° C. to about 600° C.; collecting an effluent from the flash chemical ionizing pyrolysis reactor; and recovering a liquid ionizing pyrolyzate (LIP) from the effluent.

DETAILED DESCRIPTION

Definitions

Figure 1:
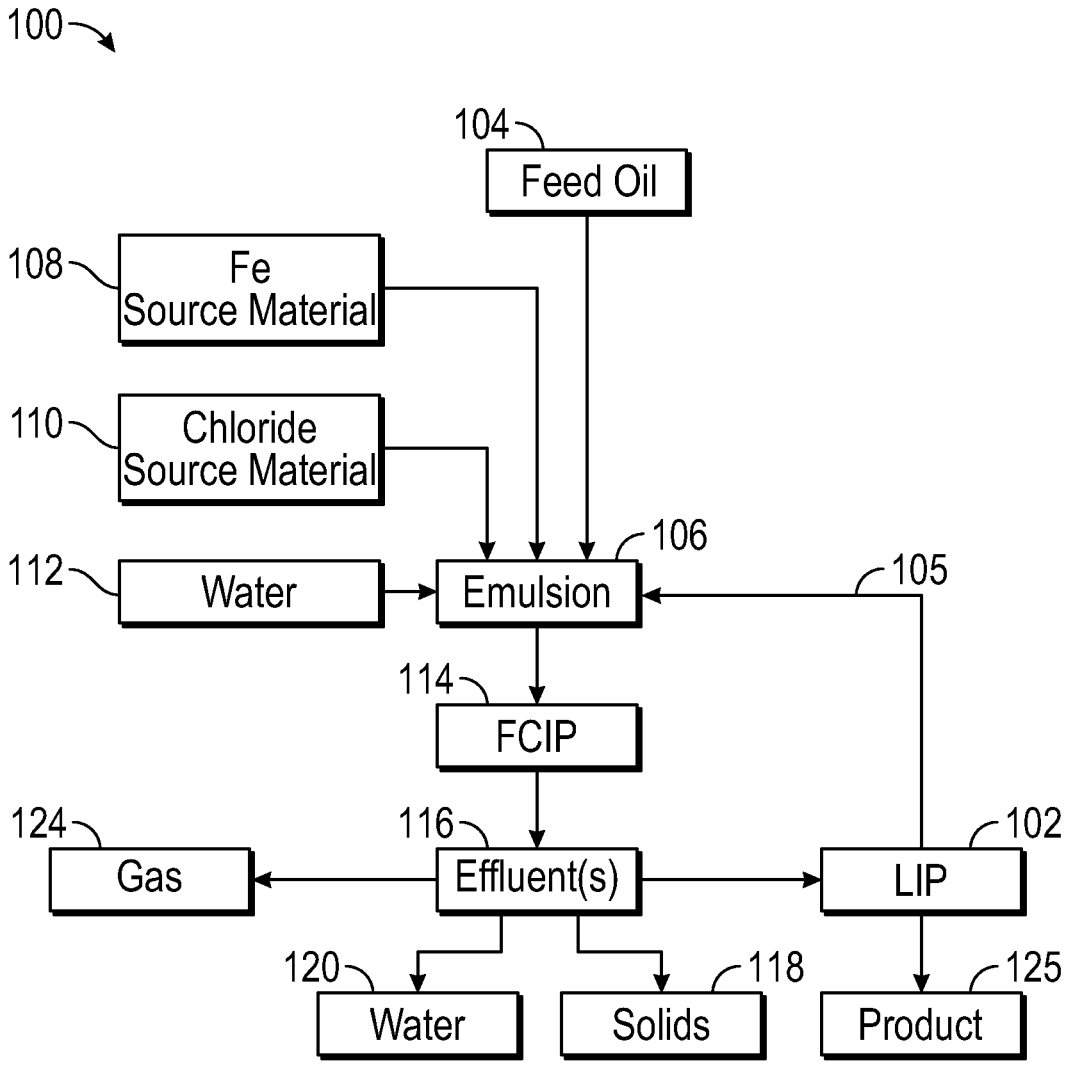
FIG. 1 shows a flash chemical ionizing pyrolysis (FCIP) process, according to embodiments of the present invention.

The words and phrases used herein should be understood and interpreted to have a meaning consistent with the understanding of those words and phrases by those skilled in the relevant art. No special definition of a term or phrase is intended except where such a special definition is expressly set forth in the specification. The following definitions are believed to be consistent with their understanding by the skilled person, and are provided for the purpose of clarification.

As used in the specification and claims, "near" is inclusive of "at." The term "and/or" refers to both the inclusive "and" case and the exclusive "or" case, whereas the term "and or" refers to the inclusive "and" case only and such terms are used herein for brevity. For example, a component comprising "A and/or B" may comprise A alone, B alone, or both A and B; and a component comprising "A and or B" may comprise A alone, or both A and B.

For purposes herein the term "alkylation" means the transfer of an alkyl group from one molecule to another, inclusive of transfer as an alkyl carbocation, a free radical, a carbanion or a carbene, or their equivalents.

For purposes herein, API refers to the American Petroleum Institute gravity (API gravity), which is a measure of the density of a petroleum product at 15.6° C. (60° F.) compared to water at 4° C., and is determined according to ASTM D1298 or ASTM D4052, unless otherwise specified. The relationship between API gravity and s.g. (specific gravity) is API gravity=(141.5/s.g.)−131.5.

As used herein, the term "aqua regia" refers to any concentrated mixture of hydrochloric and nitric acids.

As used herein, "asphaltenes" refer to compounds which are primarily composed of carbon, hydrogen, nitrogen, oxygen, and sulfur, but which may include trace amounts of vanadium, nickel, and other metals. Asphaltenes typically have a C:H ratio of approximately 1:1.1 to about 1:1.5, depending on the source. Asphaltenes are defined operationally as the n-heptane ($C_7H_{16}$)-insoluble, toluene ($C_6H_5CH_3$)-soluble component of a carbonaceous material such as crude oil, bitumen, or coal. Asphaltenes typically include a distribution of molecular masses in the range of about 400 g/mol to about 50,000 g/mol, inclusive of aggregates.

For purposes herein the term "atmospheric distillation" means distillation where an uppermost stage is in fluid communication with the atmosphere or with a fluid near atmospheric pressure, e.g., less than 5 psig.

For purposes herein, the abbreviation AET refers to "atmospheric equivalent temperature" of distillation, which is the temperature calculated from an observed vapor temperature at a pressure below atmospheric according to the Maxwell and Bonnell equations as described in Annex A9 to ASTM D2892-18a.

As used herein, "atomization" refers to spraying that forms a fine mist of droplets or particles of less than 20 microns.

For purposes herein the term "blending" means combining two or more ingredients regardless of whether any mixing is used.

For purposes herein the term "calcination" refers to heating a material in air or oxygen at high temperatures, e.g., at or above about 400° C.

For purposes herein the term "catalyst" means a substance that increases the rate of a chemical reaction usually but not always without itself undergoing any chemical change. For example, noble metal catalysts can become slowly poisoned as they contact deleterious substances.

As used herein, "clay" refers to a fine-grained material comprising one or more clay minerals, i.e., a mineral from the kaolin group, smectite group (including montmorillonite), illite group, or chlorite group, or other clay types having a 2:1 ratio of tetrahedral silicate sheets to octahedral hydroxide sheets.

For purposes herein the term "coking" refers to the thermal cracking of resid in an oil refinery processing unit known as a "coker" that converts a heavy oil such as the residual oil from a vacuum distillation column into low molecular weight hydrocarbon gases, naphtha, light and heavy gas oils, and petroleum coke. Coking is typically effected at a temperature of about 480° C.

For purposes herein the term "cracking" means the process whereby complex organic molecules are broken down into simpler molecules by the breaking of carbon-carbon bonds in the precursors. "Thermal cracking" refers to the cracking of hydrocarbons by the application of temperature, typically but not always 500-700° C. and sometimes also pressure, primarily by a free radical process, and is characterized by the production of light hydrocarbon gases, $C_4$-$C_{15}$ olefins in moderate abundance, little aromatization, little or no branched chain alkanes, slow double bond isomerization, little or no skeletal isomerization, β-scission of alkylaromatics, and/or slow cracking of naphthenes. "Catalytic cracking" refers to the cracking of hydrocarbons in the presence of a catalyst, typically but not always at 475-530° C. that forms ionic species on catalyst surfaces, and is characterized by the production of little or no methane and/or ethane, little or no olefins larger than $C_4$, some aromatization of aliphatic hydrocarbons, rapid skeletal isomerization and branched chain alkanes, rapid olefin isomerization, α-scission or dealkylation of alkylaromatics, and/or cracking of naphthenes and n-paraffins at comparable rates. "Hydrocracking" refers to cracking in the presence of hydrogen, typically but not always at 260-425° C. and using a bifunctional catalyst comprising an acid support such as silica, alumina, and/or zeolite, and a metal, resulting in hydrogenation or saturation of aromatic rings and decyclization.

For purposes herein the term "crude oil" means an unrefined liquid mixture of hydrocarbons that is extracted from certain rock strata.

For purposes herein the term "desalting" means the removal of salt from petroleum in a refinery unit referred to as a "desalter" in which the crude oil is contacted with water and separated to remove the salt in a brine.

For purposes herein the term "distillation" means the process of separating components or substances from a liquid mixture by selective boiling and condensation.

For purposes herein, "distillation temperature" refers to the distillation at atmospheric pressure or the AET in the case of vacuum distillation, unless otherwise indicated.

For purposes herein the term "emulsion" means a mixture of immiscible liquids in a discontinuous dispersed phase and a continuous phase, optionally including dispersed solids.

For purposes herein, "essentially free of" means a material is free of the stated component or contains such a minor amount of the component that it is inconsequential to the essential function of the material, or in any case the component is present in an amount of less than 1 percent by weight of the material.

For purposes herein, "ferrates" refers to a material that can be viewed as containing anionic iron complexes, e.g., tetrachloroferrate. Hydrates of $FeCl_3$ generally feature tetrachloroferrate ions.

For purposes herein the term "flash pyrolysis" means thermal reaction of a material at a very high heating rate (e.g., ≥450° C./s, preferably ≥500° C.) with very short residence time (e.g., ≤4 s, preferably ≤2 s).

For purposes herein the term "flash chemical ionizing pyrolysis" or "FCIP" means flash pyrolysis of a material in the presence of a chemical additive to promote ionization and/or free radical formation and is sometimes referred to as "catalytic pyrolysis" as described in U.S. Pat. No. 10,336,946 B2.

For purposes herein "finely divided" refers to particles having a major dimension of less than 1 mm, and a minor dimension of less than 1 mm. A particulate "fine" is defined as a solid material having a size and a mass which allows the material to become entrained in a vapor phase of a thermodesorption process as disclosed herein, e.g., less than 250 microns, preferably less than 4 microns.

For purposes herein the term "hydrocarbon" means a compound of hydrogen and carbon, such as any of those that are the chief components of petroleum and natural gas. For purposes herein the term "naphtha" refers to a petroleum distillate with an approximate boiling range from 40° C. to 195° C., a "kerosene" from greater than 195° C. to 235° C., a "distillate" from greater than 235° C. to 370° C., and a "gas oil" from greater than 370° C. to 562° C.

For purposes herein the term "hydrocarbon conversion" means the act or process of chemically changing a hydrocarbon compound from one form to another.

For purposes herein, "incipient wetness loading" refers to loading a material on a support by mixing a solution and/or slurry of the material with a dry support such that the liquid from the solution and/or slurry enters the pores of the support to carry the material into the pores with the slurry, and then the carrier liquid is subsequently evaporated. Although not technically "incipient", in the present disclosure and claims "incipient wetness loading" specifically includes the use of a volume of the solvent or slurry liquid that is in excess of the pore volume of the support material, where the liquid is subsequently evaporated from the support material, e.g., by drying.

For purposes herein, an "ionized" material refers to a material comprising ions or capable of dissociating into ions.

For purposes herein, an "ionizing" material refers to a process in which an ionized material is processed or the product from that process.

For purposes herein, an "iron chloride" generically refers to any compound comprising iron and chloride, including ferric chloride, ferrous chloride, iron oxychloride, and so on.

For purposes herein, "limited solubility" means that a material mostly does not dissolve in water, i.e., not more than 50 wt % of a 5 g sample is digested in 150 ml distilled water at 95° C. in 12 h; and "acid soluble" means that a material mostly dissolves in aqueous HCl, i.e., at least 50 wt % of a 5 g sample is digested in 150 ml of 20 wt % aqueous HCl at 95° C. in 12 h.

For purposes herein the term "liquid ionizing pyrolyzate" or "LIP" refers to an FCIP pyrolyzate that is liquid at room temperature and 1 atm, regardless of distillation temperature. In some embodiments, the LIP has blending characteristics indicative of the presence of ionized species and/or stable free radicals that can induce chemical and/or physical rearrangement of molecules or "normalization" in the blend components. For example, blending the LIP with crude containing asphaltenes results in viscosity changes that are more significant than would be predicted from conventional hydrocarbon blending nomographs, which is consistent with molecular rearrangement of the asphaltene molecules, including disaggregation. Such an unexpected viscosity reduction in turn produces unexpected increases in the efficiencies of thermal processes such as distillation, for example, employing the blend.

In some embodiments, the LIP has blending characteristics such that when blended with a specific blend oil, obtains a distillation liquid oil yield (<562° C.) that is greater than a theoretical liquid oil yield, and/or obtains a total resid yield (>562° C.) that is in an amount less than a theoretical resid yield, wherein the theoretical yields of the blend are calculated as a weighted average of the separate distillation of the LIP and blend oil alone, wherein yields are determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET. Preferably, the LIP has one, or preferably more, or more preferably all, of the following oil blending characteristics:

1) for a blend of Oil:LIP of 90:10, the liquid hydrocarbon yield, obtained from distillation of the blend up to a distillation temperature of 562° C., is equal to or greater than 1% (preferably at least 1.5%) more than the theoretical yield, wherein the percentage is absolute; and/or
2) for a blend of Oil:LIP of 90:10, a resid yield, obtained from the distillation of the blend that is decreased in an amount equal to or more than 1.5% (preferably at least 2.5%) of the theoretical resid yield, wherein the percentage is absolute; and/or 3) for a blend of Oil:LIP of 90:10, amounts of distillation of the blend into a first fraction <290° C., a second fraction 291-331° C., a third fraction 332-378° C., a fourth fraction 379-440° C., and a fifth fraction 441-531° C., are greater than theoretical amounts of the respective fractions, wherein the theoretical amounts of the blend fractions are calculated as weighted averages of the separate distillation of the LIP and blend oil alone; and/or 4) for a blend of Oil:LIP of 90:10, densities of fractions distilled into a first fraction <290° C., a second fraction 291-331° C., a third fraction 332-378° C., a fourth fraction 379-440° C., and a fifth fraction 441-531° C., are less than or equal to the densities in respective fractions obtained from distillation of the blend oil alone, preferably wherein the density in at least one of the distilled blend oil fractions is less than the density of the respective blend oil fraction(s); and/or 5) for a blend of Oil:LIP of 80:20, the liquid hydrocarbon yield, obtained from distillation of the blend up to a distillation temperature of 562° C., is equal to or greater than 1.5% (preferably at least 2.5%) more than the theoretical yield, wherein the percentage is absolute; and/or 6) for a blend of Oil:LIP of 80:20, a resid yield, obtained from the distillation of the blend that is decreased in an amount equal to or more than 2.5% (preferably at least 4%) of the theoretical resid yield, wherein the percentage is absolute; and/or 7) for a blend of Oil:LIP of 80:20, amounts of distillation of the blend into a first fraction <290° C., a second fraction 291-331° C., a third fraction 332-378° C., a fourth fraction 379-440° C., and a fifth fraction 441-531° C., are greater than theoretical amounts of the respective fractions, wherein the theoretical amounts of the blend fractions are calculated as weighted averages of the separate distillation of the LIP and blend oil alone; and/or 8) for a blend of Oil:LIP of 80:20, densities of fractions distilled into a first fraction <290° C., a second fraction 291-331° C., a third fraction 332-378° C., a fourth fraction 379-440° C., and a fifth fraction 441-531° C., are less than or equal to the densities in respective fractions obtained from distillation of the blend oil alone, preferably wherein the density in at least two, or more preferably in at least three, of the blend fractions is less than the density of the respective blend oil fraction(s).

9) for a blend of Oil:LIP of 70:30, the liquid hydrocarbon yield, obtained from distillation of the blend up to a distillation temperature of 562° C., is equal to or greater than 2% (preferably at least 3%) more than the theoretical yield, wherein the percentage is absolute; and/or 10) for a blend of Oil:LIP of 70:30, a resid yield, obtained from the distillation of the blend that is decreased in an amount equal to or more than 3% (preferably at least 5%) of the theoretical resid yield, wherein the percentage is absolute; and/or 11) for a blend of Oil:LIP of 70:30, amounts of distillation of the blend into a first fraction <290° C., a second fraction 291-331° C., a third fraction 332-378° C., a fourth fraction 379-440° C., and a fifth fraction 441-531° C., are greater than theoretical amounts of the respective fractions, wherein the theoretical amounts of the blend fractions are calculated as weighted averages of the separate distillation of the LIP and blend oil alone; and/or 12) for a blend of Oil:LIP of 70:30, densities of fractions distilled into a first fraction <290° C., a second fraction 291-331° C., a third fraction 332-378° C., a fourth fraction 379-440° C., and a fifth fraction 441-531° C., are less than or equal to the densities in respective fractions obtained from distillation of the blend oil alone, preferably wherein the density in at least two, or more preferably in at least three, of the blend fractions is less than the density of the respective blend oil fraction(s).

As used herein, unless indicated, a "liquid oil" or "liquid product" or "liquid hydrocarbon" refers to the fraction(s) of petroleum from distillation that are normally liquid at room temperature and 1 atm obtained at distillation temperatures from 29° C. to 562° C. AET, including gasoline blending components, naphtha, kerosene, jet fuel, distillates, diesel, heating oil, and gas oil; whereas a "resid" or "heavy product" or "heavy hydrocarbon" refers to the residual oil remaining after distillation to 562° C. AET, including resins, asphaltenes, and/or coke.

For purposes herein the term "oil" means any hydrophobic, lipophilic chemical substance that is a liquid at ambient temperatures.

All percentages are expressed as weight percent (wt %), based on the total weight of the particular stream or composition present, unless otherwise noted. All parts by weight are per 100 parts by weight oil, adjusted for water and/or solids in the oil sample (net oil), unless otherwise indicated. Parts of water by weight include water added as well as water present in the oil.

For purposes herein the term "pyrolysis" means decomposition brought about by high temperatures.

For purposes herein the term "ionizing pyrolyzate" means the oil condensed or otherwise recovered from the effluent of flash chemical ionizing pyrolysis.

Room temperature is 23° C. and atmospheric pressure is 101.325 kPa unless otherwise noted.

For purposes herein, SARA refers to the analysis of saturates, aromatics, resins, and asphaltenes in an oil sample. SARA can be determined by IP 143 followed by preparative HPLC (IP-368) or Clay-Gel (ASTM D-2007), or by IATROSCAN TLC-FID. For the purposes of the claims, in the event of a conflict, the results from ASTM D-2007 shall control.

For purposes herein, the term "spray" means to atomize or otherwise disperse in a mass or jet of droplets, particles, or small pieces.

For purposes herein, sulfur in crude oil and pyrolyzates is determined according to ASTM D-4294. A "high sulfur" oil is one containing more than 0.5 wt % sulfur as determined by ASTM D-4294.

For purposes herein the term "thermal processing" means processing at an elevated temperature, e.g., above 100° C.

For purposes herein, viscosity is determined at 40° C. and 100 $s^{-1}$, unless otherwise stated, or if the viscosity cannot be so determined at 40° C., the viscosity is measured at higher temperatures and extrapolated to 40° C. using a power law equation.

Flash Chemical Ionizing Pyrolysis of Hydrocarbons

Broadly, according to some embodiments of the invention, a hydrocarbon conversion process comprises: providing an iron source material; providing an alkali or alkaline earth metal chloride source material; providing an aqueous phase; mixing the iron source material, the alkali or alkaline earth metal chloride source material, and the aqueous phase with an oil component to form an ionized feed emulsion; introducing the ionized feed emulsion into a flash chemical ionizing pyrolysis (FCIP) reactor maintained at a temperature greater than about 400° C. up to about 600° C. and a pressure from 10 to 50 psia to form a chemical ionizing pyrolyzate effluent; and condensing a liquid ionizing pyrolyzate (LIP) from the effluent.

The iron source material can be any iron compound, e.g., iron oxides, hydroxides, oxyhydroxides, hydrates, halides, oxyhalides, hydrochlorides, nitrates, nitrites, or a mixture thereof. In any embodiment, the iron source material can comprise iron oxide, iron hydroxide, iron oxide-hydroxide, iron chloride, or preferably a mixture thereof. Preferably, the iron source material comprises hematite, magnetite, iron oxide hydroxide (preferably beta-ferric oxide hydroxide), or more preferably a mixture thereof, and even more preferably the iron source material further comprises chloride. In any embodiment the iron source material can comprise beta-ferric oxide hydroxide, and preferably further comprises chloride.

As an example, the iron source material can be the reaction product of iron with a mixture of hydrochloric acid and nitric acid in the presence of water (preferably aqua regia), which preferably forms a mixture of hematite, magnetite, and iron oxide hydroxide (preferably beta-ferric oxide hydroxide), and more preferably further comprises chloride. The process can include, for example, the step of reacting iron with a mixture of hydrochloric acid and nitric acid in the presence of water (preferably aqua regia) to form the iron source material.

The iron source material can be soluble in the water phase or the oil phase, or can be insoluble. Where the iron source material is insoluble, it preferably has a mean particle size of 10 microns or less, more preferably 4 microns or less, and especially less than 2 microns.

In an embodiment where it is desired to introduce the iron source materials and/or alkali/alkaline earth metal chloride source materials on a support, the iron source material and the alkali or alkaline earth metal chloride source material may comprise the product of the method comprising the steps of: treating iron with an aqueous mixture of hydrochloric and nitric acids to form a product mixture of hematite, magnetite, and iron oxide hydroxide (preferably beta-ferric oxide hydroxide), optionally comprising chloride; treating a support material such as montmorillonite, silica, zeolite, or the like, with an alkali or alkaline earth metal chloride brine and drying the treated support material; combining a slurry of the product mixture with the treated support material to load the product mixture on the support material; and heat treating the loaded support material, preferably at a temperature above 400° C.

If desired, the process can comprise first mixing the iron source material, the alkali or alkaline earth metal chloride source material, and the aqueous phase with a first portion of the oil component to form a pre-mix emulsion, and then mixing the pre-mix emulsion with a second portion of the oil component to form the feed emulsion. For example, the oil component can be present in the pre-mix emulsion in an amount equal to or less than 20 parts by weight per 100 parts by weight of the aqueous phase, e.g., from 1 to 10 parts by weight.

The iron source material can be present in the feed emulsion in an amount of from 0.01 up to 5 parts by weight, preferably 0.01 to 1 part by weight, and more preferably 0.05 to 1 part by weight, per 100 parts by weight of the oil component.

The alkali or alkaline earth metal chloride source material can be the chloride salt of any alkali metal and/or alkaline earth metal, e.g., NaCl, KCl, LiCl, $MgCl_2$, $CaCl_2$), $BaCl_2$, etc. The alkali or alkaline earth metal chloride source material is present in the feed emulsion in an amount of from 0.01 up to 5 parts by weight, preferably 0.01 to 1 part by weight, and more preferably 0.05 to 1 part by weight, per 100 parts by weight of the oil component. The chloride salt is preferably added with or in the aqueous phase, i.e., as a brine, or where a support is used, the chloride salt can be loaded on the support with (or without) the iron source material.

The iron source material can be unsupported or supported on a support material such as clay, silica, alumina, zeolite, or the like. In any embodiment, the feed emulsion can preferably be essentially free of added solids, e.g., clay solids, or essentially free of added mineral solids other than the iron source material and any sediment from the oil component(s). In preferred embodiments, the feed emulsion comprises less than 1 part by weight solids per 100 parts by weight oil, preferably less than 0.5 parts by weight solids per 100 parts by weight oil.

In embodiments, the iron source material is unsupported, and the feed emulsion comprises less than 1 part by weight of added undissolved solids per 100 parts by weight of the oil component.

In any embodiment, the feed emulsion comprises from 1 to 100 parts by weight water per 100 parts by weight total primary and blend oil components, preferably 5 to 50 parts by weight water, more preferably 5 to 20 parts by weight water.

In any embodiment, the reactor temperature is preferably from about 425° C. to about 600° C., more preferably 450° C. to 500° C. The reaction pressure is preferably equal to or greater than 10 psia up to 30 psia, more preferably equal to or less than 25 psia, even more preferably 1-1.5 atm absolute. Residence time in the flash chemical ionizing pyrolysis reactor can be from 0.1 up to 10 seconds, preferably from 0.5 to 4 seconds, and especially less than 2 seconds. The introduction step preferably comprises spraying the ionized feed emulsion in the flash chemical ionizing pyrolysis reactor, more preferably atomizing the ionized feed emulsion in the flash chemical ionizing pyrolysis reactor.

In any embodiment, the oil component can comprise hydrocarbons boiling at temperatures both less than and greater than 562° C., wherein the LIP is enriched in hydrocarbons boiling at a temperature less than 562° C., as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET. The oil component can be a crude oil, gas oil, resid, or a mixture thereof, preferably a heavy oil.

The process preferably further comprises combining a feedstock oil with the LIP to form a pyrolyzate-feedstock blend and thermally processing the blend at a temperature above about 100° C. The thermal processing can include pyrolysis, distillation, cracking, alkylation, visbreaking, coking, and so on, including combinations thereof. As one example, the process can further comprise supplying at least a portion of the pyrolyzate-feedstock blend as the oil component to the FCIP feed emulsion preparation step, i.e., the thermal processing step consists of or comprises the spraying of the FCIP feed emulsion into the FCIP reactor.

In embodiments, a hydrocarbon conversion process comprises the steps of: reacting iron with a mixture of hydrochloric acid and nitric acid in the presence of water (preferably aqua regia) to form an iron source material; mixing the iron source material, an alkali or alkaline earth metal chloride source material, and an aqueous phase with an oil component to form an emulsion; introducing the emulsion into a flash chemical ionizing pyrolysis (FCIP) reactor maintained at a temperature greater than about 400° C. up to about 600° C. and a pressure from 10 to 50 psia for a residence time of from 0.1 to 10 seconds to form a chemical ionizing pyrolyzate effluent; condensing a liquid ionizing pyrolyzate (LIP) from the effluent; and optionally blending the LIP with a feedstock oil and thermally processing the blend.

In embodiments, a hydrocarbon refinery process comprises the steps of: preparing an ionized feed emulsion comprising (i) 100 parts by weight of an oil component, (ii) from about 1 to 100 parts by weight of water, (iii) from about 0.01 to 5 parts by weight (preferably 0.01 to less than 1 part by weight) of an iron source material, and (iv) from about 0.01 to 5 parts by weight of a chloride source material; spraying the ionized feed emulsion in a flash chemical ionizing pyrolysis reactor at a temperature from about 400° C. to about 600° C.; collecting an effluent from the flash chemical ionizing pyrolysis reactor; and recovering a liquid ionizing pyrolyzate (LIP) from the effluent. The process can also include combining the recovered LIP with a feedstock oil comprising crude oil or a petroleum fraction selected from gas oil, resid, or a combination thereof to form a pyrolyzate-feedstock blend; distilling, cracking, visbreaking, and/or coking a first portion of the blend; and optionally supplying a second portion of the blend as the oil component in the feed emulsion preparation step. The LIP can exhibit a SARA analysis having higher saturates and aromatics contents and a lower asphaltenes content than the feedstock oil.

In this process, a proportion of the LIP in the oil component in the flash pyrolysis can be effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

Additionally in this process, a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

The feedstock oil may preferably be crude oil, which may be desalted or preferably un-desalted, but can also be, for example, gas oil, resid (atmospheric and/or vacuum), and the like, including mixtures or combinations. The LIP is present in a sufficient amount to enhance light oil enrichment and/or to reduce coke make in the thermal processing, e.g., reducing the Conradson carbon content of the thermal processing products. There is no upper limit on the amount of LIP that can be used, but excessive amounts may not be economical. The pyrolyzate-feedstock blend can comprise the LIP in a weight ratio of about 1:100 to 1:1, preferably from 1:100 to 1:2, more preferably from about 1:20 to 1:3, even more preferably from about 1:10 to 1:4. Preferably, the percentages of LIP and feedstock oil total 100, i.e., the blend consists essentially of or consists of the LIP and the feedstock oil.

The thermal processing is preferably distillation, e.g., atmospheric and/or vacuum distillation, and/or flash chemical ionizing pyrolysis (FCIP), which may optionally be used to produce the LIP, but the thermal processing can also be, for example, heating, cracking (thermal and/or catalytic), alkylation, visbreaking, coking, and so on, including combinations in parallel and/or series.

With reference to the embodiment of the invention shown in the simplified schematic flow diagram of FIG. 1, broadly, in process 100, a liquid ionizing pyrolyzate (LIP) 102 is optionally combined with a feed oil 104 in a blending step (not shown) or otherwise fed separately to emulsification in step 106 with iron source material 108, alkali/alkaline earth metal chloride source material 110 and water 112. LIP 102 from any source can be used, preferably from an FCIP process as described herein. The feed oil 104 can be any suitable hydrocarbon liquid, such as, for example, crude oil (including heavy crude oil), which can be desalted or un-desalted, petroleum distillation fractions (especially medium or heavy gas oil) or residue, waste oil, used lube oil, etc.

The emulsion from step 106 is supplied to FCIP instep 114 described in more detail hereinafter. One or more effluent(s) are separated in step 116 to obtain solids 118, water 120, LIP 102, and noncondensable gas 124.

When the feed oil 104 is crude oil, it is advantageously un-desalted since the inorganic components do not appear to adversely impact FCIP 114 and much of the inorganics can be recovered with the solids from FCIP. Since the inorganics are removed in FCIP process 100, the load on the desalter associated with treatment of the crude oil for feed to an atmospheric distillation can be reduced by the amount fed to the FCIP process 100. Moreover, the water content of the crude oil does not impact the FCIP 114 since the feed is in the form of an oil/water emulsion. In fact, it is preferred to use the water or brine from desalting as all or part of the water 112 for the emulsion preparation, thereby reducing the load on the desalter and reducing the amount of water that must be added to the emulsion in step 106. Further, the salt may form a eutectic mixture with one or more of the other additive components, e.g., $FeCl_3$, or otherwise enhance the catalytic and/or reactive activity of the iron and chloride source material.

The LIP 102 may optionally be supplied to the blending and/or emulsion step 106 along with or in lieu of another LIP stream from another FCIP source. The remaining LIP 102 can be produced as product 125 and/or optionally thermally processed by heating, distillation, cracking, visbreaking, coking, alkylation, reforming, etc. and/or directly supplied as product(s). If desired, water 120 recovered from the effluent may be recycled to the supply 112 and/or step 106 for the FCIP feed emulsion.

Preferably, a portion of the oil component in the FCIP feed emulsion from step 106 comprises a recycled portion of the product LIP via line 105. If used, the LIP can be used in the blend in a weight proportion of LIP 102: feed oil 104 of from 1:100 to 1:1, preferably in an amount from 1 to 40 wt % based on the total weight of the oil components supplied to the FCIP feed emulsion step 106, e.g., 1 to 40 wt % product LIP and 99 to 60 wt % feed oil, preferably 5 to 35 wt % product LIP and 95 to 65 wt % feed oil, more preferably 10 to 30 wt % product LIP and 90 to 70 wt % feed oil, based on the total weight of the oil component, preferably where the percentages of product LIP and feed oil in the LIP blend total 100.

One advantage of using emulsion from step 106 is that the oil, water, and iron/chloride source materials are intimately mixed prior to vaporization of the oil and water, which are in close contact with the iron/chloride additives, and the iron/chloride additives are already well-dispersed in liquid, promoting fluidization in the gas phase. For example, iron and/or chloride ions can associate with charged molecules in the oil component in the feed emulsion at low temperature, e.g. hetero atoms in asphaltene constituents, and thereby target these species for reaction upon decomposition or catalytic activation of the associated ion at the high temperature FCIP conditions.

Another advantageous feature of the present invention is that in some embodiments the emulsion from step 106 can have a viscosity that is lower, preferably an order of magnitude lower, than the corresponding oil components, which facilitates preparation, pumping, spraying, conversion, yield, etc., and can avoid adding solvent or diluent. For example, the feed mixture may be an emulsion having an apparent viscosity at 30° C. and 100 $s^{-1}$ at least 30% lower than the oil component alone. In embodiments, the emulsion has a viscosity of less than or equal to about 50 Pa-s (50,000 cP) at 50° C., or less than or equal to about 20 Pa-s at 50° C., or less than or equal to about 1 Pa-s (1000 cP) at 50° C., or less than about 500 mPa-s at 50° C. Accordingly, the emulsion may include heavy oil emulsified with water and the finely divided solids to produce a pumpable emulsion which facilitates adequate and uniform injection of the feed mixture into the pyrolysis chamber.

Also, in some embodiments the emulsion from step 106 can have a high stability that inhibits separation into oil or water phases and solids precipitation, which might otherwise result in a buildup of asphaltenes, wax, mineral particles, etc. The stability can facilitate advance preparation and storage of the emulsion 106. For example, the feed emulsion can have an electrical stability of equal to or greater than 1600 V, when determined according to API 13B-2 at 130° C., preferably greater than 1800 V or even greater than 2000 V. If desired, the emulsion may further comprise an emulsifying agent such as a surfactant or surfactant system. Preferably, the emulsion is substantially free of added surfactant.

In some embodiments, the process comprises first mixing the feed oil 104 (or blend with LIP 102) and the iron source material 108, and then mixing in the water 112. The alkali/alkaline earth metal chloride source material 110 can be present in the water 112, e.g., as a brine, and/or in the feed oil 104, e.g., un-desalted crude, in the iron source material 108, e.g., as a chloride or as a pretreatment in any support material, or it can be separately added. Preferably, the process further comprises passing (e.g., pumping) the feed emulsion through a line to the reactor 114, as opposed to mixing the oil, water, and/or chloride/iron source materials together in the reactor 114, e.g., introducing them separately and/or at a nozzle used for spraying the mixture. In embodiments, the heavy oil is combined with the water and the chloride/iron source material(s) to form the feed mixture at a temperature of about 25° C. to about 100° C., e.g., 30° C. to 95° C. The emulsion from step 106 may be fed to the FCIP reactor 114 at a relatively high temperature to minimize viscosity and enhance rapid heating in the pyrolysis chamber, but below boiling, e.g., 30° C. to 70° C. or 40° C. to 60° C.

An exemplary process according to embodiments of the present invention comprises the steps of preparing the FCIP feed emulsion 106 comprising (i) 100 parts by weight of the oil component which comprises from 1 to 50 wt % of the LIP, preferably 5 to 40 wt % LIP, based on the total weight of the oil component, (ii) from about 1 to 100 parts by weight of the water component 412, (iii) from about 0.01 to 5 parts by weight (preferably 0.01 to 1 part by weight) iron source material 108 (preferably comprising iron oxide, iron hydroxide, iron oxide-hydroxide, iron chloride, or a mixture thereof), and (iv) from about 0.01 to 5 parts by weight alkali/alkaline earth metal chloride source material 110 comprising alkali or alkaline earth metal chloride such as NaCl, KCl, LiCl, $MgCl_2$, $CaCl_2$), $BaCl_2$, or a mixture thereof; spraying the FCIP feed emulsion from step 108 in a pyrolysis reactor 114 at a temperature from about 425° C. to about 600° C. (preferably about 450° C. to about 500° C.); collecting effluent(s) 116 from the pyrolysis reactor 114; recovering a product LIP 102, 125 from the effluent 116; and optionally supplying a portion 105 of the LIP 102 to the feed emulsion preparation step 106.

Higher amounts of water in the emulsion 106, e. g., more than 50 parts by weight, particularly when processing paraffins, tend to produce more hydrocarbon gases, which may be preferred where olefin production is preferred. On the other hand, when processing asphaltenes, higher amounts of water can control cracking, thereby limiting gas formation and coke make. Optimally, targets of about 15 parts by weight of water per 100 oil are used for the FCIP processing of asphaltene-rich crudes, and about 10 parts by weight of water per 100 oil are used for the FCIP processing of paraffinic crudes.

In embodiments, the absolute pressure in the FCIP reactor 114 is from below atmospheric or about atmospheric up to about 5 atm, or preferably up to about 3 atm, or more preferably up to about 2 atm, or especially up to about 1.5 atm (7-8 psig). For example, the pressure in the FCIP reactor 114 can be about 10 to 50 psia, or about 1 to 3 atm, preferably 10 to 30 psia, more preferably 1 to 1.5 atm. The higher pressures are less preferred since they require more expensive equipment to handle them and may inhibit reactions necessary for forming the conversion-promoting and/or coke-inhibiting components in the product LIP 102.

The FCIP reactor 114 is operated and/or pyrolyzate exits from the reactor 114 preferably at a temperature between about 425° C. and about 600° C., more preferably between about 450° C. and about 500° C. The lower temperatures tend to favor more liquid hydrocarbon products and less gas, but total conversion may also be lower. Conversely, the higher temperatures tend to favor more conversion but hydrocarbon gas formation, including olefins, is greater and liquid hydrocarbon yield is less. The temperature depends on the hydrocarbon products desired: for greater liquid hydrocarbon yields, a temperature of 450° C. to 500° C. is preferred, 450° C. to 480° C. more preferred; for higher olefin and/or other light hydrocarbon yields, 500° C. to 600° C. is preferred.

In some embodiments, the heating of the reactor 114 and/or emulsion 106 can be direct by contact with a hot gas such as a combustion effluent or superheated steam, and/or in indirect heat exchange relationship with the combustion gas or steam, or by using an electrical or induction heating. In direct heating, the flue gas or superheated steam preferably comprises less than about 3 vol % molecular oxygen, or less than about 2 vol % molecular oxygen, or less than about 1 vol % molecular oxygen.

In some embodiments, the process comprises injecting the emulsion into the reactor, e.g., using an atomizing nozzle, and in some embodiments the injection is into a stream of combustion flue gases or other hot gas such as superheated steam in direct heat exchange to promote rapid heating and mixing, e.g., countercurrently sprayed upstream against an oncoming flow of the steam or combustion gas, for example, spraying the emulsion downwardly against an upward flow of the hot gas from below. If desired the steam, combustion flue gases or other hot gas can be introduced into a lower end of a reactor vessel housing the pyrolysis zone, e.g., through a gas inlet through a side or bottom wall of the reactor. Regardless of heating mode, when sprayed downwardly into the reactor, the residue and solids can accumulate in the bottom of the reactor, and periodically or continuously removed from the reactor, for example, through an outlet for continuous or periodic removal of the solids, e.g., using a rotary valve in the outlet.

In some embodiments, especially where the feedstock oil is a heavy crude oil or very heavy crude oil, the pyrolyzate vapor phase preferably comprises a condensate upon cooling having an overall API gravity greater than 20° API or greater than 22.3° API or greater than 26° API. In some embodiments, the process further comprises cooling the pyrolyzate vapor phase to form a condensate, and collecting the condensate, wherein the condensate has an overall API gravity greater than 20° or greater than 22.3°.

In some embodiments, the pyrolyzate vapor phase comprises hydrocarbons in an amount recoverable by condensation at 30° C. of at least about 70 parts (preferably 80 parts, more preferably 90 parts) by weight per 100 parts by weight of the oil in the feed mixture, and especially greater than 100 parts by weight liquid hydrocarbons per 100 parts by weight of the oil. Liquid hydrocarbon yields in excess of 100% of the feed oil are made possible by incorporating hydrogen and/or oxygen (from the water), especially hydrogen, into the product oil, and minimizing gas and residue formation. In some embodiments, the pyrolyzate vapor phase comprises less than 5 vol % of non-condensable (30° C.) hydrocarbon gases based on the total volume of hydrocarbons in the pyrolyzate vapor phase (dry basis).

In embodiments, the feed oil 104 can be a crude oil, including heavy crude oil, extra heavy crude oil, tar, sludge, tank bottoms, spent lubrication oils, used motor crankcase oil, oil recovered from oil based drill cuttings, etc., including combinations and mixtures thereof. In embodiments, the feed oil has an API gravity of less than 22.3° API or less than 20° API or less than 10° API. In embodiments, the heavy oil has a viscosity at 50° C. greater than 10,000 cP, or greater than 50,000 cP, or greater than 100,000 cP, or greater than 300,000 cP, whereas the LIP 422 can have a viscosity at 50° C. less than 1000 cP, or less than 100 cP, or less than 30 cP.

As mentioned above, the feed oil need not be dewatered or desalted and can be used with various levels of aqueous and/or inorganic contaminants. Any water that is present, for example, means that less water needs to be added to form the emulsion 106 to obtain the desired water:oil ratio. The salts and minerals that may be present in crude oil do not appear to adversely affect results, and may provide an alkali/alkaline earth metal chloride source material in addition to or in lieu of the added alkali/alkaline earth metal chloride source material 110. These embodiments are particularly advantageous in being able to process waste emulsions or emulsions such as rag interface that is often difficult to break. Considering that the industry goes to great lengths to break emulsions into clean oil and water phases, feeding such emulsions in the feed mixture herein to the reactor can avoid the need to break such emulsions altogether, or at least reduce the volume of emulsion that must be separated. For example, the rag layer that often forms at the interface between the oil and water, that is often quite difficult to separate, can be used as a blend component in the feed emulsion step 106.

In some embodiments of the present invention, a hydrocarbon refinery process comprises the steps of: (a) combining an LIP with a feedstock oil to form an LIP blend comprising from 1 to 50 wt % LIP and 99 to 50 wt % feedstock oil, preferably 5 to 35 wt % LIP and 95 to 65 wt % feedstock oil, more preferably 10 to 30 wt % LIP and 90 to 70 wt % feedstock oil, based on the total weight of the oil component, preferably where the percentages of LIP and feedstock oil total 100; (b) preparing an FCIP feed emulsion comprising (i) 100 parts by weight of a first portion of the LIP blend, (ii) from about 1 to 100 parts by weight of a water component, (iii) from about 0.01 to 5 parts by weight (or 0.01 to 1 part by weight) iron source material 108 (preferably comprising iron oxide, iron hydroxide, iron oxide-hydroxide, iron chloride, or a mixture thereof, more preferably where the iron source material is unsupported), and (iv) from about 0.01 to 5 parts by weight chloride source material 110 comprising alkali or alkaline earth metal chloride such as NaCl, KCl, LiCl, $MgCl_2$, $CaCl_2$), $BaCl_2$, or a mixture thereof; (c) spraying the FCIP feed emulsion in a flash pyrolysis reactor at a temperature from about 425° C. to about 600° C., preferably 450° C. to 500° C.; (d) collecting an effluent from the flash pyrolysis reactor; (e) recovering a product LIP from the effluent; (f) incorporating at least a portion of the product LIP into the LIP blend; and (g) distilling a second portion of the LIP blend. The feedstock oil preferably comprises crude oil, more preferably un-desalted crude oil, e.g., the process may further comprise water washing to desalt the second portion of the LIP blend, and distilling the desalted second portion of the LIP blend in step (g).

In some embodiments of the present invention, a hydrocarbon refinery process comprises the steps of: (a) preparing an FCIP feed emulsion comprising (i) 100 parts by weight of an oil component, (ii) from about 5 to 100 parts by weight of a water component, (iii) from about 0.01 to 5 parts by weight iron source material 108 (preferably comprising iron oxide, iron hydroxide, iron oxide-hydroxide, iron chloride, or a mixture thereof, more preferably where the iron source material is unsupported) and (iv) from about 0.01 to 5 parts by weight alkali/alkaline earth metal chloride source material 110 comprising alkali or alkaline earth metal chloride such as NaCl, KCl, LiCl, $MgCl_2$, $CaCl_2$), $BaCl_2$, or a mixture thereof; (b) spraying the FCIP feed emulsion in a pyrolysis reactor at a temperature from about 425° C. to about 600° C., preferably 450° C. to 500° C.; (c) collecting an effluent from the pyrolysis reactor; (d) recovering LIP from the effluent; (e) combining the recovered LIP with a feedstock oil comprising a petroleum fraction selected from medium weight gas oil, heavy gas oil, resid, or a combination thereof to form an LIP blend; and (f) distilling, cracking, visbreaking, and/or coking the LIP blend. Preferably, the oil component in the feed emulsion from the preparation step (a) comprises the petroleum fraction used in step (d), e.g., the feed emulsion from step (a) may comprise the LIP blend from the combining step (e).

The LIP 102 is thus produced from a flash chemical ionizing pyrolysis (FCIP) process 114 (see FIGS. 7-9 discussed below), e.g., the process referred to as catalytic pyrolysis in U.S. Pat. No. 10,336,946 B2. In any embodiment, the FCIP preferably comprises the steps of preparing an FCIP feed emulsion comprising (i) an oil component, (ii) a water component, and (iii) finely divided solids comprising a mineral support and the iron source material (preferably comprising iron oxide, iron hydroxide, iron oxide-hydroxide, iron chloride, or a mixture thereof), preferably 100 parts by weight of the oil component, from about 1 to 100 parts by weight of the water component, and from about 1 to 20 parts by weight of the finely divided solids; spraying the FCIP feed emulsion in a pyrolysis reactor, preferably at a temperature from about 425° C. to about 600° C., preferably 450° C. to 500° C.; collecting an effluent from the pyrolysis reactor; and recovering a product LIP from the effluent.

In any embodiment, the FCIP preferably comprises the steps of preparing an FCIP feed emulsion comprising (i) an oil component, (ii) a water component, (iii) unsupported iron source material, and (iv) an alkali or alkaline earth metal chloride source material, wherein the feed emulsion comprises less than 1 part by weight added solids per 100 parts oil; spraying the FCIP feed emulsion in a pyrolysis reactor, preferably at a temperature from about 425° C. to about 600° C., preferably 450° C. to 500° C.; collecting an effluent from the pyrolysis reactor; and recovering a product LIP from the effluent.

In any embodiment, the FCIP feed emulsion may preferably comprise from about 20 to about 50 parts by weight of the water, and/or from about 0.01 to about 1 part by weight of each of the iron and alkali/alkaline earth metal chloride source materials, per 100 parts by weight LIP-feedstock blend or other feed oil.

In embodiments, the iron/chloride source materials may preferably comprise or be prepared as the finely divided solids and/or any of those catalysts disclosed in my earlier patent, U.S. Pat. No. 10,336,946 B2, which is hereby incorporated herein by reference in jurisdictions where permitted. For example, the iron/chloride source materials can comprise the finely divided solids comprising clay and/or a derivative from a clay, such as montmorillonite, for example, bentonite. The mineral support can be any other mineral disclosed in the '946 patent, including processed drill cuttings, albite, and so on. The metal can comprise a Group 3-16 metal, e.g., iron, lead, zinc, or a combination thereof, preferably a Group 8-10 metal, e.g., iron, cobalt, nickel or the like. In any embodiment, the finely divided solids may comprise an oxide and/or acid addition salt of a Group 8-10 metal supported on clay, preferably iron oxide, iron hydroxide, iron oxide-hydroxide, iron chloride, or a mixture thereof.

Preferably, the iron source material comprises iron oxide, iron hydroxide, iron oxide-hydroxide, iron chloride, or a mixture thereof, more preferably where the iron source material is unsupported, and a source of a chloride salt. When present, the montmorillonite or other support is preferably a non-swelling clay such as calcium bentonite. The iron/chloride source materials are preferably the product of the method comprising the steps of: (a) treating iron with an aqueous mixture of hydrochloric and nitric acids to form a solids mixture of iron oxide, iron hydroxide, iron oxide-hydroxide, and iron chloride, preferably wherein the mixture has limited solubility in water and is acid soluble, (b) treating montmorillonite, preferably calcium bentonite, with an alkali or alkaline earth metal chloride brine, preferably NaCl brine and drying the treated montmorillonite; (c) combining the solids mixture with the treated montmorillonite to load the iron oxide, iron hydroxide, iron oxide-hydroxide, iron chloride mixture on the montmorillonite, preferably by incipient wetness or by adding an aqueous slurry of the solids mixture to the essentially dry montmorillonite; and (d) heat treating the loaded montmorillonite at a temperature above 400° C. up to the FCIP temperature, preferably 400° C. to 425° C. (see FIGS. 5-6 discussed below).

Preferably, the iron and alkali metal/alkaline earth metal chloride source materials comprise iron compound derived from the treatment of iron with an aqueous mixture of hydrochloric and nitric acids to form a solids mixture of mixed valences of iron and iron oxides, iron hydroxides, iron oxide-hydroxides, and iron chlorides. The admixture of one part by weight iron and 1-2 parts by weight aqua regia ($HCl:H_2O:HNO_3$ at 3:2:1 by weight) forms hematite, magnetite, beta-iron oxide hydroxide, and chlorides, which is consistent with the reddish black coloration of the solids that is observed. The aqua regia is preferably slowly added to the iron, or may be added in several aliquots, to avoid excessive heat formation and reactant vaporization since the reaction is very exothermic. The proportion of iron may be increased somewhat, but too much iron may form insufficient ferric material as indicated by a generally brown or rust color. Greater proportions of aqua regia do not yield much if any benefit and thus may lead to lower yields of the solids mixture and/or excessive reagent costs. The admixture of solids can also contain elemental iron, since the iron may be present in excess. Also, other iron chlorides, nitrates, nitrites, oxides, oxychlorides, hydrochlorides, hydroxides, hydrates or combinations and/or mixtures of these may also be present. For example, treatment of iron with aqua regia may in theory form ferrates such as tetrachloroferrate (III), hexachloroferrate (VI) and so on. Further, since water is present, these compounds may be hydrated to varying degrees, e.g., especially upon slurrying with water, or decomposed by the water.

The iron source materials preferably have limited solubility, e.g., less than 50 wt % will dissolve in hot water when mixed at a ratio of 1 g solids to 30 ml distilled water, preferably less than 40 wt %; and the iron source material is preferably acid soluble, e.g., more than 50 wt % will dissolve in 20 wt % aqueous HCl when mixed at a ratio of 1 g solids to 30 ml aqueous HCl, preferably at least about 65 wt %. The solids mixture may be dried, e.g., in an oven at a temperature above 100° C., for example, 100° C. to 150° C., and ground as needed. When the iron source materials is slurried in water and partially dissolved, the aqueous solution phase may comprise an excess of chloride ions, e.g., a molar ratio of chloride to total dissolved iron that is greater than 3:1, such as between 4 and 5 moles chloride per mole of solubilized iron. The aqueous phase of the slurry may also contain nitrite and/or nitrate in lesser amounts, e.g., 0.04-0.8 mole nitrite per mole of dissolved iron and/or 0.01-0.2 mole nitrate per mole of iron.

Figure 2:
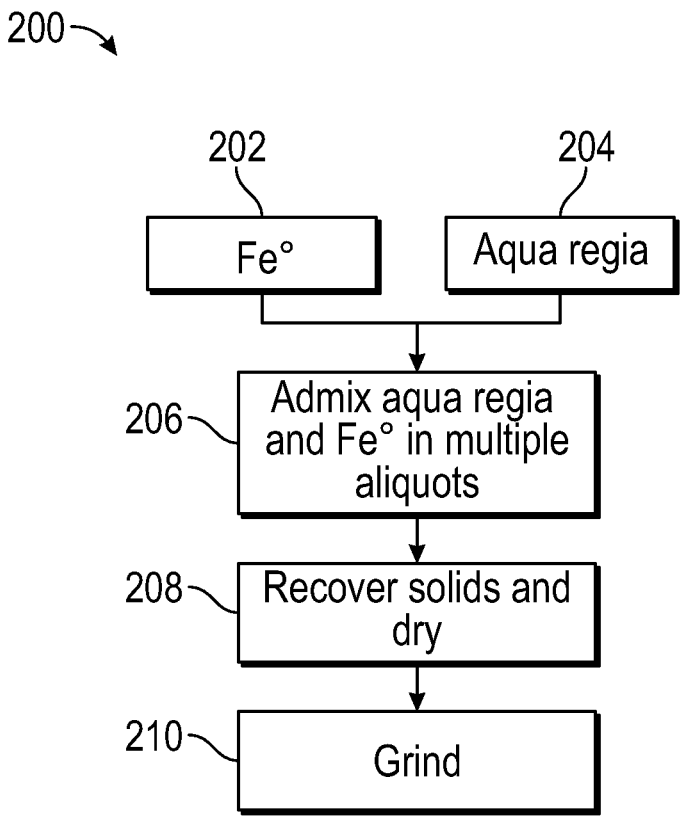
FIG. 2 shows a simplified schematic flow diagram of a method for preparing an iron source compound for FCIP, according to embodiments of the present invention.

FIG. 2 shows the preparation of the iron source compound in exemplary embodiments according to method 200. In the summarized method 200, iron 202 is treated with acid 204, which may be an aqueous mixture of HCl and $HNO_3$, in iron source material preparation step 206. In step 206, finely-divided elemental iron 202, e.g., 100 mesh carbon steel or high purity iron shavings, are admixed with aqua regia 204, preferably an excess where the total moles of HCl and $HNO_3$ are at least 3-6 times greater than the moles of iron, e.g., at a weight ratio of 1:1-2 (Fe: aqua regia) where the aqua regia has a weight ratio of nitric acid:hydrochloric acid:water of about 1:3:2. The aqua regia is preferably added in multiple aliquots while stirring, and the temperature may increase, e.g., to about 95° C. or greater, forming.

The solid iron compound can be recovered from the aqueous phase, e.g., by filtration, water washing, and drying, for example in an oven as shown in step 208. In step 210, the recovered solids can be ground, e.g., to pass a 100 mesh screen, preferably a 325 mesh or 400 mesh screen.

The aqua-regia-treated Fe solids ("AR-Fe") at this point can comprise a complex mixture of iron oxide, iron hydroxide, iron oxide-hydroxide, iron chloride, or a mixture thereof, with the iron in various valence states, e.g., Fe(0), Fe(II), Fe(III), and so on. Primarily, solids comprise hematite, magnetite, and beta-ferric oxide hydroxide. The AR-Fe unexpectedly has a low fractional solubility in water so that no more than 40 wt %, preferably no more than about 35 wt % or 30 wt %, dissolves and/or digests in an aqueous mixture of 1 g AR-Fe in 30 ml total mixture (33.33 g/L) at 100° C., but has a high fractional solubility in 20 wt % aqueous hydrochloric acid such that at least 90 wt %, preferably at least about 95 wt % or 98 wt %, dissolves and/or digests in an aqueous mixture of 1 g AR-Fe in 30 ml total mixture (33.33 g/L) at 100° C.

Figure 3:
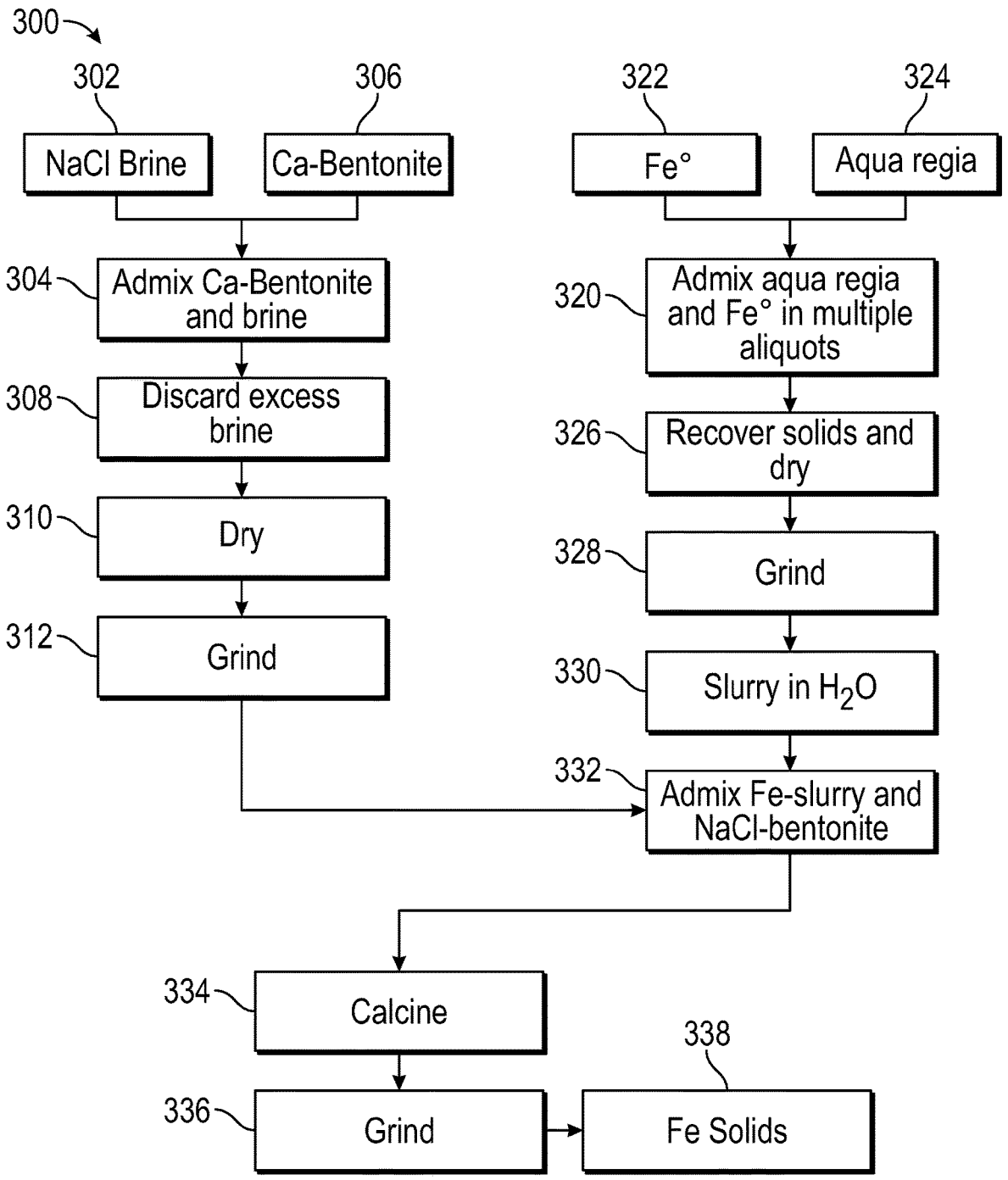
FIG. 3 shows a simplified schematic flow diagram of an alternative method for preparing an iron source compound for FCIP, according to embodiments of the present invention.

The method 300 seen in FIG. 3 shows the alternative preparation of a supported iron/chloride source compound. Brine 302, preferably 1M sodium chloride, is admixed in step 304 with calcium bentonite 306, preferably passing through a 100 mesh screen. Preferably, the weight ratio of Ca-bentonite to brine is 1:2. The mixture can be stirred, e.g., for 1 h, and allowed to stand, e.g., for 16-24 h. In step 308, the excess brine is discarded, e.g., by decantation and/or filtration, and in step 310 the solids are dried, e.g., dried in an oven at 120-130° C. for 4-6 h. When the NaCl-bentonite is dry, it can be optionally ground in step 312, e.g., to pass through an 80 mesh screen. Separately the iron compound is prepared. In step 320, finely-divided elemental iron 322 is admixed with aqua regia 324. In step 326, the solid iron compound can be recovered and dried. In step 328, the recovered solids can be ground as desired. In step 330 the solids are slurried in water, e.g., at 4 weight percent solids. Then, in step 332 the slurry from step 330 is admixed with the dry, ground NaCl-bentonite from step 312, e.g., at a weight ratio of 2:3 (slurry: NaCl-bentonite) to load the AR-Fe on the NaCl-bentonite by incipient wetness. The mixture from step 332 is then dried and calcined, e.g., at 400° C. for 2 h in step 334, cooled and ground in step 336, e.g., to pass an 80 mesh screen, and recovered as the supported iron-based solids 338.

While not wishing to be bound by theory, as mentioned above one advantage of using a feed emulsion is that iron and/or chloride ions can pre-associate with heteroatoms in the asphaltene molecules and thereby target these species for reaction upon decomposition and/or catalytic activation of the associated ions at the high temperature FCIP conditions. The ionized species present in the emulsion presents a level of molecular-scale pre-mixing of oil, water, catalysts and other reactants that cannot occur where the reactants and catalysts are supplied separately to the reactor.

While not wishing to be bound by theory, it is believed that hydrogen radicals and/or molecular hydrogen are generated in situ during flash pyrolysis by reaction and/or catalysis of one or more iron compound(s) at the pyrolysis conditions, e.g., at 450-500° C. For example, hydrogen may be formed by the decomposition of ferric chloride in the presence of steam, according to the following reactions, e.g.:

$$FeCl_3 \Leftrightarrow FeCl_2(s) + Cl^+$$

$$Cl^+ + 2H_2O \Leftrightarrow HClO + H^+$$

Here, the formation of hydrogen may be favored due to an excess of water (steam).

Ferric chloride can be formed by the decomposition of iron chloride compounds in the iron source material, e.g., FeOCl may decompose into $FeCl_3$, according to the equation:

$$3FeOCl \Leftrightarrow Fe_2O_3 + FeCl_3.$$

Ferric chloride can also be formed by the decomposition of the chloride source material to form HCl, which then reacts with iron oxides, e.g., according to the reactions:

$$NaCl + H_2O \text{ (Superheated steam)} \Leftrightarrow HCl + NaOH$$

$$Fe_2O_3 + 6HCL \Leftrightarrow 2FeCl_3 + 3H_2O$$

In turn, organic carboxylic acids can be decarboxylated according to the reactions:

$$R\text{—}COOH + NaOH \Leftrightarrow R\text{—}COONa + HOH$$

$$R\text{—}COONa + NaOH \Leftrightarrow RH + Na_2CO_3(s)$$

where R is a hydrocarbyl.

In addition to the chemical production of hydrogen radicals by decomposition, $FeCl_3$ per se and bentonite (if present) can function as Lewis and/or Bronsted acids, and thus in theory can initiate ionic cracking reactions to form liquid ionizing pyrolyzate. Another possibility in theory is that iron compound(s) having higher oxidation states relative to Fe(III) may be formed during the preparation of the iron compounds with aqua regia and/or during heat treatment, e.g., hexachloroferrate ion $(Fe(VI)Cl_3)^{3-}$ which might also help form ions and/or free radicals to propagate thermal and/or catalytic cracking reactions.

Furthermore, iron compounds such as magnetite, hematite, iron oxide hydroxide, iron oxychloride, ferrates, and the like, can act as catalysts per se in various hydrocarbon reactions.

While not wishing to be bound by theory, it is believed that FCIP using the Fe/Cl system at low pressure and a specific range of temperatures achieves extensive conversion of heavy hydrocarbons such as asphaltenes and/or resins to lighter hydrocarbons, and removal of heteroatoms such as nitrogen, sulfur, metals, etc., by reactions normally seen in high pressure catalytic cracking and hydrocracking, e.g., isomerization, cracking, dealkylation, aromatic saturation, decyclization, etc. For example, there is evidence that sulfur is both reduced, presumably by hydrogen radicals, and oxidized, presumably by reaction with HClO that is formed, as indicated above, by the reaction between the chlorine radical liberated from the iron chloride decomposition and the water that is present in the emulsion. The LIP product is unexpectedly characterized by low noncondensable gas yield, e.g., only small quantities of methane may be formed; the light products may be primarily $C_1$-$C_6$ hydrocarbons; small quantities of or no $C_{4+}$ olefins may be seen; and there may be significant formation of branched chain alkanes, isomerates, dealkylated aromatics, and naphthene cracking products. At the same time, the yield of coke can be minimized.

The montmorillonite support, if present, is preferably a non-swellable bentonite such as calcium bentonite. The bentonite is preferably treated with a chloride brine to replace calcium ions with the cation, e.g., by treating the bentonite with 1 molar NaCl or other chloride brine. The treated bentonite may then be dried, e.g., in an oven at a temperature above 100° C., for example, 100° C. to 150° C., and ground as needed to prepare it for loading with the iron/chloride source materials slurry by incipient wetness. The loading is thus achieved by mixing the iron/chloride source materials slurry with the dried chloride brine-treated bentonite, which may form a paste. In this mixture, Na ions in the bentonite may theoretically be displaced with iron and/or iron complex cations to form, e.g., possible species such as Fe(II)X—(O—Si-bentonite) and/or Fe(III)$X_2$(—O—Si-bentonite), where X is an anion. The mix of iron compound and dried, chloride brine-treated bentonite is then preferably heat treated or calcined. Heat treating the finely divided solids involves heating at a temperature above 200° C., such as from about 300° C. up to 600° C., for a period of time from less than 1 minute up to 24 hours or more, e.g., 1 to 16 hours. Heating at a temperature above 400° C. for a period of 4 to 6 hours is preferred. High temperatures above 400° C. are preferred to activate the iron/chloride source materials, and may result in isolated Lewis and/or Bronsted acid sites in the bentonite being formed and/or other hydrate compounds, e.g., iron compound hydrates, may be dehydrated. Lower temperatures may result in insufficient activation or require longer periods of heating. Substantially higher temperatures may cause undesirable reaction, volatilization, and/or deactivation of the chemical species in the solids. Preferably, the heat treatment is at a temperature lower than the FCIP temperature, which may avoid premature reaction and/or deactivation of the solids material prior to FCIP, more preferably the heat treating is at a temperature of equal to or greater than 400° C. up to a temperature equal to or less than 425° C.

Although not wishing to be bound by theory, it is believed salts or ions present in the iron/chloride source materials can form a eutectic mixture with one or more metal compounds or reaction products thereof, especially where the metal compound melts or boils at the heat treatment temperature and the eutectic mixture is non-volatile. For example, where the iron compound includes or forms $FeCl_3$, which has a normal boiling point of 315° C. and is thus normally quite volatile at 400°–425° C., the presence of NaCl or another salt may form a eutectic mixture of $FeCl_3$—NaCl with substantially lower volatility. This allows the $FeCl_3$ to remain on the support during heat treatment at 400°–425° C. and to be available as a reactant and/or catalyst at a higher pyrolysis temperature. Other iron compounds such as nitrates and/or nitrites may or may not decompose during the heat treatment step, e.g., to form iron oxides. In theory, similar eutectic systems such as $FeCl_3$—Na-bentonite may also form. Also, the iron compound resulting from the aqua regia treated iron has unexpectedly limited solubility in water suggesting that other complexes may be formed which could also limit volatility during heat pretreatment. As an example, the aqua regia-treated iron compounds might form covalent bonds with the bentonite, e.g., Fe(III)$Cl_2$(—O—Si-bentonite), to limit premature volatility. When used, the solids mixture of iron compounds or other iron source may be loaded on the bentonite in an amount from 1 mg/kg to 10 wt %, for example, from about 1000 mg/kg to 5 wt %, preferably 2-4 wt %, based on the total weight of the finely divided solids.

Liquid ionizing pyrolyzate (LIP) products obtained when a feedstock oil is processed by FCIP according to embodiments disclosed herein, especially when an oil with high contents of asphaltenes and/or resins is processed, include various medium-length hydrocarbon fractions having from about 12 to about 30 carbons, and various light oil fractions having from about 6 to 12 carbons. The LIP is thus enriched in hydrocarbons similar to those seen in catalytic and/or hydrocracking products.

Additionally, the LIP from the FCIP disclosed herein has an unexpectedly low viscosity for its density, compared to other hydrocarbons, suggesting the presence of relatively high levels of isomerates. Moreover, blends of the LIP with other crude oils, heavy oils, resids, and the like also have an unexpectedly low viscosity compared to conventional crude oil blends. Applicant is not bound by theory, but believes there may be ionized species in the LIP such as stable radicals that can inhibit asphaltene aggregation and/or decyclize asphaltenes, which is reflected in a significant reduction in coking tendency. The asphaltenes and other hydrocarbon molecules subjected to FCIP can form relatively stable free radical species, and can also form hydrogen donor species such as hydroaryl compounds. Some rearrangement of molecules appears to occur at ambient temperatures upon blending, whereas at moderate thermal processing temperatures, e.g., 100-250° C., the free radicals and hydrogen donors can facilitate conversion to saturates, aromatics, and lube oil base stock molecules, and reducing the amount of Conradson carbon residue and coke make.

In any case, when a feedstock oil is blended with the LIP, the viscosity reduction and reduced tendency to form coke results in unexpected improvements in thermal processing. For example, a crude-LIP blend can be heated more rapidly, e.g., during preheating for feed to the distillation column, since fouling from coke formation and deposition is markedly reduced. Distillation of a crude-LIP or resid-LIP blend results in liquid oil yields that are substantially and synergistically higher, and resid yields that are substantially and synergistically lower, than could be obtained by separate distillation of the LIP and crude or resid. Flash pyrolysis of a crude-LIP or resid-LIP blend, by FCIP as described herein, or otherwise, likewise results in similarly increased yields of liquid oil products and decreased yields of coke and also noncondensable gases. Unexpectedly, the resid from thermal processing of such LIP-modified blends exhibits a remarkably low viscosity, suggesting it contains an unusually high proportion of lube oil base stock. Moreover, the production of olefins by FCIP can be controlled by the selection of appropriate operational parameters, e.g., increasing the water content in the emulsion feed to the pyrolysis reactor and/or increasing the pyrolysis temperature can produce relatively larger amounts of olefins such as ethylene and propylene.

Figure 4:
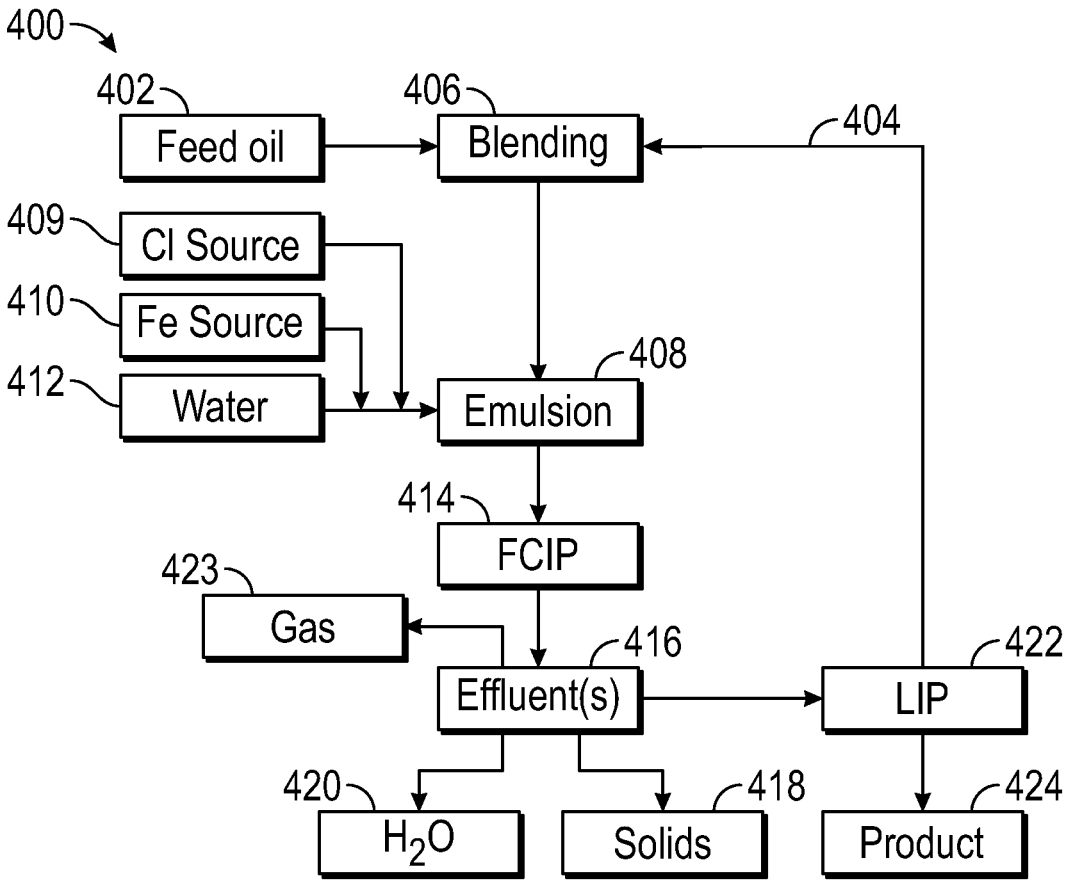
FIG. 4 shows a schematic flow diagram of a hydrocarbon conversion process wherein a liquid ionizing pyrolyzate (LIP) is combined with a feedstock oil to form an LIP blend and the LIP blend is thermally processed, according to embodiments of the present invention.

With reference to the embodiment of the invention shown in the simplified schematic flow diagram of FIG. 4, in FCIP process 400, feed oil 402 and liquid ionizing pyrolyzate (LIP) from stream 404 are optionally blended in step 406 or otherwise fed separately to emulsification in step 408 with chloride source 409, iron source 410 and water 412. The emulsion from step 408 is supplied to FCIP step 414. One or more effluents are separated in step 416 to obtain solids 418, water 420, LIP 422, and noncondensable gas 423. LIP 422 that is not recycled in stream 404 can be produced as a product 424.

Figure 5:
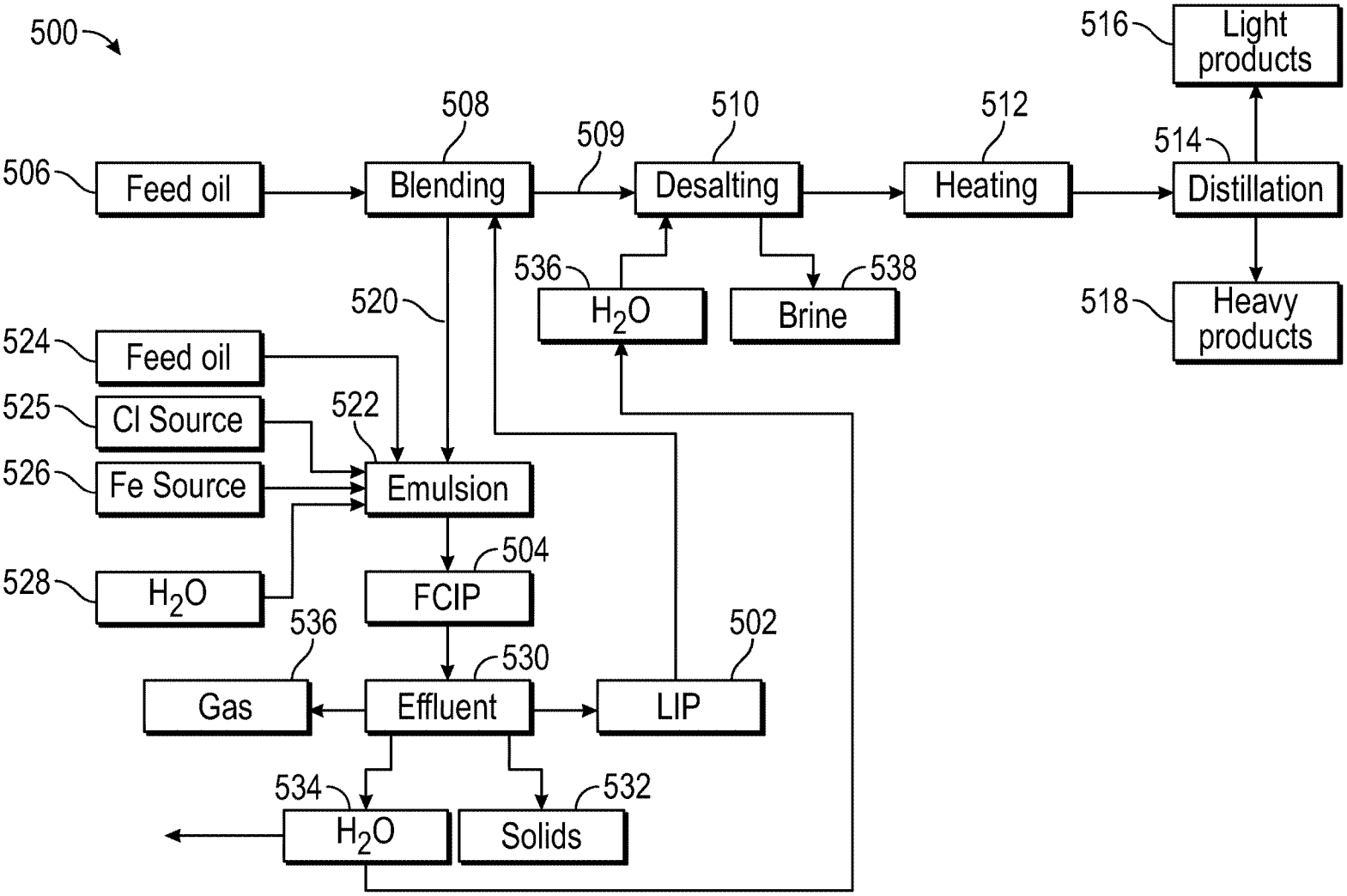
FIG. 5 shows a schematic flow diagram of a hydrocarbon refinery process wherein LIP from FCIP is blended with feed oil, desalted, heated, distilled, and optionally supplied to the emulsion preparation step for FCIP, according to embodiments of the present invention.

With reference to the embodiment of the invention shown in the simplified schematic flow diagram of FIG. 5, a hydrocarbon refinery process 500 comprises combining a liquid ionizing pyrolyzate (LIP) 502 from FCIP 504 with a feed oil 506 in step 508 to form an LIP blend comprising the LIP. A first portion 520 of the LIP blend from 508 is supplied for FCIP 504, and a second portion 509 for distillation 514.

The LIP can be used in the blend in a weight proportion of LIP 502: feed oil 502 of from 1:100 to 1:1, e.g., or from 1:20 to 1:2, preferably in an amount from 1 or 5 to 35 wt %, e.g., about 10 to 30 wt %, based on the total weight of the feed oil 506 and LIP 502 supplied to the blending step 508. Lesser amounts of the LIP have diminishing improvement of the blend, whereas higher amounts may not be economically attractive.

Surprisingly, it has been found that a blend of the LIP and crude oil can have a substantially lower viscosity than would be expected from traditional API viscosity prediction methods for blends.

The first LIP blend portion 520 can be pyrolyzed in FCIP 504. In step 522, there is prepared an FCIP feed emulsion comprising (i) 100 parts by weight of the first portion 520 of the LIP blend, (ii) from about 1 to 100 parts by weight water 528, (iii) from about 0.01 to 5 parts by weight of the iron source material 526, and (iv) from about 0.01 to 5 parts by weight of the chloride source material 525, e.g., from about 5 to about 50 parts by weight of the water 528, and from about 0.05 to about 1 parts by weight each of the iron/chloride source materials 525, 526, per 100 parts by weight of the LIP blend from step 508. In step 504, the FCIP feed emulsion from 522 is injected, preferably sprayed, in a pyrolysis reactor at a temperature from about 425° C. to about 600° C. An effluent 530 is collected from the pyrolysis reactor, a product LIP 502 is recovered from the effluent, and at least a portion is incorporated into the LIP blend in step 508 as mentioned above.

Feed oil 524, which can be the same feed oil as 506 or another oil source can optionally be supplied to the emulsion step 522 along with or in lieu of stream 520. Where blend stream 520 and feed oil 524 are both used, they can optionally be blended together in a vessel or line (not shown) before the emulsion step 522. Preferably, the blend stream 520 is the exclusive oil source for the emulsion 522 fed to FCIP 504, i.e., feed oil 524 is not supplied to the emulsion 522, thereby avoiding a duplication of oil blending equipment.

The emulsion step 522 emulsifies the blend stream 520 and/or feed oil 524 with chloride source material 525, iron source material 526, and water 528. The emulsion is pyrolyzed in FCIP step 504, and separated in step 530 to obtain solids 532, water 534, LIP 502, and noncondensable gas 536. Use of the blend stream 520 in this manner can facilitate pyrolysis by reducing fluid viscosities, improving emulsion stability, enhancing atomization, improving conversion, improving liquid yield of LIP 502, and improving the isomerization and/or alkylation promoting qualities of the product LIP 502, relative to the feed oil 506 and/or feed oil 524.

The second portion 509 of the LIP blend from 508 is fractionated in distillation 514. In any embodiment, the feed oil 506 may be a crude oil, preferably un-desalted crude oil, preferably where the process further comprises water washing in step 510 to desalt the second portion 509 of the LIP blend, preheating the crude in step 512, and distilling in step 514 to obtain light and heavy products 516, 518. In practice, the crude is often partially preheated to reduce viscosity, desalted, and then preheated to the distillation feed temperature. The distillation step 514 can include atmospheric and/or vacuum distillation, with which the skilled person is familiar.

Desalting 510 of the LIP blend portion 509 is facilitated due to lower salt and water content, synergistically lower viscosity and lower density, relative to the feed oil 506 by itself, and can thus be separated from water or brine more readily than the crude. Because some of the inorganic contaminants are removed by FCIP 504 from the first portion 520, the load on the desalter 510 is likewise reduced. If desired, the water 536 for the desalting 510 may come from the FCIP water 534, and/or the brine 538 may be supplied to water 528 for preparing the emulsion in 522.

Heating 512 can likewise be improved by less tendency to form coke or otherwise foul the heat transfer surfaces, allowing a higher differential temperature to be applied. To avoid this, refineries often use a series of heaters, e.g., more than a dozen, to incrementally raise the crude to the desired temperature. The LIP blend may reduce the number of heaters required. Also, the LIP blend has an unexpectedly lower viscosity and may provide higher heat transfer coefficients. Finally, distillation 514 is improved by providing a higher yield of light products 516, a lower yield of heavy products 518, and improved quality of both the light and heavy products 516, 518. For example, the lighter products 516 tend to have an unexpectedly high proportion of the type of hydrocarbons normally obtained by isomerization and/or alkylation, which can be reflected in a lower density, lower viscosity, higher viscosity index, etc.

Figure 6:
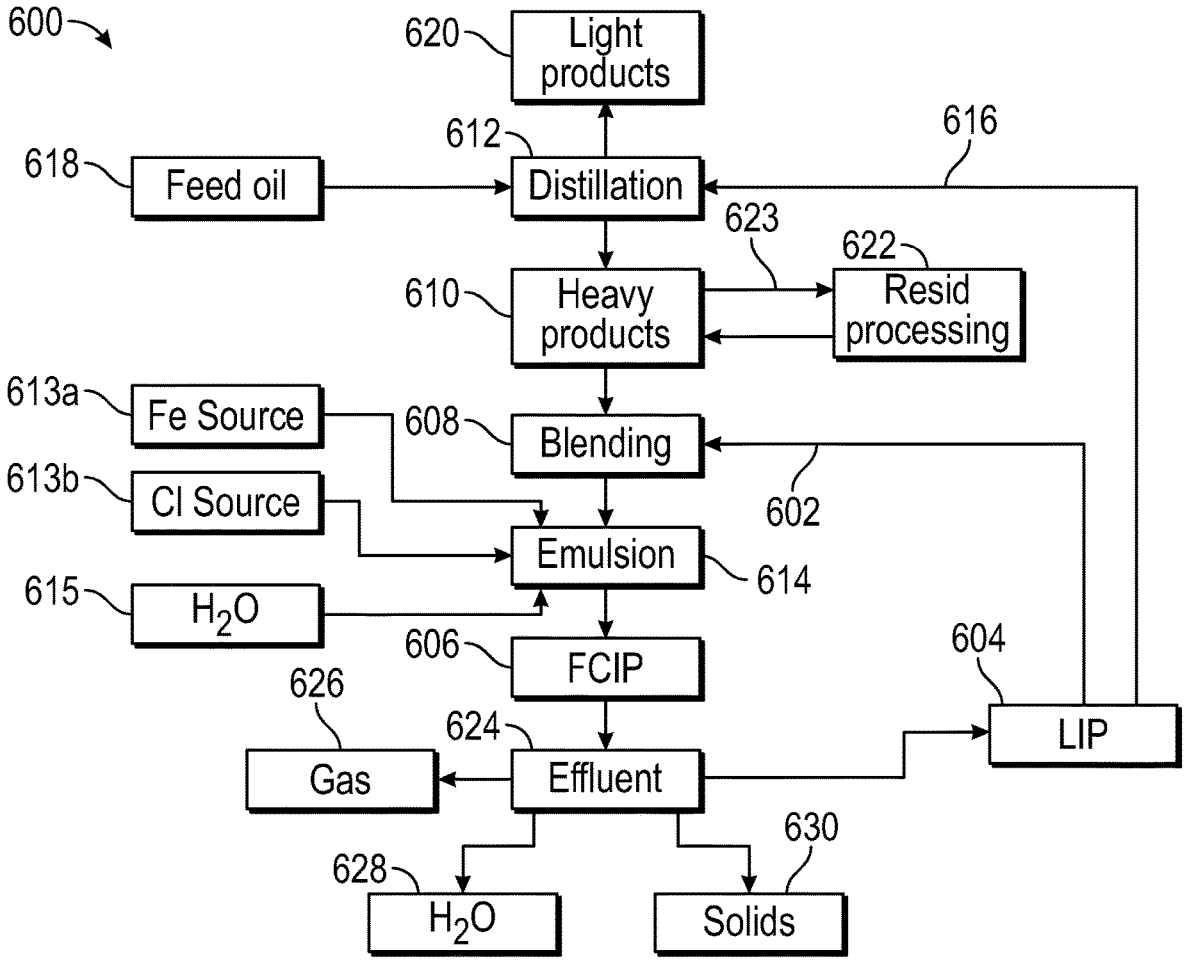
FIG. 6 shows a schematic flow diagram of a hydrocarbon refinery process wherein a first portion of LIP from FCIP is blended with heavy products from distillation, supplied to the emulsion preparation step for FCIP, and a second portion is optionally supplied to the distillation step, according to embodiments of the present invention.

With reference to the embodiment according to the present invention shown in the simplified schematic flow diagram of FIG. 6, a hydrocarbon refinery process 600 is shown in which (i) a blend of the heavy products 610 from distillation 612 and a portion 602 of the product LIP 604 is treated in FCIP 606 for improved conversion, liquid yield, and LIP quality, and a reduction in the amount of coke that is formed, relative to treatment of the heavy products 610 alone and especially relative to conventional processing of the heavy products 610, e.g., in a delayed coker; and/or (ii) a portion 616 of the product LIP 604 is supplied to distillation 612 for improved yield and quality of distillates, and a reduction in the yield of the heavy products 610 and/or the amount of coke that is formed, relative to distillation of the feed oil 618 alone.

Optionally, the feed oil 618 used for distillation 612 can be processed for feed to the distillation 602 in the manner as shown in FIG. 5 for the feed oil 506 in process 500 that is fed to distillation 514. In this arrangement, FIG. 5 can be seen as the front end or pretreatment of the crude supplied in a blend with the LIP to the distillation 514, 612, and FIG. 6 as a downstream processing of the heavy products 518, 610 from distillation 514, 612. In other words, processes 500 and 600 can be integrated where distillation 514 and 612 are equivalent, light products 516 and 620 are equivalent, and heavy products 518 and 610 are equivalent. The feed oil 618 is preferably a washed, preheated crude oil, e.g., the oil from heating step 512 in FIG. 5.

A first portion 602 of LIP 604 from FCIP 606 can be blended in step 608 with heavy products 610 from distillation 612. The blend, iron source material 613*a*, and chloride source material 613*b* are supplied with water 615 to the emulsion preparation step 614 for the FCIP 606.

A second portion 616 of the LIP 604 is optionally collected as a product stream and/or supplied to the distillation 612 for improved conversion of the feed oil 618 to light products 620 from the distillation, improved yield and quality of light products 620, and decreased yield of heavy products 610 and/or a reduced flow rate to resid processing 622. If desired, the LIP in stream 616 may be blended in step 508 with the feed oil 618 (corresponding to feed oil 506 in FIG. 5) upstream from the desalting 510, heating 512, and so on. When the LIP 604 derived from the heavy product 610 in FIG. 6 is supplied to the blending 508 in FIG. 5, the treatment loop through line 520 to FCIP 504 and return from LIP 502 may or may not be used, and if used, the processing rate through FCIP 504 may be reduced in size relative to the flow scheme of FIG. 3 alone.

Effluent 624 from FCIP 606 is separated to recover LIP 604, noncondensable gas 626, water 628, and solids 630. Recovered water 628 may optionally be supplied for re-use as the water 615 fed to the emulsion step 614 and/or water 528 (see FIG. 5).

Figure 7:
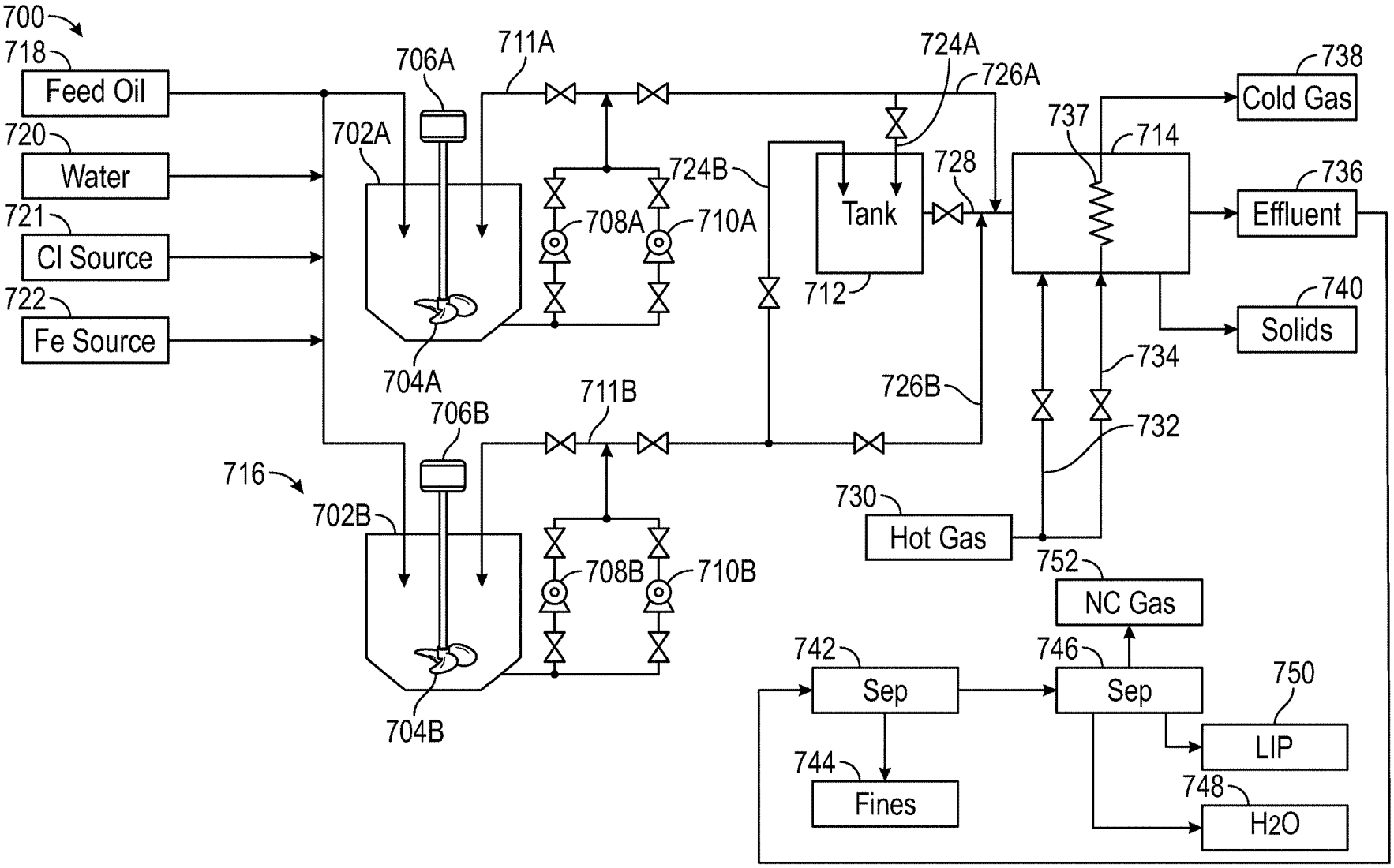
FIG. 7 shows a schematic flow diagram of an FCIP process for making the LIP, according to embodiments of the present invention.

With reference to FIG. 7, an apparatus 700 that may be used to prepare the feed mixture in accordance with some embodiments of the present invention comprises a mixing tank 702A equipped with an agitator 704A, which may be driven by motor 706A. If desired, redundant pumps 708A, 710A can be provided with valved lines for selective recirculation and transfer to an optional holdup tank 712 and/or directly to reactor 714. If desired, an optional second mixing train 716, including mixing tank 702B, agitator 704B, motor 706B, and pumps 708B, 710B, can be provided to facilitate batch, semi-batch or continuous feed mixture preparation.

In batch operation, feed oil 718, water 720, chloride source material 721, and iron source material 722 are charged to the mixing tank 702A (or 702B) in any order, preferably by transferring the feed oil into the mixing tank, then any solids, and then the water while maintaining agitation via agitator 704A (or 704B) and/or providing agitation before and/or after each addition. Alternatively, the solids can be dispersed and/or dissolved in the water, e.g., in the mixing tank, and then the oil added, e.g., as a first portion to form a pre-mix emulsion to aid dispersion of the iron source material, and then as a second portion comprising the remainder of the oil. One of the pumps 708A, 710A (708B, 710B) can recirculate the mixture via valved line 711A (711B) while agitating to facilitate mixing. Once the mixture has been prepared, the pumps 708A, 710A (708B, 710B) can transfer the mixture to holding tank 712 via valved line 724A (724B), or directly to FCIP reactor 714 via valved lines 726A (726B) and 728.

If desired, the feed oil 718 may be heated or mixed with a hydrocarbon diluent to reduce viscosity and facilitate pumping and mixing. The water 720 may also be optionally heated to facilitate mixing. Also, if desired, the tanks 702A, 702B, 712 and the associated lines and pumps may also be heated to keep the viscosity of the mixture low; however, the mixture in some embodiments has a lower viscosity than the feed oil 718, so it may be possible to maintain a lower temperature for the mixture or to avoid heating altogether. Furthermore, the mixing operation may be exothermic providing a source of heat in situ for the mixture. Moreover, the emulsion of the feed mixture is stable in some embodiments and so it may be prepared in advance, e.g., up to several days or more, and stored until use without phase separation, before transfer to the tank 712 and/or reactor 714. The emulsion can also be prepared off-site and pumped or trucked to the pyrolysis site. The feed mixture preparation apparatus shown in FIG. 7 may be used in or with any of the embodiments of the invention as shown in the other figures.

In some embodiments, the feed mixture may be mixed using an in-line mixer(s) and/or produced in-situ within the FCIP reactor 714 by adding at least one of the feed oil, water and/or the finely divided solids directly into the FCIP reactor 714 and/or by the addition of water and/or addition of solids directly to the pyrolysis chamber, depending on the composition of the feed oil and the end use of the product LIP.

In some embodiments, the pyrolyzate vapor phase is condensable to form an oil phase lighter than the feed oil. In some embodiments the pressure in the FCIP reactor 714 is sufficiently low and the temperature sufficiently high such that the pyrolyzate exits the reactor in the vapor phase or primarily in the vapor phase, e.g. with at least 70 wt % of the recovered hydrocarbons, preferably at least 80 wt %, or at least 90 wt %, or at least 95 wt %, or at least 98 wt %, or at least 99 wt % or at least 99.9 wt %, or 100 wt % of the recovered hydrocarbon exit the reactor 146 in the vapor phase, based on the total weight of the recovered hydrocarbons. In general, the pyrolyzate effluent 148 is primarily or mostly gas phase, comprised of hydrocarbons, steam, and in the case of direct heating, additional steam or flue gases such as carbon dioxide or monoxide, nitrogen, additional steam, etc., but may entrain relatively minor amounts of liquid droplets and/or small-particle solids (fines) that may be removed by filtration, cyclonic separation and/or condensation with the recovered hydrocarbons when they are subsequently condensed to produce the catalytic pyrolysis oil product.

In an embodiment, the absolute pressure in the reactor 714 is from about 10 to 50 psia, e.g. from about 10 to 30 psia, or from about 1 atm to about 1.5 atm, or to about 1.1 atm, and the pyrolyzate vapor 148 exits from the reactor at a temperature above 425° C., e.g., above 450° C., up to about 480° C., up to about 500° C., or up to about 600° C., e.g., 450° C.-500° C., 450° C.-480° C., or 500° C.-600° C.

The feed mixture from line 728 may be heated in the pyrolysis chamber by hot gas 730, e.g., steam, combustion effluent or another gas at a temperature from about 300° C. or 600° C. up to about 1200° C., either in direct heat exchange relation via line 732 or indirect heat exchange relation via line 734. In practice only one arrangement is present in the apparatus 700, either direct or indirect heating. In embodiments the hot gas 730 comprises steam, or combustion gas from a fuel-rich combustion, e.g., comprising less than about 1 vol % molecular oxygen, or another effluent having a sufficiently low oxygen content to inhibit combustion in the reactor 714. In direct heating, the hot gas 730 may have a temperature from about 300° C. to about 1200° C., and is contacted or mixed directly with the feed mixture or reaction products thereof, and the hot gas exits the FCIP reactor 714 with the pyrolyzate in effluent stream 736. In indirect heating, the hot gas 730, preferably supplied at an inlet temperature from about 600° C. to about 1200° C., enters a heat exchanger 737 within the FCIP reactor 714 and cooled gas 738 is collected from an outlet of the heat exchanger. Solids 740 accumulating in the reactor 714 may be periodically or continuously removed for disposal or for recycling in the process (re-used as the finely divided solids and/or its preparation), with or without regeneration.

In embodiments, the effluent 736 with the product LIP exits the FCIP reactor 714 at a temperature greater than about 425° C., or greater than about 450° C. In embodiments, the effluent 736 exits the FCIP reactor 714 at a temperature of about 600° C. or below, or below about 500° C. The effluent 736 from the reactor 714 can be processed as desired, e.g., in separator 742 to remove entrained fines 744 and/or in separator 746 to recover water 748 and one or more oil fractions, e.g., LIP 750, and to exhaust non-condensable gases 752. The separator 742 can comprise a cyclone separator, a filter such as a baghouse, an electric precipitator, etc. Separator 746 can comprise condensers to recover condensate and gravity separation devices, e.g., a centrifuge or oil-water separator tank, to phase separate condensate comprising oil and water mixtures. Separator 746 can if desired optionally further include recovery of light hydrocarbons, e.g., hydrogen, methane, ethane, ethylene, propane, propylene, fuel gas, or the like, using a cryogenic process, membrane separators, and so on.

In embodiments, the FCIP reactor 714 comprises a turbulent environment, and may contain a bed of particulate inert solids (see FIG. 9), which may comprise silica, alumina, sand, or a combination thereof, and/or may include nonvolatile residues from previously treated mixtures such as ash, coke, and/or heavy hydrocarbons (i.e., having 40 carbons or more). These residues may collect and/or may be continuously or periodically removed from the FCIP reactor 714. In embodiments, the feed mixture in line 728 is fed to FCIP reactor 714 at a point below a bed, thus fluidizing the bed, and/or the feed mixture may enter just over the bed, e.g., downwardly directed such as onto the bed or on an impingement plate (fixed or partially fluidized bed) from which the more volatile compounds rise immediately and the less volatile compounds are converted to more volatile compounds in the bed.

In embodiments, the combustion gases utilized as the hot gas 730 in any of the processes disclosed herein, especially in the direct heating embodiments, are sub-stoichiometric with respect to oxygen (oxygen lean/fuel rich) such that the concentration of molecular oxygen $O_2$ in the reactor is less than about 1 vol %, or less than 0.1 vol %, or the combustion gas is essentially free of molecular oxygen. Accordingly, in embodiments, the pyrolysis reactor 714 comprises a reducing atmosphere.

Figure 8:
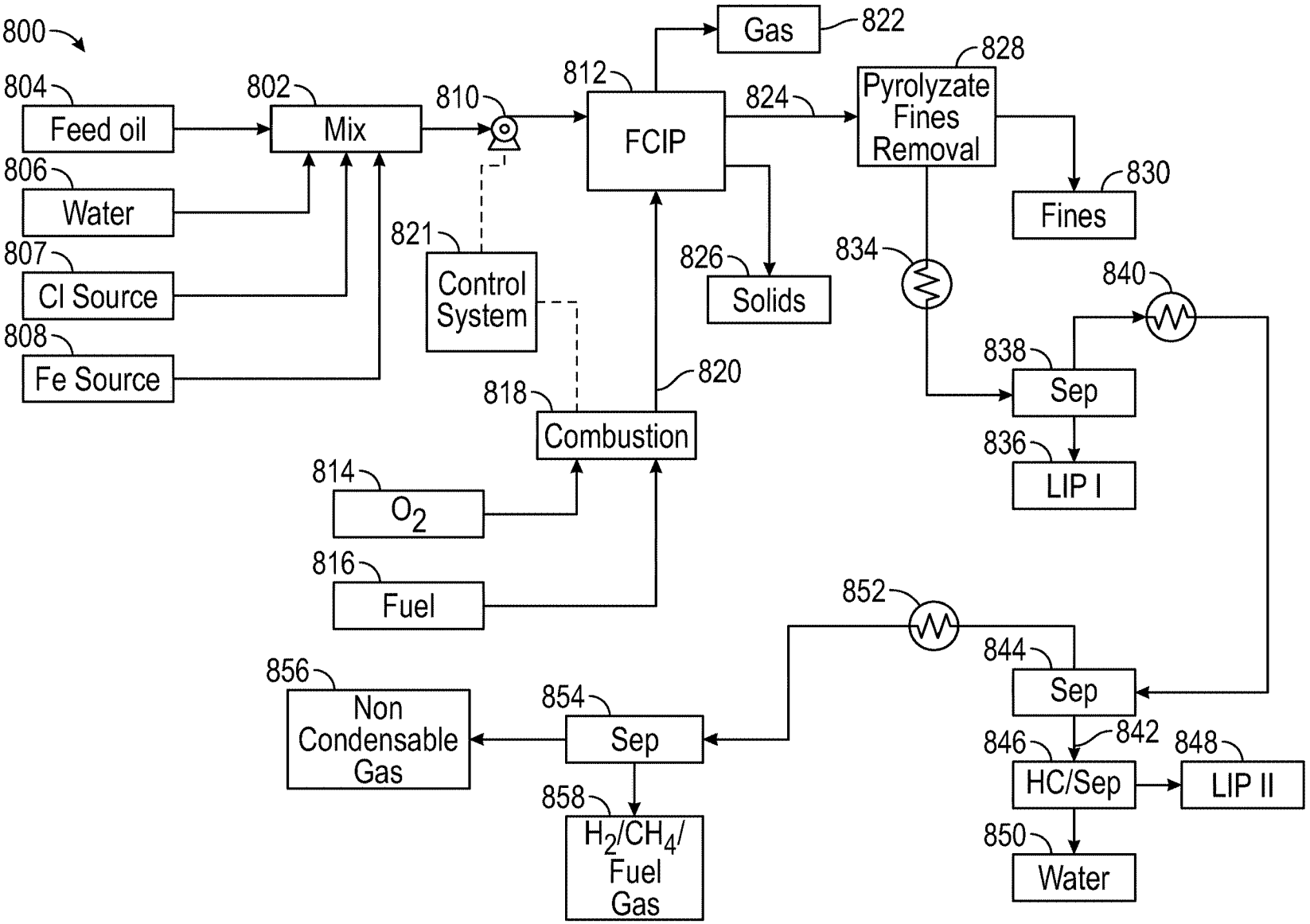
FIG. 8 shows a schematic flow diagram of another FCIP process for making the LIP, according to embodiments of the present invention.

With reference to FIG. 8, a process 800 according to some embodiments of the present invention comprises a mixer and/or mixing tank 802 to combine feed oil 804, water 806, chloride source 807, and iron source 808 into an emulsion as described herein (cf. discussion of FIG. 7). The emulsion is transferred via pump 810 to FCIP reactor 812. An oxygen source 814 such as air, oxygen or oxygen-enriched air is combined with fuel 816 in combustion burner 818 to supply combustion effluent in line 820 to the reactor 812, as described herein (cf. discussion of FIG. 7). Control system 821 is provided to control the operating conditions of the FCIP reactor 812, e.g., by manipulation or adjustment of the feed rate(s) and/or combustion rates to maintain the pyrolysis zone at a temperature, pressure and residence time to form an LIP vapor phase. In the case of indirect heating, cold gas 822 is recovered; otherwise the combustion gases are mixed with the steam and LIP vapors and recovered in effluent line 824. Solids 826 may be recovered from the reactor 812 continuously or periodically.

The effluent from line 824 is optionally processed in fines removal unit 828, to separate fines 830, optionally including any liquid droplets or other solids, and the remaining vapor can optionally be supplied directly to an oil or heavy oil reservoir recovery process (see FIG. 11 of US 2016/0160131 A1), or after conditioning to remove any undesirable components, supplement any additional components needed, compress to injection pressure, heat to the desired injection temperature, and/or cool to recover waste heat. Where the iron source material is unsupported, the fines removal can be eliminated or designed for substantially reduced fines content.

The remaining vapor can be cooled in exchanger 834 and hydrocarbon condensate (LIP I) 836 recovered from separator 838. The process temperature in the exchanger 834 and separator 838 is preferably above the water dew point so that the condensate 836 is essentially free of water, e.g., less than 1 wt %. The vapors from separator 838 are then cooled in exchanger 840 and condensate 842 recovered from separator 844. The process temperature in the exchanger 840 and separator 844 is preferably below the water dew point so that the condensate 842 is a mixture of water and oil, which can be further separated in separator 846, which can be a centrifuge or gravity settling tank, for example, to obtain oil product (LIP II) 848 and water 850. The overhead vapor from the separator 844 can be exhausted and/or used as a fuel gas, or it can optionally be further processed in exchanger 852 for cooling and separated in separator 854 into non-condensable gases 856 and or product 858 comprised of one or more streams of hydrogen, methane, ethane, ethylene, propane, propylene, carbon dioxide, fuel gas, including combinations thereof. The separator 854 can be any one or suitable combination of a cryogenic separator, membrane separator, fractionator, solvent extraction, pressure swing absorption, or the like.

Figure 9:
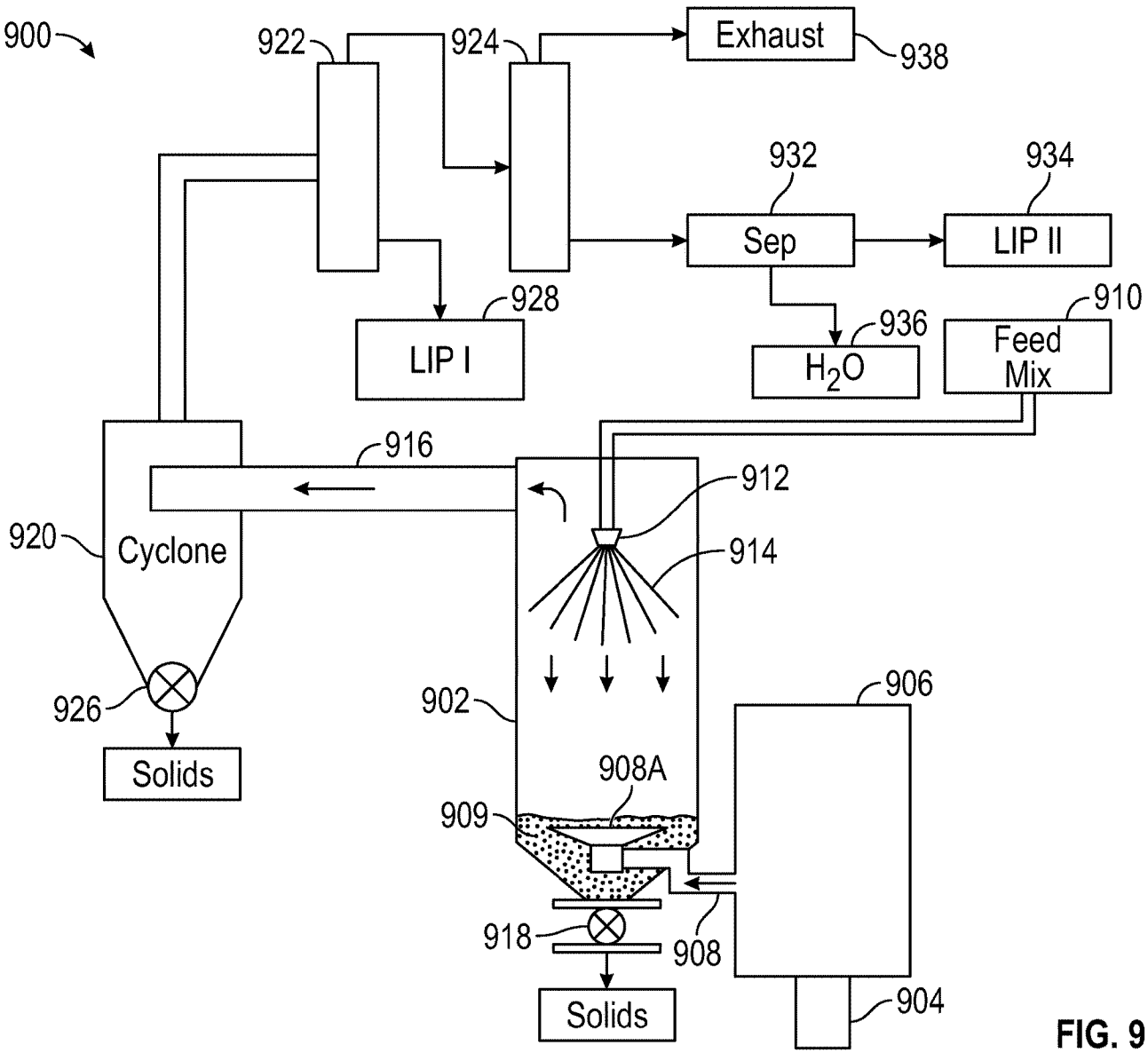
FIG. 9 shows a schematic flow diagram of a further FCIP process for making the LIP, according to embodiments of the present invention.

With reference to FIG. 9, a process 900 comprises a reactor 902 that is directly heated by combustion gases or steam supplied from burner 904 and combustion chamber or boiler 906 through duct 908, which can direct the combustion effluent/steam through distributor **908*a* located to fluidize the solids 909. Feed mixture 910 can be prepared, for example, as described above (cf. discussion of FIGS. 7-8). The feed mixture 910 is supplied to nozzle 912 and forms a preferably conical spray pattern 914 in the reactor 902**.

The nozzle 912 is directed downwardly and can be positioned near the upper end of the reactor, e.g., ⅓ of the way down from the top of the reactor toward the bottom. The nozzle 912 is preferably designed and positioned so that the spray pattern 914 avoids excessive impingement on the inside surfaces of the reactor 902 that can lead to caking and/or buildup of solids on the walls. For example, the nozzle 912 can provide a conical spray pattern. The feed mixture 910 is thus introduced countercurrently with respect to the flue gas or steam from combustion chamber or boiler 906 to promote mixing and rapid heating to facilitate the conversion and volatilization of hydrocarbons.

The pyrolyzate vapor phase exits the reactor 902 together with the combustion gas and steam from the feed mixture water into duct 916. The upward flow rate of the gases in the reactor 902 in some embodiments is sufficiently low to avoid excessive entrainment of solid particulates. The solid particulates can thus fall to the bottom of the reactor 902 and can be periodically and/or continuously withdrawn, e.g., via rotary valve 918, for disposal and/or regeneration and recycle to the slurry preparation. Regeneration can be effected in some embodiments by contacting the solids with an oxygen containing gas at high temperature to promote combustion of hydrocarbon residue and coke from the particles. In any embodiment, regeneration can be in situ in reactor 902, e.g., by supplying oxidant gas into the solids bed 909 for combustion of coke.

The gases from the reactor 902 in some embodiments are optionally passed into cyclone 920 for removal of fines. Where an unsupported iron source material is used, for example, the cyclone 920 may not be needed and/or can be designed for removal of substantially reduced fines content. Fines, when present, can be periodically and/or continuously withdrawn from the cyclone 920, e.g., via rotary valve 926. The solids-lean gases in some embodiments are then passed through condensers 922 and 924. The first condenser 922 preferably condenses hydrocarbons, which have a relatively higher boiling point than water, at a temperature above the water dew point so that the oil 928 (LIP I) has a low water content, e.g., essentially free of water so that water separation is not needed. The second condenser 924 preferably condenses the hydrocarbons and water which may be processed, if desired, in separator 932 to separate an oil phase 934 (LIP II) from a water phase 936, e.g., by gravity settling, centrifuge, or the like. The recovered water in this and any of the other embodiments illustrated herein can, if desired, be recycled for preparation of the feed mixture to the FCIP reactor (cf. FIGS. 1, 4-8), the desalting 510 (FIG. 5), and so on. Non-condensed exhaust gases 938 are recovered overhead from the condenser 924.

Embodiments

The present invention provides, among others, the following preferred embodiments:

1. A hydrocarbon refinery process comprising the steps of:
(a) combining a liquid ionizing pyrolyzate (LIP) with crude oil to form an LIP-crude blend comprising the pyrolyzate in an amount from 10 to 20 wt % based on the total weight of the HP-crude blend;
(b) combining a first portion of the LIP-crude blend, water, and 1-4 wt % of a finely divided solids to obtain an emulsion comprising (i) 75-85 wt % of an oil phase, (ii) 5-15 wt % of an aqueous phase, and (iii) 3-10 wt % total solids, based on the total weight of the emulsion, wherein the finely divided solids comprise the product of combining iron source material of limited solubility and chloride brine-treated support material and heat treating the combined material at a temperature of 400° C. to 425° C.;
(c) spraying the emulsion in a vapor phase of a flash chemical ionizing pyrolysis reactor at a temperature of 450-500° C.;
(d) collecting an effluent from the pyrolysis reactor;
(e) recovering a crude oil pyrolyzate from the effluent;
(f) supplying the crude oil pyrolyzate from step (e) as the hydrocarbon pyrolyzate in step (a);
(g) desalting a second portion of the LIP-crude blend from step (a);
(h) supplying brine recovered from step (g) as the water in step (b);
(i) preheating the desalted LIP-crude blend from step (g);
(j) atmospherically distilling the preheated LIP-crude blend from step (i) to separate an atmospheric resid from lower boiling hydrocarbon fractions; and
(k) vacuum distilling the atmospheric resid to separate a vacuum resid from gas oil.

2. A hydrocarbon refinery process comprising the steps of:
(a) combining a liquid ionizing pyrolyzate (LIP) with resid to form an LIP-resid blend comprising the pyrolyzate in an amount from 10 to 20 wt % based on the total weight of the LIP-resid blend;
(b) combining a first portion of the LIP-resid blend, water, and 1-4 wt % of a finely divided solids, wherein the finely divided solids comprises the product of combining an iron source material of limited solubility and chloride brine-treated support material and heat treating the combined material at a temperature of 400° C. to 425° C., to obtain an emulsion comprising (i) 75-85 wt % of an oil phase, (ii) 5-15 wt % of an aqueous phase, and (iii) 3-10 wt % total solids, based on the total weight of the emulsion;
(c) spraying the emulsion in a vapor phase of a flash chemical ionizing pyrolysis reactor at a temperature of 450-500° C.;
(d) collecting an effluent from the pyrolysis reactor;
(e) recovering a liquid ionizing pyrolyzate product from the effluent;
(f) supplying the liquid ionizing pyrolyzate product from step (e) as the liquid ionizing pyrolyzate in step (a);
(g) distilling a second portion of the LIP-resid blend from step (a) to separate resid from lower boiling hydrocarbon fractions;
(h) supplying a first portion of the resid from step (g) to the LIP-resid blend in step (a); and
(i) optionally coking a second portion of the resid from step (g) to obtain coker gas oil.

3. Finely divided solids for emulsion flash ionizing pyrolysis, comprising:
(a) chloride brine-treated calcium bentonite;
(b) an iron source material comprising chloride;
(c) preferably wherein the finely divided solids are prepared according to the process comprising the steps of:
i. treating iron particles with an equal weight of aqua regia, the aqua regia comprising 3 parts by weight hydrochloric acid, 2 parts by weight water, and 1 part by weight nitric acid, to form a solids mixture;
ii. rinsing, drying, and grinding the solids mixture from (i);
iii. treating calcium bentonite with 1 M NaCl brine;
iv. rinsing, drying at 100-125° C., and grinding the treated bentonite from (iii);
v. slurrying the solids mixture from (ii) in water to obtain a slurry comprising 4 wt % of the solids from (ii) by weight of the slurry;
vi. combining 2 parts by weight of the slurry from (v) with 3 parts by weight of the treated bentonite from (iv) to form a paste; and
vii. heat treating the paste from (vi) at a temperature of 400° C. to 425° C. for a period of 4-6 hours to obtain the solids; and
viii. grinding the solids from (vii) to form the finely divided solids.

A1. A hydrocarbon conversion process, comprising the steps of:
emulsifying water and an oil component with an iron source material (preferably hematite, magnetite, iron oxide hydroxide, or a mixture thereof optionally comprising chloride) and an alkali or alkaline earth metal chloride source material;
introducing the emulsion into a flash chemical ionizing pyrolysis (FCIP) reactor maintained at a temperature greater than about 400° C. up to about 600° C. and a pressure up to about 1.5 atm to form an ionized pyrolyzate effluent;
condensing the ionized pyrolyzate from the effluent to recover a liquid ionized pyrolyzate (LIP);
combining a feedstock oil with the LIP to form a pyrolyzate-feedstock blend; and
thermally processing the blend at a temperature above about 100° C.

A2. The process of embodiment A1, wherein the emulsion comprises less than 1 part by weight solids per 100 parts oil component.

A3. The process of embodiment A1, wherein the emulsion further comprises a solid support material, preferably clay, more preferably bentonite.

A4. The process of embodiment A3, comprising preparing the iron and chloride source materials by a method comprising the steps of:
(a) contacting the support material (preferably bentonite) with a chloride brine;
(b) contacting iron with an aqueous mixture of hydrochloric and nitric acids to form a mixture of hematite, magnetite, and iron oxide hydroxide comprising chlorides;
(c) loading the mixture on the brine-treated support material; and
(d) calcining the loaded support material at a temperature below the FCIP temperature.

A5. The process of any of embodiments A1 to A4, further comprising the steps of:
wherein the emulsion comprises (i) 100 parts by weight of the oil component, preferably wherein the oil component comprises the pyrolyzate-feedstock blend; (ii) from about 1 to 100 parts by weight of water, (iii) from about 0.01 to 5 parts by weight (preferably 0.01 to less than 1 part by weight) of the iron source material, and (iv) from about 0.01 to 5 parts by weight of the alkali or alkaline earth metal chloride source material; and spraying the emulsion into the reactor, wherein the reactor temperature is from about 425° C. to about 600° C., preferably 450° C. to 500° C.

A6. The process of embodiment A5, wherein the emulsion comprises less than 1 part by weight solids per 100 parts oil component.

A7. The process of any of embodiments A1 to A6, wherein the feedstock oil comprises hydrocarbons boiling at a temperature equal to or greater than 562° C., and further comprising the step of recovering a hydrocarbon product from the thermally processed blend, the hydrocarbon product having an enriched yield of liquid hydrocarbons boiling at a temperature below 562° C., relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

A8. The process of embodiment A7 wherein the feedstock oil is crude oil, gas oil, resid, or a mixture thereof.

A9. The process of any of embodiments A1 to A8 wherein the thermal processing comprises pyrolysis, distillation, cracking, alkylation, visbreaking, coking, and combinations thereof.

A10. The process of any of embodiments A1 to A9, further comprising supplying at least a portion of the pyrolyzate-feedstock blend as the oil component to the FCIP feed emulsion preparation step wherein the thermal processing step consists of or comprises the spraying of the FCIP feed emulsion into the flash pyrolysis reactor.

A11. A flash chemical ionizing pyrolysis (FCIP) process comprising the steps of:

preparing a feed emulsion comprising (i) 100 parts by weight of an oil component comprising a liquid ionizing pyrolyzate (LIP) and a feedstock oil at a weight ratio of from 1:100 to 1:1, (ii) from about 1 to 100 parts by weight of water, (iii) from about 0.01 to 5 parts by weight (preferably 0.01 to less than 1 part by weight) of an iron source material, and (iv) from about 0.01 to 5 parts by weight of an alkali or alkaline earth metal chloride source material (preferably wherein the emulsion comprises less than 1 part by weight total solids);

spraying the feed emulsion in a flash pyrolysis reactor at a temperature from about 425° C. to about 600° C.;

collecting an effluent from the reactor;

recovering a product oil from the effluent; and supplying a portion of the product oil as the LIP to the feed emulsion preparation step.

A12. A hydrocarbon refinery process comprising the steps of:

combining a liquid ionizing pyrolyzate (LIP) blend component with a feedstock oil at a weight ratio from about 1:100 to about 1:1 to form an LIP blend;

preparing an emulsion comprising (i) a first portion of the LIP blend, (ii) water, (iii) an iron source material, and (iv) an alkali or alkaline earth metal chloride source material (preferably wherein the emulsion comprises less than 1 part by weight total solids); spraying the emulsion in a flash pyrolysis reactor at a temperature from about 425° C. to about 600° C. and a pressure from about 1 to about 1.5 atm;

collecting an effluent from the reactor;

recovering a product LIP from the effluent;

incorporating the product LIP as the LIP blend component in the LIP blend; and distilling a second portion of the LIP blend.

A13. The process of embodiment A12, wherein the feedstock oil comprises crude oil.

A14. The process of embodiment A13, wherein the feedstock oil comprises un-desalted crude oil wherein the process further comprises water washing to desalt the second portion of the LIP blend, and distilling the desalted second portion of the LIP blend.

A15. The process of embodiment A9 wherein the feedstock oil comprises crude oil and further comprising washing the LIP blend with wash water, recovering a solute-enriched spent water from the water washing step, recovering a desalted LIP blend, and heating the desalted LIP blend in advance of distillation of the LIP blend.

A16. A hydrocarbon refinery process comprising the steps of:

preparing a feed emulsion comprising (i) 100 parts by weight of an oil component, (ii) from about 1 to 100 parts by weight of water, (iii) an iron source material, and (iv) an alkali or alkaline earth metal chloride source material (preferably wherein the emulsion comprises less than 1 part by weight total solids);

spraying the feed emulsion in a flash pyrolysis reactor at a temperature from about 425° C. to about 600° C.;

collecting an effluent from the flash pyrolysis reactor;

recovering a liquid ionizing pyrolyzate (LIP) from the effluent;

combining the recovered LIP with a feedstock oil comprising crude oil or a petroleum fraction selected from gas oil, resid, or a combination thereof to form a pyrolyzate-feedstock blend;

distilling, cracking, visbreaking, and/or coking a first portion of the LIP blend; and supplying a second portion of the LIP blend as the oil component in the feed emulsion preparation step.

A17. The process of embodiment A16, wherein the LIP exhibits a SARA analysis having higher saturates and aromatics contents and a lower asphaltenes content than the feedstock oil.

A18. The process of embodiment A16 or A17 wherein a proportion of the LIP in the oil component in the flash pyrolysis is effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

A19. The process of any of embodiments A16 to A18 wherein a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

A20. A crude oil upgrading process, comprising:

blending a liquid ionizing pyrolyzate (LIP) with a heavy oil; and thermally processing the blend at a temperature above about 100° C.

A21. The process of any of embodiments A1 to A19 wherein the oil component and/or the feedstock oil comprise crude oil.

A22. The process of any of embodiments A1 to A19 wherein the oil component and/or the feedstock oil comprise heavy crude oil.

A23. The process of any of embodiments A1 to A19 wherein the oil component and/or the feedstock oil comprise diesel.

A24. The process of any of embodiments A1 to A19 wherein the oil component and/or the feedstock oil comprise atmospheric resid.

A25. The process of any of embodiments A1 to A19 wherein the oil component and/or the feedstock oil comprise vacuum resid.

A26. The process of any of embodiments A1 to A25 wherein the emulsion further comprises finely divided solids in an amount of from 1 to 20 parts by weight per 100 parts by weight oil.

A27. The process of any of embodiments A1 to A25 wherein the emulsion comprises less than 1 part by weight total solids per 100 parts by weight oil.

A28. The process of any of embodiments A1 to A27, wherein the FCIP comprises contacting the emulsion with superheated steam.

B1. A hydrocarbon conversion process, comprising the steps of:

combining a feedstock oil with a liquid ionizing pyrolyzate (LIP) to form an LIP blend; thermally processing the LIP blend; and recovering a hydrocarbon product having an enriched yield of liquid hydrocarbons boiling at a temperature below 562° C., relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

B2. The process of embodiment B1 wherein the feedstock oil is crude oil, gas oil, resid, or a mixture thereof.

B3. The process of embodiment B1 or embodiment B2 wherein the thermal processing comprises emulsion flash chemical ionizing pyrolysis (FCIP), distillation, cracking, alkylation, visbreaking, coking, and combinations thereof, preferably FCIP and/or distillation.

B4. The process of embodiment B3 wherein the liquid ionizing pyrolyzate (LIP) is produced from emulsion flash chemical ionizing pyrolysis (FCIP) comprising the steps of:

preparing an FCIP feed emulsion comprising (i) 100 parts by weight of an oil component, preferably wherein the oil component comprises the LIP blend; (ii) from about 5 to 100 parts by weight of a water component, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil);

spraying the FICP feed emulsion in a pyrolysis reactor at a temperature from about 425° C. to about 600° C., preferably 450° C. to 500° C.;

collecting an effluent from the pyrolysis reactor; and recovering a product LIP from the effluent for use in the combining step to form the LIP blend.

B5. The process of embodiment B4 wherein the emulsion comprises finely divided solids, wherein the finely divided solids comprise the iron source material and the alkali or alkaline earth metal chloride source material, preferably wherein the finely divided solids comprise:

(i) a mixture of hematite, magnetite, and iron oxide hydroxide recovered from the treatment of iron with an aqueous mixture of hydrochloric and nitric acids, the mixture supported on a brine-treated montmorillonite, preferably NaCl brine-treated calcium bentonite, and/or (ii) the product of the method comprising the steps of:

treating iron with an aqueous mixture of hydrochloric and nitric acids to form a solids mixture, preferably wherein the solids mixture has limited solubility;

treating montmorillonite, preferably calcium bentonite, with brine, preferably NaCl brine;

combining a slurry of the solids mixture with the dried, treated montmorillonite to load the mixture on the montmorillonite; and heat treating the loaded montmorillonite at a temperature above 400° C., preferably 400° C. to 425° C.

B6. An emulsion flash chemical ionizing pyrolysis (FCIP) process comprising the steps of:

preparing an FCIP feed emulsion comprising 100 parts by weight of an oil component, from about 5 to 100 parts by weight of a water component, from about 0.01 to 5 parts by weight (preferably 0.01 to less than 1 part by weight) of the iron source material, and from about 0.01 to 5 parts by weight of the alkali or alkaline earth metal chloride source material (preferably wherein the emulsion comprises less than 1 part by weight total solids per 100 parts by weight oil);

spraying the FCIP feed emulsion in a flash pyrolysis reactor at a temperature from about 425° C. to about 600° C.;

collecting an effluent from the pyrolysis reactor;

recovering a product liquid ionizing pyrolyzate (LIP) from the effluent;

combining at least a portion of the product LIP with a feedstock oil to form an LIP blend comprising from 1 to 33.33 wt % of the product LIP; and thermally processing the LIP blend to form a hydrocarbon product having an enriched yield of liquid hydrocarbons boiling at a temperature below 562° C., relative to separate thermal processing of the LIP and feedstock oil, relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

B7. The process of embodiment B6, further comprising supplying at least a portion of the LIP blend as the oil component to the FCIP feed emulsion preparation step wherein the thermal processing step consists of or comprises the spraying of the FCIP feed emulsion into the flash pyrolysis reactor.

B8. An emulsion flash chemical ionizing pyrolysis (FCIP) process comprising the steps of:

preparing an FCIP feed emulsion comprising (i) 100 parts by weight of an oil component comprising a feedstock oil and from 1 to 33.33 wt % of a liquid hydrocarbon pyrolyzate (LIP), based on the total weight of the oil component, (ii) from about 5 to 100 parts by weight of a water component, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil);

spraying the FCIP feed emulsion in a pyrolysis reactor at a temperature from about 425° C. to about 600° C.;

collecting an effluent from the pyrolysis reactor;

recovering a product LIP from the effluent; and optionally supplying a portion of the product LIP to the feed emulsion preparation step.

B9. A hydrocarbon refinery process comprising the steps of:

combining a liquid ionizing pyrolyzate (LIP) with a feedstock oil to form an LIP blend comprising the LIP in an amount from 1 to 33.33 wt % based on the total weight of the LIP blend;

preparing an FCIP feed emulsion comprising (i) 100 parts by weight of a first portion of the LIP blend, (ii) from about 5 to 100 parts by weight of a water component, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil);

spraying the FCIP feed emulsion in an emulsion flash chemical ionizing pyrolysis reactor at a temperature from about 425° C. to about 600° C.;

collecting an effluent from the flash pyrolysis reactor;

recovering a product LIP from the effluent;

incorporating at least a portion of the product LIP into the LIP blend; and distilling a second portion of the LIP blend.

B10. The process of embodiment B9, wherein the feedstock oil comprises crude oil, preferably un-desalted crude oil wherein the process further comprises water washing to desalt the second portion of the LIP blend, and distilling the desalted second portion of the LIP blend.

B11. The process of embodiment B9 wherein the feedstock oil comprises crude oil and further comprising washing the LIP blend with wash water, recovering a solute-enriched spent water from the water washing step, recovering a desalted LIP blend, and heating the desalted LIP blend, preferably in advance of distillation of the LIP blend.

B12. A hydrocarbon refinery process comprising the steps of:

preparing a feed emulsion comprising (i) 100 parts by weight of an oil component, (ii) from about 5 to 100 parts by weight of a water component, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil);

spraying the feed emulsion in a flash pyrolysis reactor at a temperature from about 425° C. to about 600° C.;

collecting an effluent from the flash pyrolysis reactor;

recovering a liquid ionizing pyrolyzate (LIP) from the effluent;

combining the recovered LIP with a feedstock oil comprising a petroleum fraction selected from gas oil, resid, or a combination thereof to form an LIP blend; and distilling, cracking, visbreaking, and/or coking the LIP blend.

B13. The process of embodiment B12 wherein the oil component in the feed emulsion from the preparation step comprises the petroleum fraction, preferably the LIP blend from the combining step.

B14. The process of any of embodiments B6 to B13 wherein the pressure in the pyrolysis reactor is from about 10 to 50 psia, preferably 1 to 1.5 atm.

B15. The process of any of embodiments B6 to B13 wherein the LIP blend comprises the feedstock oil and a proportion of the LIP effective to improve conversion in the pyrolysis reactor of the oil component to the LIP at an enriched yield of liquid hydrocarbons boiling at a temperature below 562° C., and/or an enriched yield of distillates, relative to separate FCIP of the LIP and feedstock oil, relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

B16. The process of any of embodiments B6 to B13 wherein the LIP blend comprises the LIP in an amount from 1 to 33.33 percent and the feedstock oil in an amount from 99 to 66.67 percent, by weight of the LIP blend, preferably from 5 to 25 percent LIP and from 95 to 75 percent feedstock oil, more preferably from 10 to 20 percent LIP and from 90 to 80 percent feedstock oil.

B17. The process of any of embodiments B6 to B13 wherein the mineral support comprises montmorillonite, preferably bentonite, more preferably wherein the process comprises treating calcium bentonite with a sodium chloride brine and/or heat treating the bentonite, preferably to a temperature of 400° C. to 425° C.

B18. The process of embodiment B17 wherein the iron source material comprises an iron oxide, an iron hydroxide, an iron oxide hydroxide, an iron chloride, or a mixture thereof.

B19. The process of embodiment B17, wherein the iron source material comprises the reaction product of elemental iron with an aqueous mixture of hydrochloric acid and nitric acid, preferably wherein a molar ratio of the iron to the total hydrochloric and nitric acids is from 1:2 to 2:1, a molar ratio of the iron to water is from 1:2 to 2:1, and/or a molar ratio of hydrochloric acid to nitric acid is from 1:1 to 10:1, more preferably the reaction product of 1-2 parts by weight of the iron and aqua regia wherein the aqua regia comprises 3 parts by weight hydrochloric acid, 2 parts by weight water, and 1 part by weight nitric acid.

B20. The process of embodiment B19, wherein the iron source material comprises chloride.

B21. The process of any of embodiments B6 to B13, further comprising preparation of the iron source material and alkali or alkaline earth metal chloride source material according to a procedure comprising the steps of:

(a) reacting elemental iron with an aqueous mixture of hydrochloric acid and nitric acid, preferably wherein a molar ratio of the iron to the total hydrochloric and nitric acids is from 1:2 to 2:1, a molar ratio of the iron to water is from 1:2 to 2:1, and/or a molar ratio of hydrochloric acid to nitric acid is from 1:1 to 10:1, more preferably the reaction product of equal weights of the iron and aqua regia wherein the aqua regia comprises 3 parts by weight hydrochloric acid, 2 parts by weight water, and 1 part by weight nitric acid;

(b) treating calcium bentonite with a chloride brine;

(c) loading the reaction product from (a) on the treated bentonite from (b), preferably by incipient wetness, more preferably by drying the treated bentonite from (b), slurrying the reaction product from (a), and contacting the dried bentonite with the slurry;

(d) heat treating the bentonite loaded with the reaction product, preferably by heating to a temperature from 400° C. to 425° C.; and (e) grinding the heat treated sodium bentonite, preferably to a size passing a 60 mesh screen.

B22. The process of any of embodiments B1 to B21 wherein the oil component (if present) and/or the feedstock oil comprise crude oil.

B23. The process of any of embodiments B1 to B21 wherein the oil component (if present) and/or the feedstock oil comprise heavy crude oil.

B24. The process of any of embodiments B1 to B21 wherein the oil component (if present) and/or the feedstock oil comprise diesel.

B25. The process of any of embodiments B1 to B21 wherein the oil component (if present) and/or the feedstock oil comprise atmospheric resid.

B26. The process of any of embodiments B1 to B21 wherein the oil component (if present) and/or the feedstock oil comprise vacuum resid.

B27. The process of any of embodiments B4 to B26, wherein the FCIP comprises contacting the emulsion with superheated steam.

C1. A hydrocarbon desulfurization process, comprising the steps of:

emulsifying water and a high sulfur oil component comprising a feedstock oil with an iron source material and an alkali or alkaline earth metal chloride source material (preferably wherein the emulsion comprises less than 1 part by weight total solids per 100 parts by weight oil);

introducing the emulsion into a flash chemical ionizing pyrolysis (FCIP) reactor maintained at a temperature greater than about 400° C. up to about 600° C. and a pressure up to about 1.5 atm to form an ionized pyrolyzate effluent;

condensing the ionized pyrolyzate from the effluent to recover a liquid ionized pyrolyzate (LIP) having a reduced sulfur content relative to the high sulfur oil component.

C2. The process of embodiment C1, wherein the solids comprise brine-treated clay and an acid addition salt of a Group 8-10 metal, wherein the brine comprises a salt that forms a eutectic with the acid addition salt of the Group 8-10 metal.

C3. The process of embodiment C2, wherein the iron source material comprises an iron oxide, an iron hydroxide, an iron oxide hydroxide, an iron chloride, or a mixture thereof.

C4. The process of embodiment C3, comprising preparing the iron source material by a method comprising contacting iron with an aqueous mixture of hydrochloric and nitric acids to form a mixture of hematite, magnetite, and iron oxide hydroxide.

C5. The process of any of embodiments C1 to C4, further comprising:

wherein the emulsion comprises (i) 100 parts by weight of the oil component, preferably wherein the oil component comprises the pyrolyzate-feedstock blend; (ii) from about 1 to 100 parts by weight of water, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil); and spraying the emulsion into the reactor, wherein the reactor temperature is from about 425° C. to about 600° C., preferably 450° C. to 550° C.

C6. The process of embodiment C5 wherein the iron source material further comprises chloride.

C7. The process of any of embodiments C1 to C6, further comprising combining the feedstock oil with the LIP from the condensation step to form the oil component for the emulsifying step (preferably at weight ratio of 5-35 wt % LIP and 95-65 wt % feedstock oil).

C8. The process of embodiment C1, further comprising:

combining the feedstock oil with the LIP from the condensation step to form a pyrolyzate-feedstock blend; and thermally processing the blend at a temperature above about 100° C.

C9. The process of embodiment C8, wherein the feedstock oil comprises hydrocarbons boiling at a temperature equal to or greater than 562° C., and further comprising the step of recovering a hydrocarbon product from the thermally processed blend, the hydrocarbon product having an enriched yield of liquid hydrocarbons boiling at a temperature below 562° C., relative to separate thermal processing of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

C10. The process of embodiment C9 wherein the feedstock oil is crude oil, gas oil, resid, or a mixture thereof.

C11. The process of any of embodiments C8 to C10 wherein the thermal processing comprises pyrolysis, distillation, cracking, alkylation, visbreaking, coking, and combinations thereof.

C12. The process of any of embodiments C8 to C11, further comprising supplying at least a portion of the pyrolyzate-feedstock blend as the oil component to the FCIP feed emulsion preparation step wherein the thermal processing step consists of or comprises the spraying of the FCIP feed emulsion into the flash pyrolysis reactor.

C13. A flash chemical ionizing pyrolysis (FCIP) process comprising the steps of:

preparing a feed emulsion comprising (i) 100 parts by weight of an oil component comprising a liquid ionizing pyrolyzate (LIP) and a high sulfur feedstock oil at a weight ratio of from 1:100 to 1:1, (ii) from about 1 to 100 parts by weight of water, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil);

spraying the feed emulsion in a flash pyrolysis reactor at a temperature from about 425° C. to about 600° C.;

collecting an effluent from the reactor;

recovering a product oil from the effluent, wherein the product oil has a sulfur content lower than sulfur content of the oil component; and supplying a portion of the product oil as the LIP to the feed emulsion preparation step.

C14. A hydrocarbon refinery process comprising the steps of:

combining a liquid ionizing pyrolyzate (LIP) blend component with a high sulfur feedstock oil at a weight ratio from about 1:100 to about 1:1 to form an LIP blend;

preparing an emulsion comprising (i) a first portion of the LIP blend, (ii) water, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil);

spraying the emulsion in a flash pyrolysis reactor at a temperature from about 425° C. to about 600° C. and a pressure from about 1 to about 1.5 atm;

collecting an effluent from the reactor;

recovering a product LIP from the effluent;

incorporating the product LIP as the LIP blend component in the LIP blend; and distilling a second portion of the LIP blend.

C15. The process of embodiment C14, wherein the feedstock oil comprises crude oil.

C16. The process of embodiment C15, wherein the feedstock oil comprises un-desalted crude oil wherein the process further comprises water washing to desalt the second portion of the LIP blend, and distilling the desalted second portion of the LIP blend.

C17. The process of embodiment C11 wherein the feedstock oil comprises high sulfur crude oil and further comprising washing the LIP blend with wash water, recovering a solute-enriched spent water from the water washing step, recovering a desalted LIP blend, and heating the desalted LIP blend in advance of distillation of the LIP blend.

C18. A hydrocarbon refinery process comprising the steps of:

preparing a feed emulsion comprising (i) 100 parts by weight of an oil component, (ii) from about 1 to 100 parts by weight of water, (iii) from about 0.01 to 5 parts by weight (preferably 0.01 to less than 1 part by weight) of the iron source material, and (iv) from about 0.01 to 5 parts by weight of the alkali or alkaline earth metal chloride source material (preferably wherein the emulsion comprises less than 1 part by weight total solids per 100 parts by weight oil);

spraying the feed emulsion in a flash pyrolysis reactor at a temperature from about 425° C. to about 600° C.;

collecting an effluent from the flash pyrolysis reactor;

recovering a liquid ionizing pyrolyzate (LIP) from the effluent;

combining the recovered LIP with a high sulfur feedstock oil comprising crude oil or a petroleum fraction selected from gas oil, resid, or a combination thereof to form a pyrolyzate-feedstock blend;

distilling, cracking, visbreaking, and/or coking a first portion of the LIP blend; and supplying a second portion of the LIP blend as the oil component in the feed emulsion preparation step.

C19. The process of embodiment C18, wherein the LIP exhibits a SARA analysis having higher saturates and aromatics contents and a lower asphaltenes content than the feedstock oil.

C20. The process of embodiment C18 or C19 wherein a proportion of the LIP in the oil component in the flash pyrolysis is effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

C21. The process of any of embodiments C18 to C20 wherein a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

C22. The process of any of embodiments C1 to C21, wherein the FCIP comprises contacting the emulsion with superheated steam.

D1. A hydrocarbon conversion process, comprising the steps of:

providing an iron source material;

providing an alkali or alkaline earth metal chloride source material;

providing an aqueous phase;

mixing the iron source material, the alkali or alkaline earth metal chloride source material, and the aqueous phase with an oil component to form an ionized feed emulsion;

introducing the ionized feed emulsion into a flash chemical ionizing pyrolysis (FCIP) reactor maintained at a temperature greater than about 400° C. up to about 600° C. and a pressure from 10 to 50 psia to form a chemical ionizing pyrolyzate effluent; and condensing a liquid ionizing pyrolyzate (LIP) from the effluent.

D2. The process of embodiment D1, wherein the iron source material comprises an iron oxide, an iron hydroxide, an iron oxide hydroxide, an iron chloride, or a mixture thereof.

D3. The process of embodiment D1, wherein the iron source material comprises hematite, magnetite, iron oxide hydroxide, or a mixture thereof.

D4. The process of any of embodiments D1 to D3, wherein the iron source material comprises a mixture of hematite, magnetite, and iron oxide hydroxide.

D5. The process of any of embodiments D1 to D4, wherein the iron source material comprises beta-ferric oxide hydroxide and optionally comprises chloride.

D6. The process of any of embodiments D1 to D5, wherein the iron source material further comprises chloride.

D7. The process of any of embodiments D1 to D6, wherein the iron source material comprises the reaction product of iron with a mixture of hydrochloric acid and nitric acid in the presence of water (preferably aqua regia), preferably to form a mixture of hematite, magnetite, and iron oxide hydroxide.

D8. The process of embodiment D7, further comprising reacting iron with a mixture of hydrochloric acid and nitric acid in the presence of water (preferably aqua regia) to form the iron source material.

D9. The process of any of embodiments D1 to D8, wherein the iron source material comprises solid particulates, preferably particles having a major dimension equal to or less than 4 microns.

D10. The process of any of embodiments D1 to D9, further comprising first mixing the iron source material, the alkali or alkaline earth metal chloride source material, and the aqueous phase with a first portion of the oil component to form a pre-mix emulsion, and then mixing the pre-mix emulsion with a second portion of the oil component.

D11. The process of embodiment D10, wherein the oil component is present in the pre-mix emulsion in an amount equal to or less than 20 parts by weight per 100 parts by weight of the aqueous phase.

D12. The process of any of embodiments D1 to D11, wherein the iron source material is present in the ionized feed emulsion in an amount of from 0.01 to 5 parts by weight, per 100 parts by weight of the primary oil component, preferably 0.05 to 1 part by weight.

D13. The process of any of embodiments D1 to D12, wherein the alkali or alkaline earth metal chloride source material comprises NaCl, KCl, LiCl, $MgCl_2$, $CaCl_2$), $BaCl_2$, or a mixture thereof.

D14. The process of any of embodiments D1 to D13, wherein the alkali or alkaline earth metal chloride source material is present in the ionized feed emulsion in an amount of from 0.01 to 5 parts by weight, per 100 parts by weight of the primary oil component, preferably 0.05 to 1 part by weight.

D15. The process of any of embodiments D1 to D14, wherein the iron source material is unsupported, preferably wherein the feed emulsion is essentially free of added clay solids.

D16. The process of any of embodiments D1 to D15, wherein the feed emulsion comprises less than 1 part by weight undissolved solids per 100 parts by weight of the oil component, more preferably less than 0.5 parts by weight undissolved solids per 100 parts by weight of the oil component.

D17. The process of any of embodiments D1 to D16, wherein the feed emulsion is essentially free of added solids other than the iron source material and any sediment from the oil component.

D18. The process of any of embodiments D1 to D17, wherein the feed emulsion comprises from 1 to 100 parts by weight water per 100 parts by weight of the oil component, preferably 5 to 50 parts by weight water, more preferably 5 to 20 parts by weight water.

D19. The process of any of embodiments D1 to D18, wherein the reactor temperature is from about 425° C. to about 600° C., preferably 450° C. to 500° C.

D20. The process of any of embodiments D1 to D19, wherein the reaction pressure is equal to or greater than 10 psia up to 30 psia, preferably equal to or less than 25 psia, more preferably 1-1.5 atm.

D21. The process of any of embodiments D1 to D20, comprising a residence time in the flash chemical ionizing pyrolysis reactor from 0.1 up to 10 seconds, preferably from 0.5 to 4 seconds.

D22. The process of any of embodiments D1 to D21, wherein the introduction step comprises spraying the feed emulsion in the flash chemical ionizing pyrolysis reactor, preferably atomizing the feed emulsion in the flash chemical ionizing pyrolysis reactor.

D23. The process of any of embodiments D1 to D22, wherein the iron source material and the alkali or alkaline earth metal chloride source material comprise the product of the method comprising the steps of:

treating iron with an aqueous mixture of hydrochloric and nitric acids to form a product mixture of hematite, magnetite, and beta-ferric oxide hydroxide, preferably wherein the product mixture further comprises chloride;

treating a support material, preferably montmorillonite, silica, alumina, and/or zeolite, with a chloride brine and drying the treated support material;

combining a slurry of the product mixture with the treated support material to load the product mixture on the support material; and heat treating the loaded support material, preferably at a temperature above 400° C.

D24. The process of any of embodiments D1 to D23, wherein the oil component comprises hydrocarbons boiling at temperatures less than and greater than 562° C., and wherein the LIP is enriched in hydrocarbons boiling at a temperature less than 562° C., as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

D25. The process of any of embodiments D1 to D24, wherein the oil component is crude oil, gas oil, resid, or a mixture thereof, preferably a heavy oil.

D26. The process of any of embodiments D1 to D25, further comprising the steps of:

combining a feedstock oil with the LIP to form a pyrolyzate-feedstock blend; and thermally processing the blend at a temperature above about 100° C.

D27. The process of embodiment D26, wherein the thermal processing comprises pyrolysis, distillation, cracking, alkylation, visbreaking, coking, and combinations thereof.

D28. The process of embodiment D26 or D27, further comprising supplying at least a portion of the pyrolyzate-feedstock blend as the oil component to the FCIP feed emulsion preparation step wherein the thermal processing step consists of or comprises the spraying of the FCIP feed emulsion into the flash chemical ionizing pyrolysis reactor.

D29. A hydrocarbon conversion process, comprising the steps of:

reacting iron with a mixture of hydrochloric acid and nitric acid in the presence of water (preferably aqua regia) to form an iron source material;

mixing the iron source material, an alkali or alkaline earth metal chloride source material, and an aqueous phase with an oil component to form a feed emulsion;

introducing the feed emulsion into a flash chemical ionizing pyrolysis (FCIP) reactor maintained at a temperature greater than about 400° C. up to about 600° C. and a pressure from 10 to 50 psia for a residence time of from 0.1 to 10 seconds to form a chemical ionizing pyrolyzate effluent; and condensing a liquid ionizing pyrolyzate (LIP) from the effluent;

optionally blending the LIP with a feedstock oil and thermally processing the blend.

D30. A hydrocarbon refinery process comprising the steps of:

preparing an ionized feed emulsion comprising (i) 100 parts by weight of an oil component, (ii) from about 1 to 100 parts by weight of water, (iii) from about 0.01 to 5 parts by weight of an iron source material, and (iv) from about 0.01 to 5 parts by weight of an alkali or alkaline earth metal chloride source material;

spraying the ionized feed emulsion in a flash chemical ionizing pyrolysis reactor at a temperature from about 400° C. to about 600° C.;

collecting an effluent from the flash chemical ionizing pyrolysis reactor; and recovering a liquid ionizing pyrolyzate (LIP) from the effluent.

D31. The method of embodiment D30, further comprising:

combining the recovered LIP with a feedstock oil comprising crude oil or a petroleum fraction selected from gas oil, resid, or a combination thereof to form a pyrolyzate-feedstock blend;

distilling, cracking, visbreaking, and/or coking a first portion of the blend; and optionally supplying a second portion of the blend as the oil component in the ionized feed emulsion preparation step.

D32. The process of embodiment D31, wherein the LIP exhibits a SARA analysis having higher saturates and aromatics contents and a lower asphaltenes content than the feedstock oil.

D33. The process of embodiment D31 or D32, wherein a proportion of the LIP in the oil component in the flash chemical ionizing pyrolysis is effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

D34. The process of any of embodiments D31 to D33, wherein a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

D35. The process of any of embodiments D1 to D34, wherein the feed emulsion comprises less than 1 part solids per 100 parts oil.

D36. The process of any of embodiments D1 to D35, wherein the FCIP comprises contacting the emulsion with superheated steam.

E1. A hydrocarbon conversion process, comprising the steps of:

- providing an unsupported iron source material;
- providing an alkali or alkaline earth metal chloride source material;
- providing an aqueous phase;
- mixing the iron source material, the alkali or alkaline earth metal chloride source material, and the aqueous phase with an oil component to form a feed emulsion, wherein the feed emulsion comprises less than 1 part by weight of added undissolved solids per 100 parts by weight of the oil component;
- introducing the feed emulsion into a flash chemical ionizing pyrolysis (FCIP) reactor maintained at a temperature greater than about 400° C. up to about 600° C. and a pressure from 10 to 50 psia to form a chemical ionizing pyrolyzate effluent; and
- condensing a liquid ionizing pyrolyzate (LIP) from the effluent.

E2. The process of embodiment E1, wherein the iron source material comprises an iron oxide, an iron hydroxide, an iron oxide hydroxide, an iron chloride, or a mixture thereof, preferably hematite, magnetite, iron oxide hydroxide, or a mixture thereof.

E3. The process of embodiment E1, wherein the iron source material comprises the reaction product of iron with a mixture of hydrochloric acid and nitric acid in the presence of water (preferably aqua regia), preferably to form a mixture of hematite, magnetite, and iron oxide hydroxide.

E4. The process of any of embodiments E1 to E3, further comprising reacting iron with a mixture of hydrochloric acid and nitric acid in the presence of water (preferably aqua regia) to form the iron source material.

E5. The process of any of embodiments E1 to E4, wherein the iron source material comprises hematite, magnetite, iron oxide hydroxide, and chloride.

E6. The process of any of embodiments E1 to E5, wherein the iron source material comprises solid particulates, preferably particles having a major dimension equal to or less than 4 microns.

E7. The process of any of embodiments E1 to E6, further comprising first mixing the iron source material, the alkali or alkaline earth metal chloride source material, and the aqueous phase with a first portion of the oil component to form a pre-mix emulsion, and then mixing the pre-mix emulsion with a second portion of the oil component.

E8. The process of embodiment E7, wherein the oil component is present in the pre-mix emulsion in an amount equal to or less than 20 parts by weight per 100 parts by weight of the aqueous phase.

E9. The process of any of embodiments E1 to E8, wherein the iron source material is present in the ionized feed emulsion in an amount of from 0.01 to 5 parts by weight, per 100 parts by weight of the oil component, preferably 0.05 to less than 1 part by weight.

E10. The process of any of embodiments E1 to E9, wherein the alkali or alkaline earth metal chloride source material comprises NaCl, KCl, LiCl, $MgCl_2$, $CaCl_2$), $BaCl_2$, or a mixture thereof.

E11. The process of any of embodiments E1 to E10, wherein the alkali or alkaline earth metal chloride source material is present in the ionized feed emulsion in an amount of from 0.01 to 5 parts by weight, per 100 parts by weight of the primary oil component, preferably 0.05 to 1 part by weight.

E12. The process of any of embodiments E1 to E11, wherein the ionized feed emulsion is essentially free of added clay solids.

E13. The process of any of embodiments E1 to E12, wherein the ionized feed emulsion comprises less than 1 part by weight undissolved solids per 100 parts by weight of the oil component, more preferably less than 0.5 parts by weight undissolved solids per 100 parts by weight of the oil component.

E14. The process of claim any of embodiments E1 to E13, wherein the ionized feed emulsion is essentially free of added solids other than the iron source material and any sediment from the oil component.

E15. The process of any of embodiments E1 to E14, wherein the ionized feed emulsion comprises from 1 to 100 parts by weight water per 100 parts by weight of the oil component, preferably 5 to 50 parts by weight water, more preferably 5 to 20 parts by weight water.

E16. The process of any of embodiments E1 to E15, wherein the reactor temperature is from about 425° C. to about 600° C., preferably 450° C. to 500° C.

E17. The process of any of embodiments E1 to E16, wherein the reaction pressure is equal to or greater than 10 psia up to 30 psia, preferably equal to or less than 25 psia, more preferably 1-1.5 atm.

E18. The process of any of embodiments E1 to E17, comprising a residence time in the flash chemical ionizing pyrolysis reactor from 0.1 up to 10 seconds, preferably from 0.5 to 4 seconds.

E19. The process of any of embodiments E1 to E18, wherein the introduction step comprises spraying the ionized feed emulsion in the flash chemical ionizing pyrolysis reactor, preferably atomizing the ionized feed emulsion in the flash chemical ionizing pyrolysis reactor.

E20. The process of any of embodiments E1 to E19, wherein the iron source material and the alkali or alkaline earth metal chloride source material comprise the product of the method comprising the steps of:

treating iron with an aqueous mixture of hydrochloric and nitric acids to form a product mixture of two or more of hematite, magnetite, ferric oxide hydroxide, and chloride;

treating a support material, preferably montmorillonite, silica, alumina, and/or zeolite, with NaCl brine and drying the treated support material;

combining a slurry of the product mixture with the treated montmorillonite to load the product mixture on the support material; and heat treating the loaded support material, preferably at a temperature above 400° C.

E21. The process of any of embodiments E1 to E20, wherein the oil component comprises hydrocarbons boiling at temperatures less than and greater than 562° C., and wherein the LIP is enriched in hydrocarbons boiling at a temperature less than 562° C., as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

E22. The process of any of embodiments E1 to E21, wherein the oil component is crude oil, gas oil, resid, or a mixture thereof, preferably a heavy oil.

E23. The process of any of embodiments E1 to E22, further comprising the steps of:

combining a feedstock oil with the LIP to form a pyrolyzate-feedstock blend; and thermally processing the blend at a temperature above about 100° C.

E24. The process of embodiment E23, wherein the thermal processing comprises pyrolysis, distillation, cracking, alkylation, visbreaking, coking, and combinations thereof.

E25. The process of embodiment E23 or E24, further comprising supplying at least a portion of the pyrolyzate-feedstock blend as the oil component to the FCIP feed emulsion preparation step wherein the thermal processing step consists of or comprises the spraying of the FCIP feed emulsion into the flash chemical ionizing pyrolysis reactor.

E26. A hydrocarbon conversion process, comprising the steps of:

reacting iron with a mixture of hydrochloric acid and nitric acid in the presence of water (preferably aqua regia) to form an unsupported iron source material;

mixing the unsupported iron source material, an alkali or alkaline earth metal chloride source material, and an aqueous phase with an oil component to form an ionized feed emulsion, wherein the ionized feed emulsion comprises less than 1 part by weight of added undissolved solids per 100 parts by weight of the oil component;

introducing the ionized feed emulsion into a flash chemical ionizing pyrolysis (FCIP) reactor maintained at a temperature greater than about 400° C. up to about 600° C. and a pressure from 10 to 50 psia for a residence time of from 0.1 to 10 seconds to form a chemical ionizing pyrolyzate effluent;

condensing a liquid ionizing pyrolyzate (LIP) from the effluent; and optionally blending the LIP with a feedstock oil and thermally processing the blend.

E27. A hydrocarbon refinery process comprising the steps of:

preparing an ionized feed emulsion comprising (i) 100 parts by weight of an oil component, (ii) from about 1 to 100 parts by weight of water, (iii) from about 0.01 to 5 parts by weight of an unsupported iron source material, and (iv) from about 0.01 to 5 parts by weight of an alkali or alkaline earth metal chloride source material, wherein the ionized feed emulsion comprises less than 1 part by weight of added undissolved solids per 100 parts by weight of the oil component;

spraying the ionized feed emulsion in a flash chemical ionizing pyrolysis reactor at a temperature from about 400° C. to about 600° C.;

collecting an effluent from the flash chemical ionizing pyrolysis reactor; and recovering a liquid ionizing pyrolyzate (LIP) from the effluent.

E28. The method of embodiment E27, further comprising:

combining the recovered LIP with a feedstock oil comprising crude oil or a petroleum fraction selected from gas oil, resid, or a combination thereof to form a pyrolyzate-feedstock blend;

distilling, cracking, visbreaking, and/or coking a first portion of the blend; and optionally supplying a second portion of the blend as the oil component in the ionized feed emulsion preparation step.

E29. The process of embodiment E28, wherein the LIP exhibits a SARA analysis having higher saturates and aromatics contents and a lower asphaltenes content than the feedstock oil.

E30. The process of embodiment E28 or E29, wherein a proportion of the LIP in the oil component in the flash chemical ionizing pyrolysis is effective to improve yield of liquid hydrocarbons boiling at a temperature below 562° C., relative to separate flash chemical ionizing pyrolysis of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

E31. The process of any of embodiments E28 to E30, wherein a proportion of the LIP in the LIP blend in the distillation, cracking, visbreaking, and/or coking step, is effective to improve yield of liquid hydrocarbons boiling at a temperature below 562° C., relative to separate distillation, cracking, visbreaking, and/or coking of the LIP and feedstock oil, as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

E32. The process of any of embodiments E1 to E31, wherein the FCIP comprises contacting the emulsion with superheated steam.

F1. A hydrocarbon conversion process, comprising the steps of:

mixing an aqueous phase and catalyst particulates comprising iron and chloride with an oil component to form a feed emulsion;

introducing the feed emulsion into a pyrolysis reactor maintained at a temperature greater than about 400° C. up to about 600° C. and a pressure from about 1 to about 1.5 atm absolute to form a pyrolyzate effluent; and condensing a liquid pyrolyzate (LP) from the effluent.

F2. The process of embodiment F1, wherein the catalyst particulates comprise an iron oxide, an iron hydroxide, an iron oxide hydroxide, an iron chloride, or a mixture thereof.

F3. The process of embodiment F1 or embodiment F2, wherein the catalyst particulates comprise hematite, magnetite, iron oxide hydroxide, or a mixture thereof.

F4. The process of embodiment F3 wherein the catalyst particulates comprise a mixture of hematite, magnetite, and iron oxide hydroxide.

F5. The process of embodiment F3, wherein the catalyst particulates comprise beta-ferric oxide hydroxide.

F6. The process of any of embodiments F1-F5, wherein the catalyst particulates comprise the reaction product of iron with a mixture of hydrochloric acid and nitric acid in the presence of water.

F7. The process of embodiment F6, wherein the mixture of hydrochloric acid and nitric acid comprises aqua regia.

F8. The process of embodiment F6, wherein the catalyst particulates comprise a mixture of hematite, magnetite, and iron oxide hydroxide.

F9. The process of any of embodiments F1-F8, further comprising reacting iron with a mixture of hydrochloric acid and nitric acid in the presence of water to form the catalyst particulates.

F10. The process of any of embodiments F1-F9, wherein the catalyst particulates comprise solid particulates having a major dimension equal to or less than 4 microns.

F11. The process of any of embodiments F1-F8, wherein the feed emulsion further comprises an alkali or alkaline earth metal chloride source material.

F12. The process of embodiment F11, further comprising first mixing the catalyst particulates, the alkali or alkaline earth metal chloride source material, and the aqueous phase with a first portion of the oil component to form a pre-mix emulsion, and then mixing the pre-mix emulsion with a second portion of the oil component to form the feed emulsion.

F13. The process of embodiment F12, wherein the oil component is present in the pre-mix emulsion in an amount equal to or less than 20 parts by weight per 100 parts by weight of the aqueous phase.

F14. The process of any of embodiments F1-F13, wherein the catalyst particulates are present in the feed emulsion in an amount of from 0.01 to 5 parts by weight, per 100 parts by weight of the oil component, preferably 0.05 to 1 part by weight.

F15. The process of any of embodiments F11-F14, wherein the alkali or alkaline earth metal chloride source material comprises NaCl, KCl, LiCl, $MgCl_2$, $CaCl_2$), $BaCl_2$, or a mixture thereof, preferably NaCl.

F16. The process of any of embodiments F11-F15, wherein the alkali or alkaline earth metal chloride source material is present in the feed emulsion in an amount of from 0.01 to 5 parts by weight, per 100 parts by weight of the primary oil component, preferably 0.05 to 1 part by weight.

F17. The process of any of embodiments F1-F16, wherein the catalyst particles are unsupported, wherein the feed emulsion is essentially free of added clay solids.

F18. The process of any of embodiments F1-F17, wherein the feed emulsion comprises less than 1 part by weight undissolved solids per 100 parts by weight of the oil component, preferably less than 0.5 parts by weight undissolved solids per 100 parts by weight of the oil component.

F19. The process of any of embodiments F1-F18, wherein the feed emulsion is essentially free of added solids other than the catalyst particulates and any sediment from the oil component.

F20. The process of any of embodiments F1-F16, wherein the catalyst particulates further comprise clay.

F21. The process of any of embodiments F1-F20, wherein the feed emulsion comprises from 1 to 100 parts by weight water per 100 parts by weight of the oil component, preferably 5 to 50 parts by weight water, more preferably 5 to 20 parts by weight water.

F22. The process of any of embodiments F1-F21, wherein the reactor temperature is from about 425° C. to about 600° C., preferably 450° C. to 500° C.

F23. The process of any of embodiments F1-F22, wherein the pyrolysis reactor comprises a flash chemical ionizing pyrolysis (FCIP) reactor comprising a residence time from 0.1 up to 10 seconds, preferably from 0.5 to 4 seconds.

F24. The process of any of embodiments F1-F23, wherein the introduction step comprises spraying the feed emulsion in the FCIP reactor.

F25. The process of any of embodiments F1-F24, wherein the catalyst particulates comprise the product of the method comprising the steps of:

treating iron with an aqueous mixture of hydrochloric and nitric acids to form a product mixture of hematite, magnetite, and beta-ferric oxide hydroxide, wherein the product mixture further comprises chloride;

treating a support material with a chloride brine and drying the treated support material;

combining a slurry of the product mixture with the treated support material to load the product mixture on the support material; and heat treating the loaded support material.

F26. The process of any of embodiments F1-F25, wherein the oil component comprises hydrocarbons boiling at temperatures less than and greater than 562° C., and wherein the LP is enriched in hydrocarbons boiling at a temperature less than 562° C., as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

F27. The process of any of embodiments F1-F26, wherein the oil component comprises a heavy oil comprising crude oil, gas oil, resid, or a mixture thereof.

F28. The process of any of embodiments F1-F27, further comprising the steps of:

combining a feedstock oil with the LP to form a pyrolyzate-feedstock blend; and thermally processing the blend at a temperature above about 100° C.

F29. The process of embodiment F28, wherein the thermal processing comprises pyrolysis, distillation, cracking, alkylation, visbreaking, coking, or a combination thereof.

F30. The process of embodiment F28 or embodiment F29, further comprising supplying at least a portion of the pyrolyzate-feedstock blend as the oil component to the feed emulsion preparation step wherein the thermal processing step consists of or comprises the spraying of the feed emulsion into the pyrolysis reactor.

F31. The process of any of embodiments F1 to F30, wherein the FCIP comprises contacting the emulsion with superheated steam.

G1. Any preceding embodiment wherein the iron source material comprises hematite.

G2. Any preceding embodiment wherein the iron source material comprises magnetite.

G3. Any preceding embodiment wherein the iron source material comprises beta ferric oxide hydroxide.

G4. Any preceding embodiment wherein the iron source material comprises chloride.

G5. Any preceding embodiment wherein the iron source material comprises hematite and magnetite.

G6. Any preceding embodiment wherein the iron source material comprises hematite and beta ferric oxide hydroxide.

G7. Any preceding embodiment wherein the iron source material comprises hematite and chloride.

G8. Any preceding embodiment wherein the iron source material comprises magnetite and beta ferric oxide hydroxide.

G9. Any preceding embodiment wherein the iron source material comprises magnetite and chloride.

G10. Any preceding embodiment wherein the iron source material comprises beta ferric oxide hydroxide and chloride.

G11. Any preceding embodiment wherein the iron source material comprises hematite, magnetite and beta ferric oxide hydroxide.

G12. Any preceding embodiment wherein the iron source material comprises hematite, magnetite and chloride.

G13. Any preceding embodiment wherein the iron source material comprises hematite, magnetite, beta ferric oxide hydroxide, and chloride.

EXAMPLES

Example 1A: Preparation of Iron Solids

Preferred finely divided solids according to the present invention were prepared by mixing with constant stirring 1 part by weight 100 mesh hydrogen reduced iron shavings with 1 part by weight aqua regia (1 part by weight nitric acid, 3 parts by weight hydrochloric acid, 2 parts by weight water). The aqua regia was added in three aliquots (1 part each, i.e., ⅓, ⅓, ⅓), and the temperature increased to 95° C. The material dried considerably, leaving wet solids. The oxidized iron solids were dried in an oven at 130° C., and ground to pass a 100 mesh screen. The oxidized iron solids had a reddish black or dark violet color.

The oxidized iron solids were analyzed by wet chemistry by sequential digestion in hot water, followed by digestion of the water-insoluble solids in 20 wt % HCl(aq), and recovery of the insoluble material which was not further analyzed. Initially, a 5 g sample of the oxidized iron solids was placed in 150 ml of 100° C. water, and the water-insoluble solids remaining were recovered and weighed. The amount digested in the water was surprisingly only 1.4488 g, or 28.98 wt %. The filtrate was diluted to 1 L and the solute was found by spectrophotometry to contain 11.32 wt % total Fe consisting of 3.24 wt % Fe(II) and 8.08 wt % Fe(III), 32.79 wt % chloride, 3.52 wt % nitrite, and 1.17 wt % nitrate. The water-soluble fraction was thus determined to be mostly chloride and nitrite salts with some nitrate salts.

The water-insoluble fraction was then digested in 150 ml of 20% HCl in water, and 3.478 g went into solution, or 69.56 wt % of the initial oxidized iron sample. The acid soluble fraction was found to contain 62.23 wt % total Fe consisting of 7.04 wt % Fe(II) and 55.19 Fe(III), 51.18 wt % nitrate, and 0.2587 wt % nitrite. The acid soluble fraction was thus found to contain mostly ferric oxides and/or nitrates, with some ferrous iron and a small amount of nitrite. From a relatively small proportion of ferrous iron seen in the acid soluble fraction, it was inferred that little or no elemental iron was present. The acid insoluble fraction was just 1.46 wt % of the original sample, and appeared from its red color to be Fe(III) oxide, hematite. The wet chemistry data are summarized in Table 1.

TABLE 1

WET CHEMISTRY ANALYSIS OF IRON OXIDIZED BY AQUA REGIA

| Sample | Mass, g | Total Iron, wt % | Fe(II), wt % | Fe(III), wt % | Chloride, wt % | Nitrate ($NO_3^-$), % | Nitrite ($NO_2^-$), % |
|---|---|---|---|---|---|---|---|
| Original Sample | 5 | | | | | | |
| Water Solubles | 1.449 | 11.32 | 3.24 | 8.08 | 32.79 | 1.17 | 3.52 |
| Acid Solubles | 3.478 | 62.23 | 7.04 | 55.19 | nd | 51.18 | 0.2587 |
| Acid Insolubles | 0.073 | nd | nd | nd | nd | nd | nd |

nd = not determined

Example 1B: Preparation of Iron Solids with 2× Aqua Regia

The finely divided solids were prepared as in Example 1A except 1 part by weight 100 mesh hydrogen reduced iron shavings was mixed with 2 parts by weight aqua regia comprising 1 parts by weight nitric acid, 3 parts by weight hydrochloric acid, and 2 parts by weight water. Following the reaction between 25 kg of the iron and 50 kg of the aqua regia, the reaction mass weighed 58.5 kg. After drying at 130° C., the acidified iron product weighed 36 kg and had a reddish black color. XRD analysis showed the presence of hematite, magnetite, and beta-ferric oxide hydroxide. SEM analysis showed 65.5 wt % Fe; 23.0 wt % 0; 8.08 wt % Cl; 1.97 wt % Cu; and less than 1 wt % of Cr, Si, Al, and Sr. The acidified iron product or one similar to it was used in the following examples.

Example 1C: Preparation of Supported Iron Solids

The iron solids were prepared as in Example 1A or 1B and then these were loaded on NaCl-treated calcium bentonite generally using the following procedure. A 100 mesh calcium bentonite was obtained commercially. A 1 M aqueous NaCl brine was prepared from distilled water and salt obtained commercially. The bentonite was prepared by mixing the as-received bentonite with the brine at a 1:2 weight ratio (1 part by weight bentonite, 2 parts by weight brine), stirring for 1 hour, and then allowing the mixture to sit for 16-24 hours. The excess brine was removed, the NaCl-treated bentonite dried at 120-130° C. for 4-6 hours, and the dried material ground to pass through an 80 mesh screen. The dried NaCl-bentonite had a reddish-brown to dark violet color. The 100 mesh iron solids were slurried at 1 part by weight oxidized iron in 24 parts by weight distilled water (4 wt % iron solids). Then 2 parts by weight of the slurry were mixed with 3 parts by weight of the dried 80 mesh bentonite, the resulting paste dried at 400° C. for 2 hours in an oven, and the solids cooled and ground to pass a 60 mesh screen. This oxidized Fe-bentonite, or one prepared in a similar manner, was used in the following examples.

Example 2A: Flash Chemical Ionizing Pyrolysis Tests on Texistepec Crude Oil-LIP Blend in a Lab Reactor with High-Chloride Iron Additive These flash chemical ionizing pyrolysis (FCIP) tests used an externally heated lab scale reactor equipped with a condenser and a bag for non-condensable gases. The feed emulsion was pulsed into the reactor using a spray nozzle at a rate to keep the reactor within a range of about +/−10° C. of the average, 460° C.

Texistepec crude oil was pretreated by heating to a temperature of 150° C. for 1 h to remove water and sediment that settled out. The pretreated crude oil (s.g. 1.221 g/cm$^3$, viscosity 5,676,000 cP at 50° C., Flash point 200° C., boiling point 280° C., Conradson carbon 18.2%) was blended at 70° C. with an LIP obtained from previous FCIP at a weight ratio of crude:LIP of 90:10 to obtain a blend having s.g. of 1.1 g/cm$^3$, viscosity 57,900 cP at 50° C., and Conradson carbon 14.4%. The blend contained 9.96 wt % soluble inorganics.

The feed emulsion was prepared by first mixing the high-chloride iron additive of Example 1B (168 g per 100 kg oil) with 1 M NaCl (876 g NaCl per 100 kg oil) and water (total water 15 kg/100 kg oil) using a high speed blender at ambient temperature, and then mixing the water-NaCl—Fe additive mixture with the oil blend at 70° C. The resulting feed emulsion had density of 1.1 g/cm$^3$ and viscosity at 50° C. of 34,980 cP. The feed emulsion had the composition shown in Table 2:

TABLE 2

FCIP FEED EMULSION, EXAMPLE 2A

| Component | Wt % |
|---|---|
| Hydrocarbons | 78.60 |
| Soluble inorganics | 8.80 |
| Total crude oil | 87.40 |
| Water | 11.77 |
| Fe compound (Example 2B) | 0.143 |
| NaCl | 0.689 |
| Total additives | 12.60 |
| Total | 100.00 |

FCIP of the feed emulsion yielded two immiscible oil layers, a light oil layer (67.5 wt %, hydrocarbons basis) and a heavy oil layer (17.5 wt %, hydrocarbons basis), non-condensable gas (12.8 wt %, hydrocarbons basis), and coke (2.2 wt %, hydrocarbons basis). These surprising results indicate that 97.8 wt % of the Texistepec crude can be recovered as high quality oil and light hydrocarbons. Also recovered were 82.6 wt % of the water (feed basis) and 69.5 wt % of the inorganic solids (total feed basis). The product mix is listed in Table 3:

TABLE 3

FCIP PRODUCT MIX, EXAMPLE 2A

| Component | Wt % |
|---|---|
| LIP #1, light oil phase yield[1] | 67.5 |
| LIP #2, heavier oil phase yield[1] | 17.5 |
| Total oil yield[1] | 85.0 |
| Gas yield[1] | 12.8 |
| Coke yield[1] | 2.2 |
| Total hydrocarbon yield[1] | 100.0 |
| Water yield[2] | 82.6 |
| Solid inorganics yield[3] | 69.5 |

Notes:
[1]based on hydrocarbons in feed emulsion;
[2]based on water in feed emulsion;
[3]based on total feed soluble inorganics, NaCl, and Fe compound The recovered oils were markedly improved with lower density, lower viscosities, lower flash points, lower boiling points, and lower pour points. A comparison of properties with the pretreated Texistepec crude oil and the LIP blend is listed in Table 4:

TABLE 4

OIL PROPERTIES, EXAMPLE 2A

| Property | Units | TXPC | TXPC/LIP Blend (90/10) | LIP-1 | LIP-2 |
|---|---|---|---|---|---|
| Density | °API | <0 | <0 | 28 | 21 |
| Density | g/cm$^3$ | 1.221 | 1.1 | 0.89 | 0.93 |
| Viscosity @ 50° C. | cP | $5.68 \times 10^6$ | $57.9 \times 10^3$ | 5.6 | 34.7 |
| Viscosity @ 50° C. | mm$^2$/s | 12.8 | | 6.6 | 41.1 |
| Viscosity @ 50° C. | SUS | 2.2 | | 30.3 | 189.4 |
| Flash point | ° C. | 200 | | 29 | 64 |
| Boiling point | ° C. | 280 | | 75 | 102 |
| Pour point | ° C. | >30 | | −55 | −35 |
| Conradson carbon | wt % | 18.2 | 14.4 | 2.7 | 4.5 |

It is seen from Tables 3 and 4 that the LIP-1 and LIP-2 are recovered from the FPIC of the Texistepec crude oil in surprisingly high yield. Moreover, LIP-1 and LIP-2 have unexpectedly improved properties indicative of astonishingly high quality as reflected in low densities, low viscosities, low flash points, low boiling points, low pour points and low Conradson carbon contents. The low conversion to coke in the FCIP and the low Conradson carbon contents in the LIP products indicate that thermal processing, e.g., distillation, will result in very little coke make.

Example 2B: Flash Chemical Ionizing Pyrolysis Tests on Texistepec Crude Oil-LIP Blend in a Lab Reactor with Supported Iron Additive These flash chemical ionizing pyrolysis (FCIP) tests used an externally heated lab scale reactor equipped with a condenser and a bag for non-condensable gases as in Example 2A. The feed emulsion was pulsed into the reactor using a spray nozzle at a rate to keep the reactor within a range of about +/−10° C. of the average, 470° C., similar to Example 2A.

As in Example 2A, Texistepec crude oil was pretreated by heating to a temperature of 150° C. for 1 h to remove water and sediment that settled out. The pretreated crude oil (s.g. 1.221 g/cm$^3$, viscosity 5,676,000 cP at 50° C., Flash point 200° C., boiling point 280° C., Conradson carbon 18.2%) was blended at 70° C. with an LIP obtained from previous FCIP, at a weight ratio of crude:LIP of 90:10 to obtain a blend having s.g. of 1.1 g/cm$^3$, viscosity 57,900 cP at 50° C., and Conradson carbon 14.4%. The blend contained 10.1 wt % soluble inorganics.

The feed emulsion was prepared by first mixing the supported iron additive of Example 1C (5 kg per 100 kg oil, 5.4 wt % acidified iron, 4.5 wt % NaCl) with the oil blend at 70° C. using a high speed blender, and then adding the water (15 kg per 100 kg oil). The resulting feed emulsion had density of 1.1 g/cm$^3$ and viscosity at 50° C. of 32,000 cP. The feed emulsion had the composition shown in Table 5:

TABLE 5

| FCIP FEED EMULSION, EXAMPLE 2B | |
|---|---|
| Component | Wt % |
| Hydrocarbons | 76.52 |
| Soluble inorganics | 8.58 |
| Total crude oil | 85.1 |
| Water | 11.50 |
| Fe compound (Example 1C) | 3.4 |
| Total additives | 14.9 |
| Total | 100.00 |

FCIP of the feed emulsion yielded two immiscible oil layers, a light oil layer (61.9 wt %, hydrocarbons feed basis) and a heavy oil layer (27.7 wt %, hydrocarbons feed basis), non-condensable gas (5.1 wt %, hydrocarbons feed basis), and coke (5.3 wt %, hydrocarbons feed basis). These results indicate that 94.7 wt % of the Texistepec crude can be recovered as high quality oil and light hydrocarbons. Also recovered were 93 wt % of the water (feed basis) and 100.2 wt % of the inorganic solids (total feed basis). Compared to Example 2A, Example 2B using the supported catalyst produced less LIP-3 and more coke. The product mix is listed in Table 6:

TABLE 6

| FCIP PRODUCT MIX, EXAMPLE 2B | |
|---|---|
| Component | Wt % |
| LIP-3, light oil phase yield[1] | 61.9 |
| LIP-4, heavier oil phase yield[1] | 27.7 |
| Total oil yield[1] | 89.6 |
| Gas yield[1] | 5.1 |
| Coke yield[1] | 5.3 |
| Total hydrocarbon yield[1] | 100.0 |
| Water yield[2] | 93.0 |
| Solid inorganics yield[3] | 100.2 |

Notes:
[1]based on hydrocarbons in feed emulsion;
[2]based on water in feed emulsion;
[3]based on total feed soluble inorganics, NaCl, and Fe compound It is thus seen that the coke make is greater and the LIP-3 yield is lower when the bentonite was present. Moreover, the solid inorganics yield included spent bentonite, which would require solids removal equipment.

The recovered oils were markedly improved with lower density, lower viscosities, lower flash points, lower boiling points, and lower pour points. However, the values for the LIP-3 were not as good compared to the LIP-1 obtained from Example 2A which was run bentonite-free. A comparison of properties with the pretreated Texistepec crude oil and the LIP blend is listed in Table 7:

TABLE 7

| OIL PROPERTIES, EXAMPLE 2B | | | | | | |
|---|---|---|---|---|---|---|
| Property | Units | TXPC | TXPC/ LIP Blend (90/10) | Emulsion to FCIP | LIP-3 | LIP-4 |
| Density | °API | <0 | <0 | <0 | 24 | 21 |
| Density | g/cm$^3$ | 1.221 | 1.1 | 1.1 | 0.91 | 0.93 |

TABLE 7-continued

| OIL PROPERTIES, EXAMPLE 2B | | | | | | |
|---|---|---|---|---|---|---|
| Property | Units | TXPC | TXPC/ LIP Blend (90/10) | Emulsion to FCIP | LIP-3 | LIP-4 |
| Viscosity @ 50 °C. | cP | 5.68 × 10$^6$ | 57.9 × 10$^3$ | 32 × 10$^3$ | 13 | 21 |
| Viscosity @ 50 °C. | mm$^2$/s | 12.8 | | | 16 | 23 |
| Viscosity @ 50 °C. | SUS | 2.2 | | | 74 | 106 |
| Flash point | °C. | 200 | | | 80 | 85 |
| Boiling point | °C. | 280 | | | 56 | 90 |
| Pour point | °C. | >30 | | | −40 | −35 |
| Conradson carbon | wt % | 18.2 | 14.4 | | 1.8 | 2.2 |

It is seen from Tables 6 and 7 that the LIP-3 and LIP-4 are recovered from the FPIC of the Texistepec crude oil in surprisingly high yield using the bentonite-loaded iron compound and NaCl. Moreover, LIP-3 and LIP-4 have unexpectedly improved properties indicative of high quality as reflected in low densities, low viscosities, low flash points, low boiling points, low pour points and low Conradson carbon contents. The low conversion to coke in the FCIP and the low Conradson carbon contents in the LIP products indicate that thermal processing, e.g., distillation, will result in very little coke make. It is further seen from a comparison of the properties that the LIP-1 of Example 2A prepared without bentonite has a higher proportion of lower molecular weight hydrocarbons than the LIP-3 prepared using bentonite, indicating a higher degree of conversion, as reflected in the lower pour point of LIP-1. It is further seen that the LIP-4 prepared with bentonite has a higher proportion of light fractions and higher quality compared to LIP-3 if the goal is to produce gasoline ranges of hydrocarbons.

Example 3A: Flash Chemical Ionizing Pyrolysis on Maya Crude Oil in a Lab Reactor with High-Chloride Iron Additive These flash chemical ionizing pyrolysis (FCIP) tests used the same lab scale reactor as Example 2A. The feed emulsion was pulsed into the reactor using a spray nozzle at a rate to keep the reactor within a range of about +/−10° C. of the average, 500° C.

A 22° API Maya crude oil was used having s.g. 0.92 g/cm$^3$, viscosity 450 cP at 50° C., flash point 133° C., boiling point 155° C., Conradson carbon 12%, and 1 wt % inorganic solids content. The feed emulsion was prepared by first mixing the high-chloride iron additive of Example 1B (168 g per 100 kg crude) with 0.25 M NaCl (219 g NaCl per 100 kg crude) and water (total water 15 kg/100 kg crude) using a high speed blender at ambient temperature, and then mixing the water-NaCl—Fe additive mixture with the crude oil. The feed emulsion had the composition shown in Table 8:

TABLE 8

| FCIP FEED EMULSION, EXAMPLE 3A | |
|---|---|
| Component | Wt % |
| Hydrocarbons | 85.81 |
| Soluble inorganics | 0.87 |
| Total crude oil | 86.68 |
| Water | 13.00 |
| Fe compound (Example 2B) | 0.144 |
| NaCl | 0.173 |
| Total additives | 13.32 |
| Total | 100.00 |

FCIP of the feed emulsion yielded LIP (89.9 wt %, hydrocarbons basis), non-condensable gas (9.4 wt %, hydrocarbons basis), and coke (0.7 wt %, hydrocarbons basis). These surprising results indicate that 99.3 wt % of the Maya crude can be recovered as high quality oil and light hydrocarbons. Also recovered were 81.8 wt % of the water (feed basis) and 97.0 wt % of the inorganic solids (total feed basis). The product mix is listed in Table 9:

TABLE 9

| FCIP PRODUCT MIX, EXAMPLE 3A | |
|---|---|
| Component | Wt % |
| LIP-5 yield[1] | 89.9 |
| Gas yield[1] | 9.4 |
| Coke yield[1] | 0.7 |
| Total hydrocarbon yield[1] | 100.0 |
| Water yield[2] | 81.8 |
| Solid inorganics yield[3] | 97.0 |

Notes:
[1]based on hydrocarbons in feed emulsion;
[2]based on water in feed emulsion;
[3]based on total feed soluble inorganics, NaCl, and Fe compound The recovered oil LIP-5 was markedly improved with lower density, lower viscosity, lower flash point, lower boiling point, and lower pour point. A comparison of properties with the Maya crude oil and the feed emulsion is listed in Table 10:

TABLE 10

| OIL PROPERTIES, EXAMPLE 3A | | | | |
|---|---|---|---|---|
| Property | Units | Maya Crude | Feed Emulsion | LIP-5 |
| Density | °API | 22 | | 34 |
| Density | g/cm$^3$ | 0.92 | | 0.86 |
| Viscosity @ 50° C. | cP | 450 | | 7.5 |
| Viscosity @ 50° C. | mm$^2$/s | | | |
| Viscosity @ 50° C. | SUS | | | |
| Flash point | ° C. | 133 | | 58 |
| Boiling point | ° C. | 155 | | 70 |
| Pour point | ° C. | | | −57 |
| Conradson carbon | wt % | 12 | | 1.5 |

It is seen from Tables 9 and 10 that the LIP-5 was recovered from the FPIC of the Maya crude oil in surprisingly high yield. Moreover, the LIP-5 had unexpectedly improved properties indicative of astonishingly high quality as reflected in low density, low viscosity, low flash point, low boiling point, low pour point and low Conradson carbon content. The low conversion to coke in the FCIP and the low Conradson carbon content in the LIP-5 product indicate that thermal processing, e.g., FCIP and distillation, will result in very little coke make.

Example 3B: Flash Chemical Ionizing Pyrolysis on Maya Crude Oil in a Lab Reactor with Supported Iron Additive These flash chemical ionizing pyrolysis (FCIP) tests used the same lab scale reactor and Maya crude oil as Example 3A. The feed emulsion was pulsed into the reactor using a spray nozzle at a rate to keep the reactor within a range of about +/−10° C. of the average, 510° C.

The feed emulsion was prepared by first mixing the supported iron additive of Example 1C (5 kg per 100 kg oil, 5.4 wt % acidified iron, 4.5 wt % NaCl) with the oil blend at 70° C. using a high speed blender, and then adding the water (15 kg per 100 kg oil). The resulting feed emulsion had density of 0.96 g/cm$^3$ and viscosity at 50° C. of 270 cP. The feed emulsion had the composition shown in Table 11:

TABLE 11

| FCIP FEED EMULSION, EXAMPLE 3B | |
|---|---|
| Component | Wt % |
| Hydrocarbons | 82.54 |
| Soluble inorganics | 0.83 |
| Total crude oil | 83.37 |
| Water | 12.50 |
| Additive particulates (Example 1C)* | 4.13 |
| Total additives | 16.63 |
| Total | 100.00 |

*Supplying 270 g iron compound and 225 g NaCl per 100 kg crude oil

FCIP of the feed emulsion yielded LIP-6 (93.0 wt %, hydrocarbons basis), non-condensable gas (5.0 wt %, hydrocarbons basis), and coke (2.0 wt %, hydrocarbons basis). These surprising results indicate that 98 wt % of the Maya crude can be recovered as high quality oil and light hydrocarbons. Also recovered were 84.2 wt % of the water (feed basis) and 99.7 wt % of the inorganic solids (total feed basis). The product mix is listed in Table 12:

TABLE 12

| FCIP PRODUCT MIX, EXAMPLE 3B | |
|---|---|
| Component | Wt % |
| LIP-6 yield[1] | 93.0 |
| Gas yield[1] | 5.0 |
| Coke yield[1] | 2.0 |
| Total hydrocarbon yield[1] | 100.0 |
| Water yield[2] | 84.2 |
| Solid inorganics yield[3] | 99.7 |

Notes:
[1]based on hydrocarbons in feed emulsion;
2based on water in feed emulsion;
[3]based on total feed soluble inorganics, NaCl, and Fe compound The recovered oil LIP-6 was markedly improved with lower density, lower viscosity, lower flash point, lower boiling point, and lower pour point. A comparison of properties with the Maya crude oil is listed in Table 13:

TABLE 13

OIL PROPERTIES, EXAMPLE 3B

| Property | Units | Maya Crude | Feed Emulsion | LIP-6 |
|---|---|---|---|---|
| Density | °API | 22 | | 28 |
| Density | g/cm³ | 0.92 | 0.96 | 0.89 |
| Viscosity @ 50° C. | cP | 450 | 270 | 4.7 |
| Viscosity @ 50° C. | mm²/s | | | 7.6 |
| Viscosity @ 50° C. | SUS | | | 35 |
| Flash point | ° C. | 133 | | 54 |
| Boiling point | ° C. | 155 | | 68 |
| Pour point | ° C. | | | −35 |
| Conradson carbon | wt % | 12 | | 2 |

It is seen from Tables 12 and 13 that the LIP-6 was recovered from FPIC of the Maya crude oil in surprisingly high yield. Moreover, the LIP-6 had unexpectedly improved properties indicative of high quality as reflected in low density, low viscosity, low flash point, low boiling point, low pour point and low Conradson carbon content. The low conversion to coke in the FCIP and the low Conradson carbon content in the LIP-6 product indicate that thermal processing, e.g., FCIP and distillation, will result in very little coke make.

It is further seen that the LIP-5 of Example 3A prepared without bentonite is even better than the LIP-6 of Example 3B prepared with bentonite in that the LIP-5 has a lower density and comparable Conradson carbon content. There appear to be no untoward effects from eliminating the bentonite but using the same or similar amounts of the iron compound and NaCl.

Example 4: Steady State Flash Chemical Ionizing Pyrolysis Tests

These flash chemical ionizing pyrolysis (FCIP) tests used a pilot plant scale reactor similar to the direct-heating design shown in FIG. 9, except that only one exchanger downstream from the cyclone was used and there were no solids discharged from the reactor. Instead, a bed of sand was placed in the bottom of the reactor and some solids accumulated on the sand during the test. The reactor was heated by combustion flue gas flowing into the side of the reactor near the bottom. A slurry injection nozzle pointed downwardly (countercurrent to the flue gases) was positioned ⅓ of the way from the top of the reactor toward the bottom to provide a conical spray pattern. The reactor was equipped with thermocouples in the combustion chamber, within the reactor, at the top of the reactor, and in the cyclone.

An emulsion of heavy crude (API <10°) was prepared by heating the crude oil to 70° C., adding water and mixing with an overhead mixer for 10 minutes, then adding the finely divided solids (iron on NaCl-treated bentonite prepared in a manner similar to Example 1C), and mixing for another 5 minutes. The resulting emulsion was composed of 5 parts by weight finely divided solids, 30 parts by weight water (added water plus water in heavy oil sample), and 65 parts by weight oil (heavy oil less water and solids).

The reactor was heated up to operating temperature with combustion gases only before the slurry feed was started. The reactor was then brought to steady state over 1-2 hours at a reactor temperature generally between 400° C. and 600° C., the reactor outlet temperature generally between 300° C. and 400° C., and the cyclone temperature between 200° C. and 300° C. while maintaining the combustion at a steady rate between 1100° C. and 1200° C., adjusting the emulsion feed rate as necessary to obtain the desired temperatures, and collecting the pyrolyzate liquids from the condenser. The recovered liquid ionizing pyrolyzate (LIP) was a low viscosity, low-density (° API >30) liquid representing a recovery of 90 wt % of the oil from the slurry, while non-condensable gases represented just 4 wt % of the oil in the slurry.

Example 5: Flash Chemical Ionizing Pyrolysis with Maya Crude Oil-LIP Blends

In this example, flash chemical ionizing pyrolysis (FCIP) was conducted by the following procedure. The finely divided solids were the iron on NaCl-treated bentonite prepared in a manner similar to Example 1C. The emulsion was prepared with a commercial blender, placed in a tank heated at 90° C., pressurized at 2-8 kg/cm² with inert gas, and fed to a nozzle with a conical spray pattern in a reactor measuring 8 in. diameter by 16 in. long. The reactor was heated using a gas burner, and a sand bed was placed in the reactor at the beginning of the test. The effluent was passed through a water-cooled condenser and the condensate was collected and separated into oil, water, and solids.

A 22° API Maya crude oil was used. The crude had a composition by retort distillation of 71 wt % oil (0-520° C.), 28 wt % heavy hydrocarbons (>520 to 800° C.), and 1 wt % inorganic solids. The physical properties and distillation fractions are described below in Table 14.

First, in Run 5-1, an emulsion was prepared as a baseline using 100% crude, and subjected to FCIP at 470° C. The FCIP product mix obtained a gas yield of 14%, an oil ("LIP-M1") yield of 69% (retort distillation <550-600° C.), a resid yield of 11% (>600° C.), and coke yield of 6%, expressed as percentages of the oil in the FCIP emulsion.

Then an emulsion was prepared in Run 5-2 as an example according to the present invention, using 90% of the crude and 10% of the LIP-M1 from the crude FCIP in Run 5-1, subjected to FCIP at 430° C. The yields were gas 7%, oil ("LIP-B1") 89%, and coke 4%, expressed as percentages of the oil in the FCIP emulsion. These represent yield increases in the oil and decreases in the resid, gas and coke, all to a greater extent than theoretical.

Then another emulsion was prepared for Run 5-3 as another example according to the present invention, again using 90% of the crude and 10% of the LIP-M1 from the crude FCIP in Run 5-1, subjected to FCIP at 470° C., and the yields were gas 3%, oil ("LIP-B2") 93%, and coke 4%, expressed as percentages of the oil in the FCIP emulsion. These likewise represent yield increases in the oil and decreases in the resid, gas and coke, all greater than theoretical relative to LIP-M1. The crude oil, emulsions, and FCIP products had the characteristics shown in Tables 14-15.

It is considered that if the yields of FCIP of oil LIP-M1 alone is assumed to be 100%, then the theoretical oil LIP-B1/LIP-B2 yields from FCIP of the 90:10 blend of Maya crude and LIP-M1 would be (0.9*80.3)+(0.1*100)= 82.3 wt %. However, the resulting yields of 89.3 wt % of LIP-B1 for FCIP at 430° C., and 93.17 of LIP-B2 for FCIP at 470° C. (see Table 14), demonstrated an unexpected synergy in FCIP thermal processing of the blends of Maya crude and LIP-M1. Moreover, the improved quality of the LIP-B1 and LIP-B2, namely an increased level of isomerates, was demonstrated by the lower viscosities at 100° C. and/or 40° C. and higher initial boiling points, relative to the LIP-M1 product.

TABLE 14

| MAYA CRUDE, BLENDS, AND FCIP CHARACTERIZATION | | | | | |
|---|---|---|---|---|---|
| Property | Unit | Maya Crude | Run 5-1 | Run 5-2 | Run 5-3 |
| FLASH CHEMICAL IONIZING PYROLYSIS Emulsion Feed Composition | | | | | |
| Oil (<600° C.) | wt % | N/A | 57.50 | 51.38 | 51.38 |
| Heavy HC | wt % | N/A | 22.68 | 20.26 | 20.26 |
| LIP-M | wt % | N/A | — | 9.04 | 9.04 |
| Water | wt % | N/A | 15.00 | 15.01 | 15.01 |
| Finely divided solids | wt % | N/A | 4.01 | 3.58 | 3.58 |
| Other solids | wt % | N/A | 0.81 | 0.73 | 0.73 |
| Reactor Temperature | ° C. | N/A | 470 | 430 | 470 |
| PRODUCT (LIP) YIELDS | | | | | |
| Oil (<600° C.) | wt % | N/A | 80.38 | 89.3 | 93.17 |
| Gas | wt % | N/A | 13.57 | 6.63 | 3.05 |
| Coke | wt % | N/A | 6.05 | 4.07 | 3.78 |
| OIL PHYSICAL PROPERTIES | | | | | |
| Designation | | Crude | LIP-M1 | LIP-B1 | LIP-B2 |
| °API | °API | 22 | 35.60 | 35.60 | 35.60 |
| Density | g/cm$^3$ | 0.92 | 0.847 | 0.847 | 0.847 |
| Viscosity @ 40° C. | cP | 459.20 | 13.30 | 14.43 | 11.76 |
| Viscosity @ 100° C. | cP | 58.68 | 11.85 | 7.05 | 6.45 |
| Flash Point | ° C. | 133 | 33.4 | 31.0 | 36.0 |
| Initial Boiling Point | ° C. | 155 | 100 | 108 | 145 |
| Conradson carbon | % CC | 11.96 | 1 | 1 | 1 |

TABLE 15

| MAYA CRUDE DISTILLATES CHARACTERIZATION | | | | | |
|---|---|---|---|---|---|
| PROPERTY/FRACTION | F-1 | F-2 | F-3 | F-4 | F-5 |
| Recovery, Weight % | 13.2 | 11.1 | 18.4 | 25.9 | 0 |
| Distillation Temp. (° C.) | <330 | 331-344 | 345-423 | 423-428 | 453-528 |
| °API | 52 | 39 | 35 | 31 | X |
| Density (g/cm$^3$) | 0.77 | 0.83 | 0.85 | 0.87 | X |
| Viscosity @ 50° C. (cP) | nd | nd | 9.63 | 10.35 | X |
| Aniline Point (° C.) | 61 | 65 | 63 | 57 | X |
| Flash Point (° C.) | 32 | 81 | 32 | 35 | X |
| Initial Boiling Point (° C.) | 120 | 145 | 67 | 164 | X |

X = no product;
nd = not determined

Example 6: Flash Chemical Ionizing Pyrolysis of Maya Crude

In Run 6, an 8° API Maya crude oil was subjected to FCIP to produce an LIP (LIP-B3) in a manner similar to LIP-B2 in Run 5-3. SARA analyses of the crude and LIP showed the results in Table 16 below. The LIP unexpectedly had more than twice the saturates, and more than three times the aromatics, slightly less resins, and substantially lower asphaltenes, relative to the crude starting material. This shows that primarily the asphaltenes were converted to saturates and aromatics.

TABLE 16

| SARA ANALYSES OF 8 °API CRUDE AND LIP FROM FCIP | | |
|---|---|---|
| Component | 8 °API Crude | LIP-B3 |
| Saturates, wt | 4 | 10 |
| Aromatics, wt % | 12 | 40 |

TABLE 16-continued

| SARA ANALYSES OF 8 °API CRUDE AND LIP FROM FCIP | | |
|---|---|---|
| Component | 8 °API Crude | LIP-B3 |
| Resins, wt % | 37 | 36 |
| Asphaltenes, wt % | 47 | 14 |

Example 7: Desulfurization of Maya Crude Oil-LIP Blends in Flash Chemical Ionizing Pyrolysis In this example, Maya crude (Run 7-1) and a mixture (Run 7-2) of 85 wt % Maya crude and 15 wt % liquid ionizing pyrolyzate (an LIP-M from FCIP of the Maya crude) were subjected to FCIP in a manner similar to Examples 5 and 6, to study sulfur removal. In FCIP, sulfur can be removed by reduction of organic sulfur compounds by reactive hydrogen radicals to produce $H_2S$, and/or by oxidation of organic sulfur compounds by reaction with HOCl to form $SO_x$ compounds. As determined by ASTM D4294, the Maya crude had an initial sulfur content of 4.4 wt %. When the Maya crude by itself was subjected to FCIP in Run 7-1, the resulting LIP-M2 had an ASTM D4294 sulfur content of 2.7 wt %. However, when the 85:15 blend of Maya crude and LIP-M2 was subjected to FCIP under similar conditions in Run 7-2, the resulting LIP-B4 had an ASTM D4294 sulfur content of 1.5 wt %, demonstrating synergy in sulfur removal when the blend was thermally processed by FCIP. The results are listed in Table 17.

Example 8: Desulfurization of Texistepec Crude Oil-LIP Blends in Flash Chemical Ionizing Pyrolysis In this example, Texistepec crude (Run 8-1) and a mixture (Run 8-2) of 85 wt % Texistepec crude and 15 wt % liquid ionizing pyrolyzate (an "LIP-T" from FCIP of the Texistepec crude) were subjected to FCIP in a manner similar to Example 7, to study sulfur removal. In FCIP, sulfur can be removed by reduction of organic sulfur compounds by reactive hydrogen radicals to produce $H_2S$, and/or by oxidation of organic sulfur compounds by reaction with HOCl to form $SO_x$ compounds. As determined by ASTM D4294, the Texistepec crude had an initial sulfur content of 9.7 wt %. When the Texistepec crude by itself was subjected to FCIP in Run 8-1, the resulting LIP-T1 had an ASTM D4294 sulfur content of 6.6 wt %. However, when the 85:15 blend of Texistepec crude and LIP-T1 was subjected to FCIP under similar conditions in Run 8-2, the resulting LIP-B5 had an ASTM D4294 sulfur content of 5.4 wt %, again demonstrating synergy in sulfur removal when the blend was thermally processed by FCIP. The results are also listed in Table 17.

TABLE 17

| FCIP Desulfurization of Crude and Crude-LIP Blends | | | | |
|---|---|---|---|---|
| FCIP Run | Crude, wt % | LIP, wt % | FCIP Product Designation | ASTM D4294 S content, wt % |
| N/A | Maya, 100 | — | N/A | 4.4 |
| 5-1 | Maya, 100 | — | LIP-M2 | 2.7 |
| 5-2 | Maya, 85 | LIP-M2, 15 | LIP-B4 | 1.5 |
| N/A | Texistepec, 100 | — | N/A | 9.7 |
| 6-1 | Texistepec, 100 | — | LIP-Tl | 6.6 |
| 6-2 | Texistepec, 85 | LIP-T1, 15 | LIP-B5 | 5.4 |

Example 9: Distillation of Maya Crude Oil-LIP Blends

In this example, distillation of 100% Maya crude (22-23° API) was compared with distillation in an identical manner of blends of the Maya crude with 10, 20, and 30 wt % of a liquid ionizing pyrolyzate (LIP-M3) obtained by the flash chemical ionizing pyrolysis (FCIP) of the Maya crude in a manner similar to Example 5. The distillation comprised or was similar to atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET. Table 18 below lists the distillate yields and Conradson carbon residue (CCR) of the distillates from atmospheric and vacuum distillation. These data show that not only were the liquid yields synergistically higher for the crude-LIP blends, the quality of the distillates was unexpectedly improved, as reflected in the substantially lower CCRs of the distillates from the blends.

TABLE 18

DISTILLATE YIELDS AND CCR'S OF CRUDE, LIP, AND BLENDS

| FCIP Run | Maya Crude, wt % | LIP-M3, wt % | Distillation Yield, wt % | Conradson Carbon Residue, wt % |
|---|---|---|---|---|
| 9-1 | 100 | — | 60 | 12 |
| 9-2 | 80 | 20 | 68 | 7.6 |
| 9-3 | 70 | 30 | 74 | 5 |
| 9-4 | — | 100 | 89 | 4 |

The characteristics of the selected fractions of distillation of the Maya crude by itself are similar to those presented in Example 5 and Table 15. The data obtained for characteristics of selected fractions of the distillation of the 90:10 and 80:20 Maya crude:LIP blends are shown in Tables 19 and 20 below. These data show that blending a liquid ionizing pyrolyzate with a crude oil can synergistically increase distillation oil yield and reduce coke and gas yields in excess of theoretical, even assuming the LIP blend component converts 100% to oil and 0% to gas and coke. Moreover, the quality of the recovered oil is also improved, for example, no F-5 fraction was obtained from the Maya crude distilled by itself, but was recovered in both the 10 and 20% LIP blends. The density of each of the fractions F-1 to F-5 in the blends is the same or lower than the Maya crude distillation, e.g., F-1 fraction was lighter as reflected in the degrees API in the 10% LIP distillation, while F-1, F-2, and F-3 in the 20% LIP distillation were lighter (higher API gravity).

TABLE 19

90% MAYA:10% LIP DISTILLATES CHARACTERIZATION

| PROPERTY | F-1 | F-2 | F-3 | F-4 | F-5 |
|---|---|---|---|---|---|
| Recovery, Weight % | 22.5 | 11.3 | 8.0 | 17.9 | 14.1 |
| Distillation Temp. (° C.) | <342 | 343-383 | 384-404 | 405-440 | 441-497 |
| °API | 55 | 39 | 35 | 31 | 29 |
| Density (g/cm$^3$) | 0.76 | 0.83 | 0.85 | 0.87 | 0.88 |
| Viscosity @ 50° C. (cP) | 4.62 | nd | nd | 14.67 | nd |
| Aniline Point (° C.) | 60 | 64 | 62 | 59 | 58 |
| Flash Point (° C.) | 32 | 52 | 88 | 49 | 54 |
| Initial Boiling Point (° C.) | 125 | 220 | 240 | 125 | 130 |

nd = not determined

TABLE 20

80% MAYA:20% LIP DISTILLATES CHARACTERIZATION

| PROPERTY | F-1 | F-2 | F-3 | F-4 | F-5 |
|---|---|---|---|---|---|
| Recovery, Weight % | 19.1 | 9.4 | 14.5 | 20.5 | 14.6 |
| Distillation Temp. (° C.) | <320 | 320-340 | 340-417 | 418-452 | 453-475 |
| ° API | 62 | 45 | 35 | 33 | 31 |
| Density (g/cm$^3$) | 0.73 | 0.8 | 0.85 | 0.86 | 0.87 |
| Viscosity @ 50° C. (cP) | 5.13 | nd | nd | 8.22 | nd |
| Aniline Point (° C.) | 54 | 60 | 60 | 59 | 52 |
| Flash Point (° C.) | 32 | 76 | 45 | 65 | 36 |
| Initial Boiling Point (° C.) | 90 | 160 | 125 | 190 | 150 |

nd = not determined

The properties of the vacuum residuum from the distillation of the Maya crude by itself, the LIP by itself, and the 80:20 and 70:30 blends are listed in Table 21 below. These data show that the resid is unexpectedly improved relative to that from the crude by itself such that a delayed coker is not needed or is only needed for a much lesser volume of coke product. For example, the low CCR values and low flow temperatures of the resid from the blends indicates that the resid can be used as a lube stock, which is a very valuable product compared to resid from distillation of the crude by itself. Moreover, if the resid is processed in a delayed coker, the products from the delayed coker are of much higher quality.

TABLE 21

CHARACTERISTICS OF RESID FROM CRUDE, LIP, AND BLENDS

| Resid Product From | CCR, wt % | Flow T, ° C. |
|---|---|---|
| 100% Maya Crude | 30 | >400 |
| 20% LIP/80% Crude | 18 | 50 |
| 30% LIP/70% Crude | 10 | 40 |
| 100% LIP | 1 | <0 |

Example 10: Diesel Upgrading

Diesel fuel was obtained commercially and blended with an LIP obtained by FCIP of the diesel fuel at a weight ratio of 80:20 diesel:LIP. The blend and the diesel were distilled from 58° C. to 220° C. similarly to the method of Example 7. The product yields are given in Table 22 below. The distillate yields for the fractions 1: 58-100° C., 2: 100-180° C., 3: 180-220° C., and residual (>220° C.) are given in Table 23 below. The aniline points, corresponding to aromatics contents, are presented in Table 24.

TABLE 22

DIESEL AND LIP BLEND DISTILLATION

| Product | Initial Boiling Point, ° C. | Distillate (<220° C.), wt % | Resid (>220° C.), wt % | Gas, wt % | Resid CCR, wt % |
|---|---|---|---|---|---|
| Diesel | 58 | 54 | 44 | 2 | 0 |
| 80:20 blend* | 60 | 83 | 16 | 1 | 0 |

Note:
*= 80 wt % diesel fuel, 20 wt % LIP from FCIP of diesel fuel

TABLE 23

| DIESEL AND BLEND DISTILLATION PRODUCT PROPORTIONS | | | |
|---|---|---|---|
| Product | 58-100° C., wt % | 100-180° C., wt % | 180-220° C., wt % |
| Diesel | 9 | 49 | 42 |
| 80:20 blend* | 20 | 41 | 39 |

Note:
*= 80 wt % diesel fuel, 20 wt % LIP from FCIP of diesel fuel

TABLE 24

| DIESEL/BLEND DISTILLATION PRODUCT ANILINE POINTS | | | | | |
|---|---|---|---|---|---|
| Product | Starting Material | 1st Fraction 58-100° C. | 2nd Fraction 100-180° C. | 3rd Fraction 180-220° C. | Residual >220° C. |
| Diesel | 68 | 56 | 66 | 66 | 76 |
| 80:20 blend* | 66 | 40 | 64 | 64 | 86 |

Note:
*= 80 wt % diesel fuel, 20 wt % LIP from FCIP of diesel fuel

These data show that diesel can be upgraded to lower boiling products in high yield by FCIP and distillation of the LIP blend, with unexpected improvements in yield and properties. Notably, the residual material boiling above the 220° C. cut point from the mix had aniline point of 86 a pour point of −5° C. and a viscosity index of 253, compared to a pour point of −4° C. and a viscosity index of 303 for the residual (>220° C.) of the residual fraction from distillation of the diesel fuel by itself. These data indicate the distillates and resid materials from the diesel-LIP mixtures have excellent properties for a solvent, e.g., for use in an oil-based drilling fluid, or as base stock oils.

TABLE 25

| CHROMATOGRAM COMPARISON OF FIRST FRACTION (<100° C.) | | | | |
|---|---|---|---|---|
| Retention time (min) | Alkane | Relative response area ($\times 10^{-7}$) 1st Diesel Fraction | 1st LIP-Diesel Mix Fraction | % Increase or decrease |
| 12.9 | n-C10 | 3.320 | 5.04 | 51.81 |
| 14.4 | n-C11 | 5.036 | 5.99 | 18.86 |
| 15.6 | n-C12 | 1.532 | 2.507 | 63.64 |
| 16.7 | n-C13 | 1.210 | 2.248 | 85.79 |
| 17.8 | n-C14 | 0.5030 | 1.412 | 180.72 |
| 18.8 | n-C15 | 0.3740 | 7.758 | 107.43 |
| 20.1 | n-C16 | 0.4754 | 0.4304 | −9.47 |
| 25.3 | n-C17 | 0.3850 | 0.2760 | −28.31 |

Moreover, chromatographic analysis shows further unexpected results comparing the distillate fractions and the original diesel and diesel/LIP blend. The samples were analyzed by GC-MS of a 2 μL sample at a concentration of 2 volume percent in methylene chloride through an HP-5MS SEMIVOL column of 30 m length and 0.25 mm ID with a temperature ramp from 50° C. initially held for 6 minutes up to 315° C. at 15° C./minute. The original diesel and the original blend showed no significant difference and the chromatograms were virtually identical. Chromatograms of the first distillate fractions (<100° C.) showed higher response areas for the lower n-alkanes $C_{10-15}$ and lower response areas for the higher n-alkanes $C_{16-17}$ from the blend relative to the first fraction from the diesel itself. These results are shown in Table 25.

Chromatograms of the second distillate fractions (100-180° C.) showed higher response areas for the lower n-alkanes $C_{10-13}$ and lower response areas for the higher n-alkanes $C_{14-17}$ from the blend relative to the second fraction from the diesel itself. These results are shown in Table 26.

TABLE 26

| CHROMATOGRAM COMPARISON OF SECOND FRACTION (<100° C.) | | | | |
|---|---|---|---|---|
| Retention time (min) | Alkane | Relative response area ($\times 10^{-7}$) 2nd Diesel Fraction | 2nd LIP-Diesel Mix Fraction | % Increase or decrease |
| 12.9 | n-C10 | 0.0789 | 2.27 | 2778.40 |
| 14.4 | n-C11 | 0.0517 | 5.49 | 963.70 |
| 15.6 | n-C12 | 0.340 | 2.69 | 693.23 |
| 16.7 | n-C13 | 0.408 | 3.68 | 803.31 |
| 17.8 | n-C14 | 0.558 | 0.404 | −27.62 |
| 18.8 | n-C15 | 0.535 | 0.322 | −39.80 |
| 20.1 | n-C16 | 0.510 | 0.210 | −58.86 |
| 25.3 | n-C17 | 0.491 | 0.163 | −66.91 |

Chromatograms of the third distillate fractions (180-220° C.) showed higher response areas for the lower n-alkanes $C_{10-12}$ and n-alkanes $C_{14-17}$, and a lower response area for the middle-range n-alkane $C_{13}$, from the blend, relative to the third fraction from the diesel itself. These results are shown in Table 27.

TABLE 27

| CHROMATOGRAM COMPARISON OF THIRD FRACTION (<100° C.) | | | | |
|---|---|---|---|---|
| Retention time (min) | Alkane | Relative response area ($\times 10^{-7}$) 3rd Diesel Fraction | 3rd LIP-Diesel Mix Fraction | % Increase or decrease |
| 12.9 | n-C10 | 0.0650 | 0.623 | 858.89 |
| 14.4 | n-C11 | 0.449 | 2.75 | 512.73 |
| 15.6 | n-C12 | 2.70 | 3.05 | 13.05 |
| 16.7 | n-C13 | 4.42 | 3.58 | −19.05 |
| 17.8 | n-C14 | 4.55 | 7.12 | 56.56 |
| 18.8 | n-C15 | 4.25 | 5.19 | 22.21 |
| 20.1 | n-C16 | 4.84 | 5.02 | 3.66 |
| 25.3 | n-C17 | 4.67 | 6.37 | 36.33 |

Figure 10:
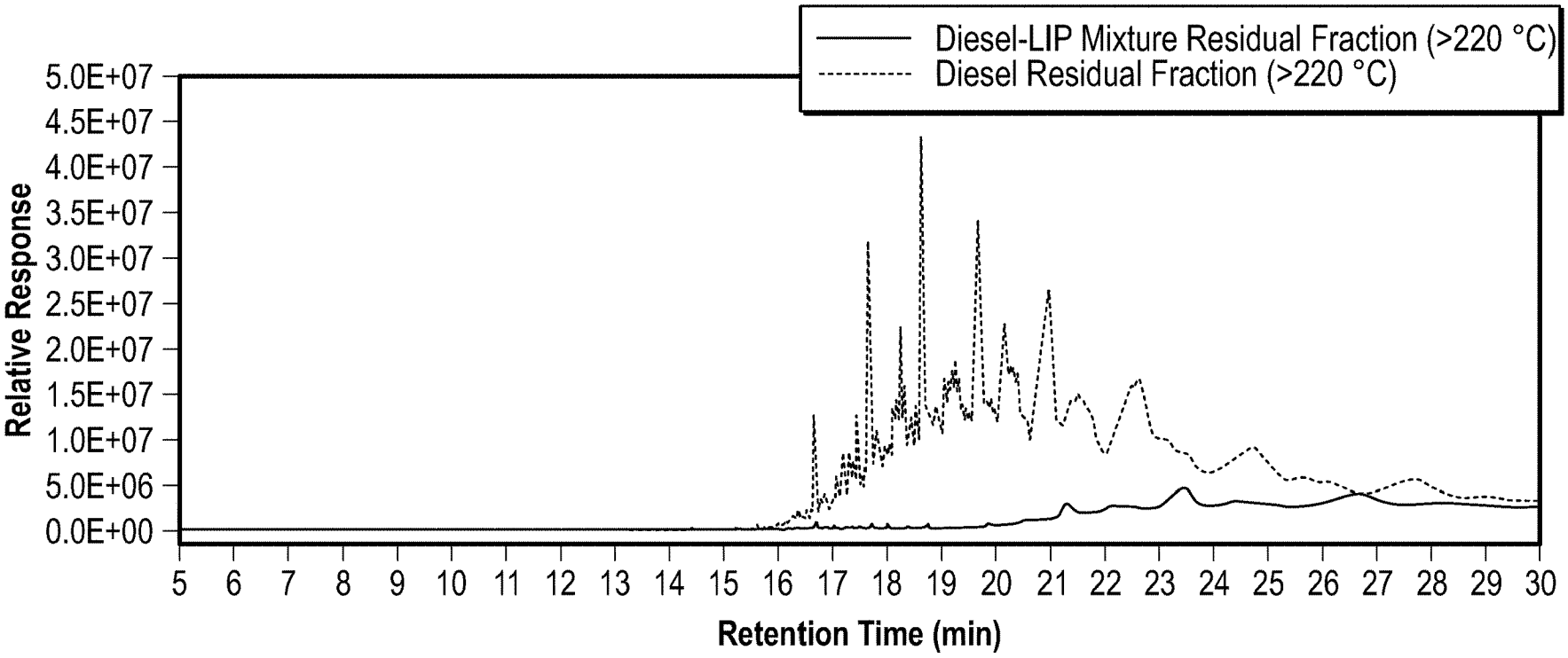
FIG. 10 shows chromatograms of the non-distilled, residual fraction (>220° C.) from the LIP-diesel blend of Example 6 according to an embodiment of the present invention, compared to the residual fraction from the diesel alone.

Chromatograms of the non-distilled, residual fractions (>220° C.) showed the residual from the diesel itself was composed of primarily $C_{12-17}$ hydrocarbons, whereas the residual from the blend was comprised of virtually no $C_{12-16}$ alkanes and consisted almost entirely of $C_{17+}$ hydrocarbons. See the chromatograms shown in FIG. 10.

Example 11: FCIP with Texistepec/Crude Oil-LIP Blends

In this example, flash chemical ionizing pyrolysis (FCIP) was conducted by the following procedure. The finely divided solids were the iron on NaCl-treated bentonite prepared in a manner similar to Example 1C. The emulsion was prepared with a commercial blender, placed in a tank heated at 70-90° C., pressurized at 2-8 kg/cm$^2$ with inert gas, and fed to a nozzle with a conical spray pattern in a reactor measuring 8 in. diameter by 16 in. long. The reactor was heated using a gas burner, and a sand bed was placed in the reactor at the beginning of the test. The effluent was passed through a water-cooled condenser and the condensate was collected and separated into oil, water, and solids.

An 8° API Texistepec crude oil having a viscosity of 144,400 cP at 40° C. was used. The crude had a composition by retort distillation of 46.1 wt % oil (0-600° C.), 40.4 wt % heavy hydrocarbons (>600 to 800° C.), 8.1 wt % water, and 5.4 wt % inorganic solids. First, in Run 11-1, a baseline emulsion was prepared using all crude for the oil (0-600° C.) and heavy HC components, 14 wt % total water, and no finely divided solids other than the solids present in the crude (5.4 wt %), and subjected to flash pyrolysis at 500-550° C. The product ("LIP-T3") yield was just 55.2 wt % oil (<600° C.), 8.4 wt % gas, and 36.4 wt % coke.

Then, in Run 11-2, an emulsion was prepared using all crude for the oil and heavy oil components, 16.2 wt % total water, and 3.8 wt % finely divided solids and subjected to FCIP at 500-550° C. The FCIP product mix obtained a gas yield of 1.3 wt %, an oil ("LIP-T4") yield of 87.7 wt %, and coke yield of 11 wt %, expressed as percentages of the oil in the FCIP emulsion.

Then, in Run 11-3, an emulsion was prepared using 90 wt % of the crude and 10 wt % of the LIP-T4 from Run 11-2, similarly subjected to FCIP at 500-550° C. The yields were gas 1.3 wt %, oil ("LIP-B5") 95.2 wt %, and coke 3.5 wt %, expressed as percentages of the oil in the FCIP emulsion. These represent unexpected yield increases in the oil LIP-B5 and decreases in the resid and coke, all to a greater extent than theoretical (assuming the added LIP-T4 gives 100% oil and 0% coke yield). The results are summarized in Table 28.

TABLE 28

TEXISTEPEC, BLENDS, AND FCIP CHARACTERIZATION

| Property | Unit | TXPC | Run 11-1 | Run 11-2 | Run 11-3 |
|---|---|---|---|---|---|
| FCIP EMULSION FEED COMPOSITION | | | | | |
| Oil (<600° C.) | wt % | 46.1 | 42.6 | 40.1 | 37.4 |
| Heavy HC | wt % | 40.4 | 37.3 | 35.2 | 32.7 |
| LIP-T1 | wt % | — | — | — | 10.0 |
| Water | wt % | 8.1 | 15.2 | 16.2 | 12.7 |
| Finely divided solids | wt % | — | — | 3.8 | 3.5 |
| Other solids | wt % | 5.4 | 4.9 | 4.7 | 3.7 |
| Reactor Temperature | ° C. | N/A | 500-550 | 500-550 | 500-550 |
| PRODUCT YIELDS | | | | | |
| Oil (<600° C.) | wt % | N/A | 55.2 | 87.7 | 95.2 |
| Gas | wt % | N/A | 8.4 | 1.3 | 1.3 |
| Coke | wt % | N/A | 36.4 | 11.0 | 3.5 |
| PRODUCT OIL (LIP) PHYSICAL PROPERTIES | | | | | |
| Oil Designation | | | LIP-T3 | LIP-T4 | LIP-B5 |
| ° API | ° API | 8 | 12 | 21 | 21 |
| Density | g/cm$^3$ | 1.16 | 0.96 | 0.93 | 0.93 |
| Viscosity @ 40° C. | cP | 144,400 | 55 | 52.2 | 44.0 |
| Viscosity @ 100° C. | cP | 4,722 | 22.0 | 19.2 | 17.8 |
| Flash Point | ° C. | 204 | 78 | 75 | 85 |
| Initial Boiling Point | ° C. | 280 | 145 | 142 | 120 |
| Conradson carbon | % CC | 18.2 | 8.0 | 4.0 | 2.8 |

Example 12A: Flash Chemical Ionizing Pyrolysis on Texistepec Crude Oil in a Lab Reactor with Mixed Iron Additive This flash chemical ionizing pyrolysis (FCIP) test used commercially obtained iron compounds hematite ($Fe_2O_3$, industrial grade), magnetite ($Fe_3O_4$, industrial grade), and prepared β-FeOOH, and FeOCl.

β-FeOOH was prepared by adding 100 mL of a 5.4 M NaOH solution (20.147 g NaOH/100 mL of distilled water) dropwise over an equal volume of a solution of $FeCl_3.6H_2O$ (53.8 g in 100 mL of distilled water) at a temperature of 40° C.±2° C. and with constant agitation. The mixture was then placed in an oven at 100° C. for 6 hours. After this time the reaction was stopped by rapid cooling in cold water. The product (15.45 g) was collected by filtration, washed with distilled water, dried at room temperature and crushed to obtain a fine powder.

FeOCl was prepared in a 500 mL ball flask to which was added 7.00 g of $Fe_2O_3$ and 8.20 g of $FeCl_3.6H_2O$. The flask was purged with argon and heated to 370° C. for 30 minutes to carry out the reaction. After cooling, the product (11.16 g) was crushed to obtain a fine powder.

The iron compounds were screened to remove +100 mesh particles, using only the fines that passed through the sieve. The iron compound used in this example was a mixture of equal parts by weight of $Fe_2O_3$, $Fe_3O_4$, β-FeOOH, and FeOCl.

Texistepec crude oil was pretreated by heating to a temperature of 150° C. for 1 h to remove water and sediment that settled out. The pretreated crude oil had s.g. 1.2 g/cm$^3$, viscosity 833,800 cP at 50° C., Flash point 228° C., boiling point 314° C., Conradson carbon 15%. The feed emulsion was prepared by first mixing the blended iron additive (240 g per 100 kg oil) with 1 M NaCl (220 g NaCl per 100 kg oil) and water (total water 15 kg/100 kg oil) using a high speed blender at ambient temperature, and then mixing the water-NaCl—Fe additive mixture with the pretreated Texistepec crude at 70° C. The resulting feed emulsion had density of 1.2 g/cm$^3$ and viscosity at 50° C. of 199,400 cP. The flash chemical ionizing pyrolysis (FCIP) used the same lab scale reactor as Example 2A. The feed emulsion was pulsed into the reactor using a spray nozzle at a rate to keep the reactor within a range of about +/−5° C. of the average, 530° C.

FCIP of the feed emulsion yielded liquid oil (85.8 wt %, hydrocarbons basis), non-condensable gas (1.6 wt %, hydrocarbons basis), and coke (12.7 wt %, hydrocarbons basis). These surprising results indicate that 97.8 wt % of the Texistepec crude can be recovered as high quality oil and light hydrocarbons. Also recovered were 75.2 wt % of the water (feed basis) and 95.6 wt % of the inorganic solids (total feed basis). The product mix is listed in Table 29:

TABLE 29

FCIP PRODUCT MIX, EXAMPLE 4A

| Component | Wt % |
|---|---|
| LIP #7, light oil phase yield[1] | 85.8 |
| Gas yield[1] | 1.6 |
| Coke yield[1] | 12.7 |
| Total hydrocarbon yield[1] | 100.0 |
| Water yield[2] | 75.2 |
| Solid inorganics yield[3] | 95.6 |

Notes:
[1]based on hydrocarbons in feed emulsion;
[2]based on water in feed emulsion;
[3]based on total feed soluble inorganics, NaCl, and Fe additive The recovered oil (LIP-7) was markedly improved with lower density, lower viscosity, lower flash point, lower boiling point, and lower pour point. A comparison of properties with the pretreated Texistepec crude oil and the LIP blend is listed in Table 30:

TABLE 30

OIL PROPERTIES, EXAMPLE 4A

| Property | Units | TXPC | LIP-7 |
|---|---|---|---|
| Density | ° API | | 25 |
| Density | g/cm$^3$ | 1.221 | 0.91 |
| Viscosity @ 50° C. | cP | 8.34 × 10$^5$ | 15.58 |
| Viscosity @ 50° C. | mm$^2$/s | 12.8 | 14.77 |
| Viscosity @ 50° C. | SUS | 2.2 | 68.04 |
| Flash point | ° C. | 228 | 80 |
| Boiling point | ° C. | 314 | 115 |
| Pour point | ° C. | >30 | −28 |
| Conradson carbon | wt % | 15 | 4.61 |

It is seen from Tables 29 and 30 that the LIP-7 was recovered from the FCIP of the Texistepec crude oil in surprisingly high yield. Moreover, LIP-7 has unexpectedly improved properties indicative of astonishingly high quality as reflected in low density, low viscosity, low flash point, low boiling point, low pour point and low Conradson carbon content. These would be further improved by using the Texistepec in a blend with the LIP-7 in the feed emulsion.

Example 12B: Flash Chemical Ionizing Pyrolysis on Texistepec Crude Oil in a Lab Reactor with Mixed Iron Additives (Sans $Fe_3O_4$)

This flash chemical ionizing pyrolysis (FCIP) test used commercially obtained hematite (3 parts by weight), and prepared β-FeOOH (3 parts by weight), and FeOCl (2 parts by weight) as in Example 12A. The feed emulsion was prepared by first mixing the blended iron additive (240 g per 100 kg oil) with 1 M NaCl (220 g NaCl per 100 kg oil) and water (total water 15 kg/100 kg oil) using a high speed blender at ambient temperature, and then mixing the water-NaCl—Fe additive mixture with the pretreated Texistepec crude at 70° C. The resulting feed emulsion had density of 1.16 g/cm$^3$ and viscosity at 50° C. of 137,300 cP. The flash chemical ionizing pyrolysis (FCIP) used the same lab scale reactor as Examples 2A/12A. The feed emulsion was pulsed into the reactor using a spray nozzle at a rate to keep the reactor within a range of about +/−5° C. of the average, 514° C.

FCIP of the feed emulsion yielded liquid oil (81 wt %, hydrocarbons basis), non-condensable gas (1 wt %, hydrocarbons basis), and coke (18 wt %, hydrocarbons basis). These surprising results indicate that 82 wt % of the Texistepec crude can be recovered as high quality oil and light hydrocarbons. Also recovered were 70.7 wt % of the water (feed basis) and 99.9 wt % of the inorganic solids (total feed basis). The product mix is listed in Table 31:

TABLE 31

FCIP PRODUCT MIX, EXAMPLE 12B

| Component | Wt % |
|---|---|
| LIP #8, oil yield[1] | 81 |
| Gas yield[1] | 1 |
| Coke yield[1] | 18 |
| Total hydrocarbon yield[1] | 100.0 |
| Water yield[2] | 70.7 |
| Solid inorganics yield[3] | 99.9 |

Notes:
[1]based on hydrocarbons in feed emulsion;
[2]based on water in feed emulsion;
[3]based on total feed soluble inorganics, NaCl, and Fe additive The recovered oil (LIP-8) was markedly improved with lower density, lower viscosity, lower flash point, lower boiling point, and lower pour point. A comparison of properties with the pretreated Texistepec crude oil is listed in Table 32:

TABLE 32

OIL PROPERTIES, EXAMPLE 4B

| Property | Units | TXPC | LIP-8 |
|---|---|---|---|
| Density | ° API | | 30 |
| Density | g/cm$^3$ | 1.221 | 0.878 |
| Viscosity @ 50° C. | cP | 8.34 × 10$^5$ | 10.19 |
| Viscosity @ 50° C. | mm$^2$/s | 12.8 | 11.03 |
| Viscosity @ 50° C. | SUS | 2.2 | 50.79 |
| Flash point | ° C. | 228 | 76 |
| Boiling point | ° C. | 314 | 120 |
| Pour point | ° C. | >30 | −41 |
| Conradson carbon | wt % | 15 | 1.3 |

It is seen from Tables 31 and 32 that the LIP-8 was recovered from the FCIP of the Texistepec crude oil in surprisingly high yield. Moreover, LIP-8 has unexpectedly improved properties indicative of high quality as reflected in low density, low viscosity, low flash point, low boiling point, low pour point and low Conradson carbon content. These would be further improved by using the Texistepec in a blend with the LIP in the feed emulsion.

Example 12C: Flash Chemical Ionizing Pyrolysis on Texistepec Crude Oil in a Lab Reactor with Mixed Iron Additives (Sans $Fe_2O_3$)

This flash chemical ionizing pyrolysis (FCIP) test used commercially obtained magnetite (3 parts by weight), and prepared β-FeOOH (3 parts by weight), and FeOCl (2 parts by weight) as in Example 12A. The feed emulsion was prepared by first mixing the blended iron additive (240 g per 100 kg oil) with 1 M NaCl (220 g NaCl per 100 kg oil) and water (total water 15 kg/100 kg oil) using a high speed blender at ambient temperature, and then mixing the water-NaCl—Fe additive mixture with the pretreated Texistepec crude at 70° C. The resulting feed emulsion had density of 1.14 g/cm$^3$ and viscosity at 50° C. of 137,300 cP. The flash chemical ionizing pyrolysis (FCIP) used the same lab scale reactor as Examples 2A/4A. The feed emulsion was pulsed into the reactor using a spray nozzle at a rate to keep the reactor within a range of about +/−5° C. of the average, 517° C.

FCIP of the feed emulsion yielded liquid oil (81 wt %, hydrocarbons basis), non-condensable gas (1 wt %, hydrocarbons basis), and coke (18 wt %, hydrocarbons basis). These surprising results indicate that 82 wt % of the Texistepec crude can be recovered as high quality oil and light hydrocarbons. Also recovered were 70.7 wt % of the water (feed basis) and 99.9 wt % of the inorganic solids (total feed basis). The product mix is listed in Table 33:

TABLE 33

| FCIP PRODUCT MIX, EXAMPLE 12B | |
|---|---|
| Component | Wt % |
| LIP #9, oil yield[1] | 81 |
| Gas yield[1] | 1 |
| Coke yield[1] | 18 |
| Total hydrocarbon yield[1] | 100.0 |
| Water yield[2] | 70.7 |
| Solid inorganics yield[3] | 99.9 |

Notes:
[1]based on hydrocarbons in feed emulsion;
[2]based on water in feed emulsion;
[3]based on total feed soluble inorganics, NaCl, and Fe additive The recovered oil (LIP-8) was markedly improved with lower density, lower viscosity, lower flash point, lower boiling point, and lower pour point. A comparison of properties with the pretreated Texistepec crude oil is listed in Table 34:

TABLE 34

| OIL PROPERTIES, EXAMPLE 4C | | | |
|---|---|---|---|
| Property | Units | TXPC | LIP-8 |
| Density | ° API | | 27 |
| Density | g/cm$^3$ | 1.221 | 0.893 |
| Viscosity @ 50° C. | cP | $8.34 \times 10^5$ | 8.15 |
| Viscosity @ 50° C. | mm$^2$/s | 12.8 | 12.44 |
| Viscosity @ 50° C. | SUS | 2.2 | 57.31 |
| Flash point | ° C. | 228 | 70 |
| Boiling point | ° C. | 314 | 140 |
| Pour point | ° C. | >30 | −40 |
| Conradson carbon | wt % | 15 | 1.5 |

It is seen from Tables 33 and 34 that the LIP-9 was recovered from the FCIP of the Texistepec crude oil in surprisingly high yield. Moreover, LIP-9 has unexpectedly improved properties indicative of high quality as reflected in low density, low viscosity, low flash point, low boiling point, low pour point and low Conradson carbon content. These would be further improved by using the Texistepec in a blend with the LIP in the feed emulsion.

The invention has been described above with reference to numerous embodiments and specific examples. Many variations will suggest themselves to those skilled in this art in light of the above detailed description. All such obvious variations are within the full intended scope of the appended claims.

What is claimed is:

1. A hydrocarbon conversion process, comprising the steps of:

mixing an aqueous phase and catalyst particulates comprising iron and chloride with an oil component to form a feed emulsion;

introducing the feed emulsion into a pyrolysis reactor maintained at a temperature greater than about 400° C. up to about 600° C. and a pressure from about 1 to about 1.5 atm to form a pyrolyzate effluent; and condensing a liquid pyrolyzate (LP) from the effluent.

2. The process of claim 1, wherein the catalyst particulates comprise an iron oxide, an iron chloride, or a mixture thereof.

3. The process of claim 1, wherein the catalyst particulates comprise hematite, magnetite, iron oxide hydroxide, iron oxychloride, or a mixture thereof.

4. The process of claim 3 wherein the catalyst particulates comprise a mixture of hematite, magnetite, and iron oxide hydroxide.

5. The process of claim 4, wherein the catalyst particulates further comprise iron chloride.

6. The process of claim 1, wherein the catalyst particulates comprise the reaction product of iron with a mixture of hydrochloric acid and nitric acid in the presence of water.

7. The process of claim 1, wherein the catalyst particulates comprise a mixture of iron oxide hydroxide and iron chloride.

8. The process of claim 7, wherein the catalyst particulates further comprise hematite, magnetite, or a combination thereof.

9. The process of claim 1, wherein the catalyst particulates comprise solid particulates having a major dimension equal to or less than 4 microns.

10. The process of claim 1, wherein the feed emulsion further comprises an alkali or alkaline earth metal chloride source material.

11. The process of claim 10, further comprising first mixing the catalyst particulates, the alkali or alkaline earth metal chloride source material, and the aqueous phase with a first portion of the oil component to form a pre-mix emulsion, and then mixing the pre-mix emulsion with a second portion of the oil component to form the feed emulsion.

12. The process of claim 11, wherein the oil component is present in the pre-mix emulsion in an amount equal to or less than 20 parts by weight per 100 parts by weight of the aqueous phase.

13. The process of claim 10, wherein the catalyst particulates are present in the feed emulsion in an amount of from 0.01 to 5 parts by weight, per 100 parts by weight of the oil component.

14. The process of claim 10, wherein the alkali or alkaline earth metal chloride source material comprises NaCl, KCl, LiCl, $MgCl_2$, $CaCl_2$, $BaCl_2$, or a mixture thereof.

15. The process of claim 10, wherein the alkali or alkaline earth metal chloride source material is present in the feed emulsion in an amount of from 0.01 to 5 parts by weight, per 100 parts by weight of the oil component.

16. The process of claim 1, wherein the catalyst particulates are unsupported, wherein the feed emulsion is essentially free of added clay solids.

17. The process of claim 1, wherein the feed emulsion comprises less than 1 part by weight undissolved solids per 100 parts by weight of the oil component.

18. The process of claim 1, wherein the feed emulsion is essentially free of added solids other than the catalyst particulates and any sediment from the oil component.

19. The process of claim 1, wherein the catalyst particulates further comprise clay.

20. The process of claim 1, wherein the feed emulsion comprises from 1 to 100 parts by weight water per 100 parts by weight of the oil component.

21. The process of claim 1, wherein the reactor temperature is from about 425° C. to about 600° C.

22. The process of claim 1, wherein the pyrolysis reactor comprises a flash chemical ionizing pyrolysis (FCIP) reactor comprising a residence time from 0.1 up to 10 seconds.

23. The process of claim 1, wherein the introduction step comprises spraying the feed emulsion in the pyrolysis reactor.

24. The process of claim 1, wherein the catalyst particulates comprise the product of the method comprising the steps of:

treating iron with an aqueous mixture of hydrochloric and nitric acids to form a product mixture of hematite, magnetite, and beta-ferric oxide hydroxide, wherein the product mixture further comprises chloride;

treating a support material with a chloride brine and drying the treated support material;

combining a slurry of the product mixture with the treated support material to load the product mixture on the support material; and heat treating the loaded support material.

25. The process of claim 1, wherein the oil component comprises hydrocarbons boiling at temperatures less than and greater than 562° C., and wherein the LP is enriched in hydrocarbons boiling at a temperature less than 562° C., as determined by atmospheric distillation in a 15-theoretical plate column at a reflux ratio of 5:1, according to ASTM D2892-18 up to cutpoint 400° C. AET, and by vacuum potstill method according to ASTM D5236-18a above the 400° C. cutpoint to cutpoint 562° C. AET.

26. The process of claim 1 wherein the oil component comprises a heavy oil comprising crude oil, gas oil, resid, or a mixture thereof, preferably a heavy oil.

27. The process of claim 1, further comprising the steps of:

combining a feedstock oil with the LP to form a pyrolyzate-feedstock blend; and thermally processing the blend at a temperature above about 100° C.

28. The process of claim 27, wherein the thermal processing comprises pyrolysis, distillation, cracking, alkylation, visbreaking, coking, or combinations thereof.

29. The process of claim 27, further comprising supplying at least a portion of the pyrolyzate-feedstock blend as the oil component to the feed emulsion preparation step wherein the thermal processing step consists of or comprises spraying of the feed emulsion into the pyrolysis reactor.

30. The process of claim 1, further comprising contacting the feed emulsion in the reactor with superheated steam.

31. The process of claim 1, wherein the feed emulsion comprises less than 1 part by weight solids per 100 parts by weight oil.

* * * * *